US008263299B2

(12) United States Patent
Iemura et al.

(10) Patent No.: US 8,263,299 B2
(45) Date of Patent: Sep. 11, 2012

(54) ELECTROPHOTOGRAPHIC PHOTORECEPTOR, PROCESS CARTRIDGE, AND IMAGE FORMING APPARATUS

(75) Inventors: Kaori Iemura, Kanagawa (JP); Katsumi Nukada, Kanagawa (JP); Hidemi Nukada, Kanagawa (JP); Kazuyuki Nakamura, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 261 days.

(21) Appl. No.: 11/356,351

(22) Filed: Feb. 17, 2006

(65) Prior Publication Data

US 2007/0065741 A1 Mar. 22, 2007

(30) Foreign Application Priority Data

Sep. 21, 2005 (JP) ..... 2005-274621

(51) Int. Cl.
*G03G 5/06* (2006.01)

(52) U.S. Cl. ..... 430/60; 430/56; 430/58.2; 430/66

(58) Field of Classification Search ..... 430/56, 430/58.2, 60, 66
See application file for complete search history.

(56) References Cited

U.S. PATENT DOCUMENTS

| | | | | |
|---|---|---|---|---|
| 5,663,407 | A * | 9/1997 | Shimada et al. | 558/270 |
| 5,795,690 | A * | 8/1998 | Takegawa et al. | 430/58.25 |
| 6,835,512 | B2 * | 12/2004 | Morikawa et al. | 430/58.05 |
| 6,946,226 | B2 | 9/2005 | Wu et al. | |
| 7,105,257 | B2 | 9/2006 | Yamada et al. | |
| 7,251,437 | B2 | 7/2007 | Tamoto et al. | |
| 2003/0054271 | A1 | 3/2003 | Yao et al. | |
| 2003/0142988 | A1 * | 7/2003 | Kimura | 399/49 |
| 2004/0086794 | A1 | 5/2004 | Yamada et al. | |
| 2004/0101771 | A1 * | 5/2004 | Azuma et al. | 430/58.85 |
| 2005/0042533 | A1 | 2/2005 | Wu et al. | |
| 2005/0196193 | A1 * | 9/2005 | Tamoto et al. | 399/111 |
| 2006/0029870 | A1 * | 2/2006 | Nukada et al. | 430/56 |
| 2006/0029872 | A1 * | 2/2006 | Qi et al. | 430/58.8 |
| 2006/0292464 | A1 * | 12/2006 | Yamada et al. | 430/56 |

FOREIGN PATENT DOCUMENTS

| | | |
|---|---|---|
| JP | A-9-197701 | 7/1997 |
| JP | A-2000-3055 | 1/2000 |
| JP | A-2000-10320 | 1/2000 |
| JP | A-2002-082469 | 3/2002 |
| JP | A 2002-318459 | 10/2002 |
| JP | A-2002-318459 | 10/2002 |
| JP | A-2004-086066 | 3/2004 |
| JP | A-2004-126069 | 4/2004 |
| JP | A-2004-302450 | 10/2004 |
| JP | A-2005-070786 | 3/2005 |
| JP | A-2005-164776 | 6/2005 |
| JP | A-2005-249901 | 9/2005 |
| JP | A-2006-025914 | 2/2006 |

OTHER PUBLICATIONS

Information Offer Form submitted on Nov. 5, 2009 with English translation.
Notice of Reasons for Refusal for Application No. 2005-274621; mailed Apr. 20, 2010 (with translation).

* cited by examiner

*Primary Examiner* — Mark F Huff
*Assistant Examiner* — Rachel Zhang
(74) *Attorney, Agent, or Firm* — Oliff & Berridge, PLC

(57) ABSTRACT

An electrophotographic photoreceptor comprises: an electroconductive support; and a photosensitive layer on the electroconductive support, wherein the photosensitive layer having a dynamic hardness of from $20\times10^9$ to $150\times10^9$ N/m$^2$ and an elastic deformation ratio of from 15 to 80%.

18 Claims, 11 Drawing Sheets

ELECTROPHOTOGRAPHIC PHOTORECEPTOR, PROCESS CARTRIDGE, AND IMAGE FORMING APPARATUS

BACKGROUND OF THE INVENTION

1. Field of the Invention

The present invention relates to an electrophotographic photoreceptor, a process cartridge, and an image forming apparatus.

2. Description of the Related Art

As an image forming apparatus using an electrophotographic system, such an apparatus has been conventionally known that steps including charging, exposing, developing, transferring and cleaning are sequentially carried out by using an electrophotographic photoreceptor (hereinafter, sometimes simply referred to as a "photoreceptor"). In the field of the image forming apparatus, improvements in image quality and service life of the apparatus are increasingly demanded in recent years, and improvements of the parts and systems are being investigated to deal with the demands.

For example, a photoreceptor used for writing an image is liable to receive stress upon charging and cleaning, and flaws and abrasion occurring on the surface of the photoreceptor bring about image defects. Members in contact with the photoreceptor (such as a charging roller and a cleaning blade) also receive stress, and it is necessary to prevent these members from being broken.

Accordingly, there has been proposed a method of preventing the surface of the photoreceptor from being damaged and preventing a member in contact with the photoreceptor from being broken by defining the dynamic hardness of the outermost layer of the photosensitive layer to a range of from $13.0\times10^9$ to $100.0\times10^9$ N/m$^2$ (for example, in JP-A-2002-318459).

A system of transferring an image by using an intermediate transfer material is being frequently employed in recent years since the degree of freedom in paper to which the image is transferred. In an image forming apparatus equipped with an intermediate transfer material, however, foreign matters generated in the apparatus or getting into the apparatus intervene between the intermediate transfer material and the photoreceptor in some cases, whereby the photoreceptor is damaged, or the foreign matter sticking into the photoreceptor reach the electroconductive support. The problem is liable to occur particularly in the case where the intermediate transfer material has relatively high hardness in comparison to the electrophotographic photoreceptor. The problem causes photoreceptor leakage (which is such a phenomenon that an overcurrent locally flows in the photoreceptor), which brings about deficiency in image quality, such as colored spots on the formed image.

In recent years, furthermore, as a charging device of an electrophotographic apparatus, a charging device of a contact charging system, such as a charging roll, is being used instead of a non-contact charging device, such as a corona discharge device. A contact charging device has advantages in low ozone generation and low electric power consumption, but a higher voltage is applied to a photoreceptor by using a contact charging device than by using a non-contact charging device, whereby leakage is liable to occur in the photoreceptor suffering the aforementioned problems.

The amount of foreign matters generated in the apparatus (for example, generated from the developer and intermediate transfer medium having been deteriorated) or getting into the apparatus is increased associated with the use of an image forming apparatus for a long period of time, and therefore, it is important that the leakage is prevented from occurring for attaining at a higher level a long service life of the apparatus and high image quality.

One of the aims of the method disclosed in JP-A-2002-318459 is to prevent flaws of a photoreceptor from being formed, but it has been found as a result of investigations by the inventors that the method of JP-A-2002-318459 is insufficient for preventing leakage from occurring, and the photoreceptor disclosed in JP-A-2002-318459 is still has room for improvement in prevention of leakage.

SUMMARY OF THE INVENTION

The invention has been developed under the circumstances and is to provide such an electrophotographic photoreceptor that is capable of sufficiently preventing image defects caused by leakage from being generated to provide a prolonged service life and high image quality, and is also to provide such a process cartridge and an image forming apparatus that have the electrophotographic photoreceptor to attain a prolonged service life and high image quality.

The electrophotographic photoreceptor of the invention contains an electroconductive support and a photosensitive layer provided on the electroconductive support, and the photosensitive layer has a dynamic hardness of from $20\times10^9$ to $150\times10^9$ N/m$^2$ and an elastic deformation ratio of from 15 to 80%.

The "dynamic hardness" referred herein is defined as follows. A Bercovici indenter (a diamond indenter having a triangular pyramid shape with an apical angle of 115° and a nose curvature radius of 0.1 μm or less) is pressed perpendicularly on a surface of a photosensitive layer of an electrophotographic photoreceptor at a stress of 0.3 mN, so as to measure a penetration depth of the indenter. The dynamic hardness in the invention is a value calculated from the penetration depth by using the following equation (1):

$$DH=3.8584\times(P/D^2) \quad (1)$$

wherein DH represents the dynamic hardness (N/m$^2$), P represents the penetration load (N), and D represents the penetration depth (m). The diamond indenter is that mounted on a minute hardness measuring apparatus (DUH-201, produced by Shimadzu Corp.). The penetration depth is read from the displacement of the indenter, and the penetration load is read from a load cell attached to the indenter.

The "elastic deformation ratio" referred herein is defined as follows. A Bercovici indenter (a diamond indenter having a triangular pyramid shape with an apical angle of 115° and a nose curvature radius of 0.1 μm or less) is pressed perpendicularly on a surface of a photosensitive layer of an electrophotographic photoreceptor at a stress of 0.3 mN, and then the stress applied to the indenter is released to 0 mN, so as to measure a penetration depth of the indenter applied with a stress of 0.3 mN and a displacement of the indenter after releasing the stress. The elastic deformation ratio in the invention is calculated from the penetration depth and the displacement of the indenter by using the following equation (2):

$$ED=(D-M)/D\times100 \quad (2)$$

wherein ED represents the elastic deformation ratio (%), M represents the displacement of the indenter after releasing the stress (m), and D represents the penetration depth (m). The diamond indenter is that mounted on a minute hardness measuring apparatus (DUH-201, produced by Shimadzu Corp.). The penetration depth is read from the displacement of the indenter, and the penetration load is read from a load cell attached to the indenter.

The elastic deformation ratio will be further described with reference to the drawing. FIG. 11 is a graph showing the relationship between the penetration load of the indenter and the displacement of the indenter in the aforementioned measurement. In the invention, $P_1$ in FIG. 11 is 0.3 mN. By increasing the stress applied to the indenter penetrating into the photosensitive layer from 0 to $P_1$, the displacement of the indenter penetrating into the photosensitive layer is increased to $D_1$ (curve A-B). Thereafter, by decreasing the stress applied to the indenter from $P_1$ to 0, the indenter is thrust back in such an extent that the photosensitive layer is elastically deformed to change the displacement of the indenter from $D_1$ to $M_1$ (curve B-C). The value $M_1$ means the plastic deformation amount of the photosensitive layer, and a value obtained by subtracting the plastic deformation amount $M_1$ from the total deformation amount $D_1$ ($D_1-M_1$) means the elastic deformation amount of the photosensitive layer. Accordingly, the elastic deformation ratio (%) of the photosensitive layer can be obtained by calculating $(D_1-M_1)/D_1\times100$.

According to the electrophotographic photoreceptor of the invention, image defects caused by leakage can be sufficiently prevented from being generated to provide a prolonged service life and high image quality at a high level.

The reason why the aforementioned advantages of the invention are obtained is expected as follows by the inventors. In the case where the surface of the photosensitive layer is merely hardened as in the method disclosed in JP-A-2002-318459, it is considered that when a fragment of a carrier of a toner or a hard matter getting into the apparatus is stuck into the photosensitive layer, the photosensitive layer is liable to be cracked or chipped from the stuck position, or the foreign matter stuck is difficult to be removed. Therefore, it is considered that the leakage cannot be sufficiently prevented from occurring when the amount of foreign matters generated in the apparatus associated with the use for a long period of time. In the photoreceptor of the invention, on the other hand, the hardness and the elasticity of the photoreceptor are balanced within the aforementioned ranges, and therefore, it is considered that foreign matters are suppressed from being stuck into the photosensitive layer, and simultaneously, even in the case where foreign matters are stuck into the photosensitive layer, the foreign matters can be easily removed until reaching the electroconductive support or the vicinity thereof, and cracking and chipping are prevented from occurring, by means of the appropriate elasticity. That is, it is considered that according to the photoreceptor of the invention, factors of leakage can be sufficiently reduced even when the image forming apparatus is used for a long period of time, whereby deficiency in image quality caused by leakage can be sufficiently prevented from occurring, so as to attain a long service life and high image quality at a high level. It is also considered that the reason why a long service life and high image quality can be attained at a high level also includes that the photosensitive layer is well balanced between hardness and elasticity within the aforementioned ranges, whereby flaws can be prevented from being formed on the photosensitive layer, and a stick-slip phenomenon can be sufficiently prevented from occurring between the photoreceptor and the member in contact with the photoreceptor.

In the case where the dynamic hardness is less than $20\times10^9$ $N/m^2$, electroconductive foreign matters are liable to stick into the photosensitive layer, and the stuck electroconductive foreign matters are liable to reach the electroconductive support, whereby deficiency in image quality due to pinhole leakage cannot be prevented from occurring for a long period of time. In the case where the dynamic hardness exceeds $150\times10^9$ $N/m^2$, when foreign matters are stuck into the photosensitive layer, the photosensitive layer is liable to be cracked or chipped from the stuck position, and thus deficiency in image quality caused by leakage at the defective positions cannot be sufficiently prevented from occurring for a long period of time.

In the case where the elastic deformation ratio is less than 15%, the photosensitive layer is liable to be cracked or chipped due to a fragment of a carrier of a toner or a hard matter getting into the apparatus, and when electroconductive foreign matters are stuck into the photosensitive layer, cracking and chipping from the stuck positions bring about leakage, whereby deficiency in image quality caused by leakage at the defective positions cannot be sufficiently prevented from occurring for a long period of time. In the case where elastic deformation ratio is 80% or more, a stick-slip phenomenon is liable to occur between the photoreceptor and the member in contact with the photoreceptor (such as a cleaning blade and an intermediate transfer material), whereby deficiency in image quality, such as banding, occurs to fail to attain sufficiently high image quality.

The electrophotographic photoreceptor of the invention applied to a color image forming apparatus attains a long service life and high image quality at a higher level than the conventional technique in the following factors. An intermediate transfer material is preferably used when a color image is formed on a recording medium, and when electroconductive foreign matters are stuck into the photoreceptor to cause leakage, beaded color dot defects containing spots in various colors are formed on the recording medium in some cases. According to the electrophotographic photoreceptor of the invention, on the other hand, sticking of foreign matters into the photoreceptor and formation of flaws on the photoreceptor can be sufficiently prevented even though an intermediate transfer material is used, whereby leakage can be sufficiently prevented from occurring, and beaded color dot defects can be sufficiently prevented from being formed on the photoreceptor in a color image forming apparatus.

The process cartridge of the invention contains the electrophotographic photoreceptor of the invention, and at least one selected from the group consisting of a charging unit charging the electrophotographic photoreceptor, a developing unit developing an electrostatic latent image formed on the electrophotographic photoreceptor with a toner to form a toner image, and a cleaning unit removing the toner remaining on a surface of the electrophotographic photoreceptor.

The image forming apparatus of the invention contains the electrophotographic photoreceptor of the invention, a charging unit charging the electrophotographic photoreceptor, an exposing unit forming an electrostatic latent image on the electrophotographic photoreceptor charged, a developing unit developing an electrostatic latent image with a toner to form a toner image, and a transferring unit transferring the toner image from the electrophotographic photoreceptor to a transferring material.

The process cartridge and the image forming apparatus of the invention can provide an image with high quality for a long period of time by the electrophotographic photoreceptor contained therein.

BRIEF DESCRIPTION OF THE DRAWINGS

Preferred embodiments of the present invention will be described in detail based on the following figure, wherein.

DETAILED DESCRIPTION OF THE INVENTION

Figure 1:
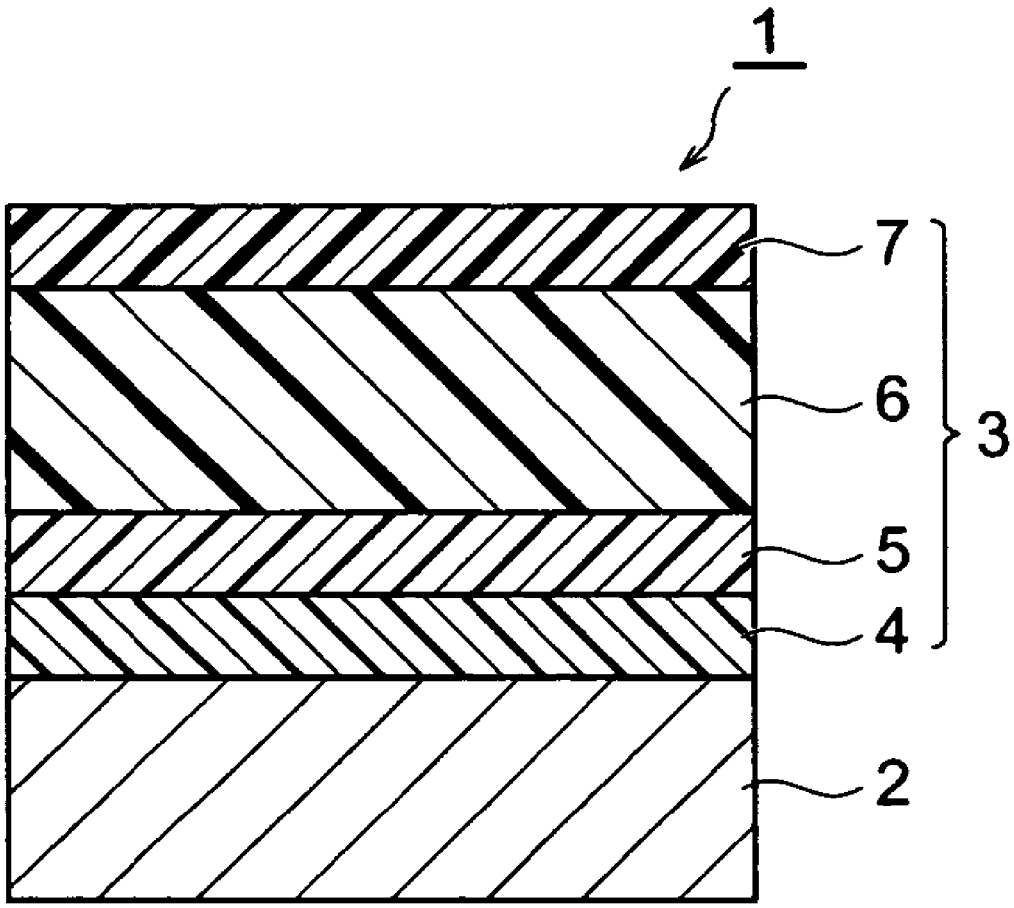
FIG. 1 is a schematic cross sectional view showing a preferred embodiment of the electrophotographic photoreceptor of the invention.

As having been described, the electric photoreceptor of the invention contains an electroconductive support and a photosensitive layer provided on the electroconductive support, and it is necessary that the photosensitive layer has a dynamic hardness of from $20\times10^9$ to $150\times10^9$ N/m$^2$ and an elastic deformation ratio of from 15 to 80%. According to the constitution, image defects caused by leakage can be sufficiently prevented from being generated to attain a long service life and high image quality at a high level.

In the invention, the dynamic hardness of the photosensitive layer is preferably from $25\times10^9$ to $75\times10^9$ N/m$^2$, and more preferably from $25\times10^9$ to $45\times10^9$ N/m$^2$.

The elastic deformation ratio of the photosensitive layer is preferably from 20 to 80%, and more preferably from 20 to 45%.

In the electrophotographic photoreceptor of the invention, it is preferred that the photosensitive layer has an undercoating layer on the photosensitive layer on a side of the electroconductive support, and the undercoating layer contains a composite of an acceptive compound and metallic oxide fine particles. In alternative, it is preferred that the undercoating layer contains metallic oxide fine particles and an acceptive compound having a group capable of being bonded to the metallic oxide fine particles through reaction therewith.

By using the undercoating layer, increase of the residual potential due to repeated use can be sufficiently prevented from occurring by increasing the thickness of the undercoating layer even when the elastic deformation ratio of the photosensitive layer is set at the aforementioned range, whereby electroconductive foreign matters can be securely prevented from reaching the electroconductive support while sufficiently suppressing image quality from being deteriorated. According to the constitution, high image quality can be attained at a further higher level.

In order to obtain the aforementioned advantage securely, the thickness of the undercoating layer is preferably from 15 to 50 μm, and more preferably from 17 to 30 μm.

In the electrophotographic photoreceptor of the invention, it is preferred that the photosensitive layer has a phenol resin-containing layer containing a phenol resin having a crosslinked structure and charge transporting property, on the farthest side of the photosensitive layer from the electroconductive support. The provision of the phenol resin-containing layer improves the wear resistance of the surface of the photosensitive layer to suppress the thickness thereof from being reduced upon using for a long period of time, whereby electroconductive foreign matters can be securely prevented from reaching the electroconductive support. Furthermore, the photosensitive layer is improved in both mechanical strength and electric characteristics, whereby high image quality and a long service life can be attained at a higher level.

The phenol resin-containing layer preferably contains such a phenol resin that is formed from a phenol derivative having a methylol group and a charge transporting material having a reactive functional group. According to the constitution, high image quality and a long service life can be attained at a higher level. It is considered that the advantage is obtained by the following factors. In the case where the phenol resin-containing layer is formed by using the phenol derivative and the charge transporting material, the charge transporting material is chemically bonded in the crosslinked structure of the phenol resin, whereby the phenol resin-containing layer thus formed is further improved in both mechanical strength and electric characteristics.

The charge transporting material preferably has at least one functional group selected from a hydroxyl group, a carboxyl group, an alkoxysilyl group, an epoxy group, a carbonate group, a thiol group and an amino group.

The charge transporting material is preferably a compound represented by the following general formula (I), (II), (III), (IV) or (V):

$$F[—(X^1)_n—R^1\text{-}Z^1H]_m \quad \text{(I)}$$

wherein F represents an organic group derived from a compound having a positive hole transporting capability, $X^1$ represents an oxygen atom or a sulfur atom, $R^1$ represents an alkylene group, $Z^1$ represents an oxygen atom, a sulfur atom, NH or COO, n represents 0 or 1, and m represents an integer of from 1 to 4, $$F[—(X^2)_{n1}—(R^2)_{n2}\text{-}(Z^2)_{n3}G]_{n4} \quad \text{(II)}$$

wherein F represents an organic group derived from a compound having a positive hole transporting capability, $X^2$ represents an oxygen atom or a sulfur atom, $R^2$ represents an alkylene group, $Z^2$ represents an oxygen atom, a sulfur atom, NH or COO, G represents an epoxy group, n1, n2 and n3 each independently represents 0 or 1, and n4 represents an integer of from 1 to 4, $$F[\text{-}D\text{-}Si(R^3)_{(3-a)}Q_a]_b \quad \text{(III)}$$

wherein F represents an organic group derived from a compound having a positive hole transporting capability, D represents a divalent group having flexibility, $R^3$ represents a hydrogen atom, a substituted or unsubstituted alkyl group or a substituted or unsubstituted aryl group, Q represents a hydrolyzable group, a represents an integer of from 1 to 3, and b represents an integer of from 1 to 4, (IV)

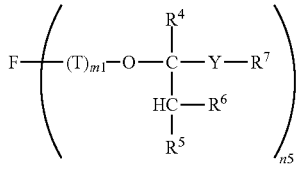

wherein F represents a n5-valent organic group having a positive hole transporting capability, T represents a divalent group, Y represents an oxygen atom or a sulfur atom, $R^4$, $R^5$ and $R^6$ each independently represents a hydrogen atom or a monovalent organic group, $R^7$ represents a monovalent organic group, m1 represents 0 or 1, and n5 represents an integer of from 1 to 4, provided that $R^6$ and $R^7$ may be bonded to form a heterocyclic ring containing Y as a hetero atom, (V)

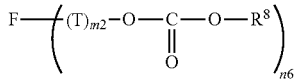

wherein F represents a n6-valent organic group having a positive hole transporting capability, T represents a divalent group, $R^8$ represents a monovalent organic group, m2 represents 0 or 1, and n6 represents an integer of from 1 to 4.

In the case where the phenol resin-containing layer contains at least one compound selected from the compounds represented by the general formulae (I) to (V), the phenol resin-containing layer is further improved in mechanical strength and electric characteristics, whereby high image quality and a long service life can be attained at a higher level.

The electrophotographic photoreceptor of the invention can be obtained, for example, by appropriately selecting the compositions and thickness of the layers constituting the photosensitive layer, which are described in an embodiment of the electrophotographic photoreceptor later, in such a manner that the aforementioned requirements are satisfied.

In the invention, the photosensitive layer has a protective layer and an undercoating layer from the standpoint that a long service life and high image quality are attained securely and easily, and it is particularly preferred that these layers are controlled in composition and thickness to provide a photosensitive layer satisfying the aforementioned requirements.

Preferred embodiments of the invention will be described in detail below with reference to the drawing. In the descriptions of the drawings, the same elements or corresponding elements are attached with the same symbol to omit duplicate descriptions.

(Electrophotographic Photoreceptor)

FIG. 1 is a schematic cross sectional view showing a preferred embodiment of the electrophotographic photoreceptor of the invention. The electrophotographic photoreceptor 1 shown in FIG. 1 is constituted by an electroconductive support 2 and a photosensitive layer 3. The photosensitive layer 3 has a structure containing an undercoating layer 4, a charge generating layer 5, a charge transporting layer 6 and a protective layer 7 accumulated in this order on the electroconductive support 2.

FIGS. 2 to 5 are schematic cross sectional views showing other preferred embodiments of the electrophotographic photoreceptor of the invention. The electrophotographic photoreceptors shown in FIGS. 2 and 3 have a photosensitive layer 3 that is functionally divided into a charge generating layer 5 and a charge transporting layer 6 as similar to the electrophotographic photoreceptor shown in FIG. 1. In the electrophotographic photoreceptors shown in FIGS. 4 and, 5 a charge generating material and a charge transporting material are contained in the same layer (a single photosensitive layer 8).

Figure 2:
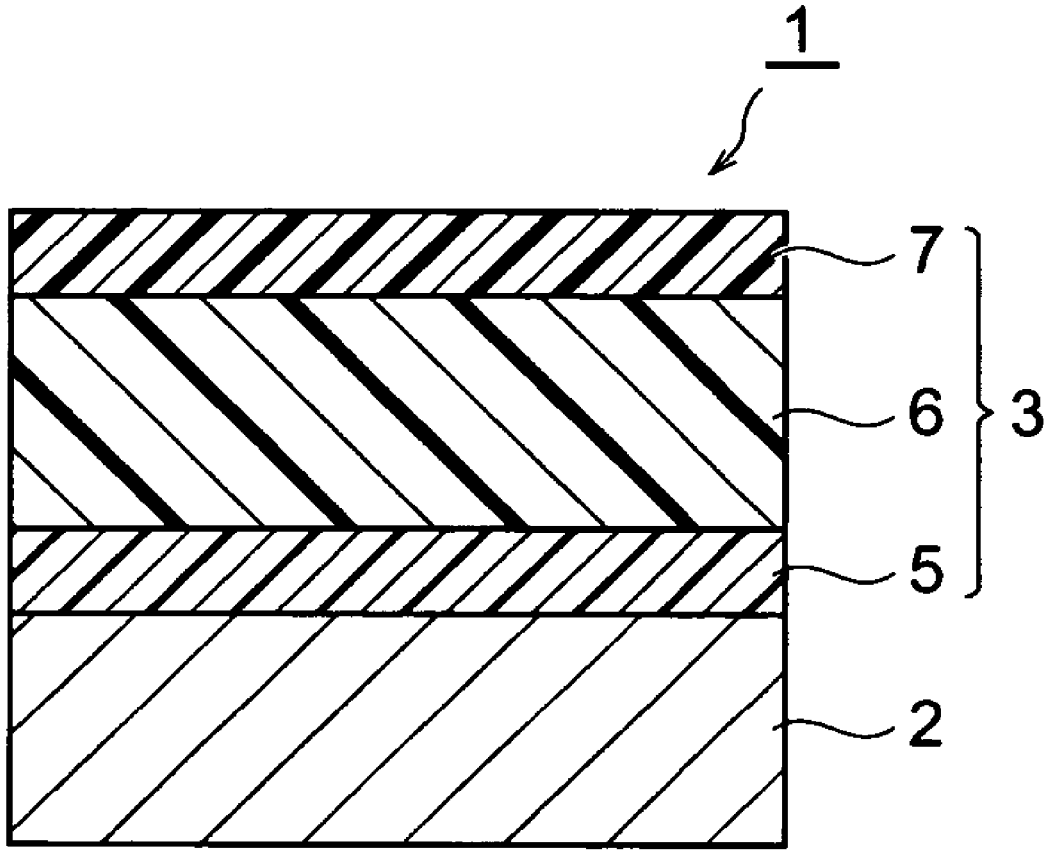
FIG. 2 is a schematic cross sectional view showing another preferred embodiment of the electrophotographic photoreceptor of the invention.
Figure 3:
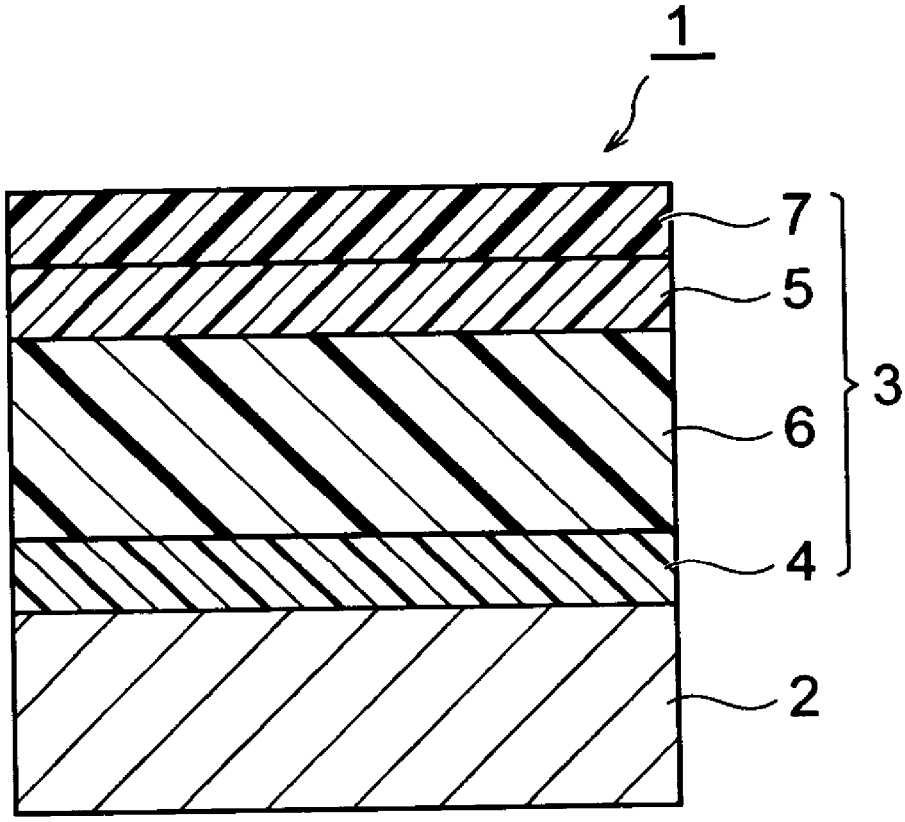
FIG. 3 is a schematic cross sectional view showing still another preferred embodiment of the electrophotographic photoreceptor of the invention.

The electrophotographic photoreceptor 1 shown in FIG. 2 has a structure containing an electroconductive support 2 having accumulated thereon a charge generating layer 5, a charge transporting layer 6 and a protective layer 7 in this order. The electrophotographic photoreceptor 1 shown in FIG. 3 has a structure containing an electroconductive support 2 having accumulated thereon an undercoating layer 4, a charge transporting layer 6, a charge generating layer 5 and a protective layer 7 in this order.

Figure 4:
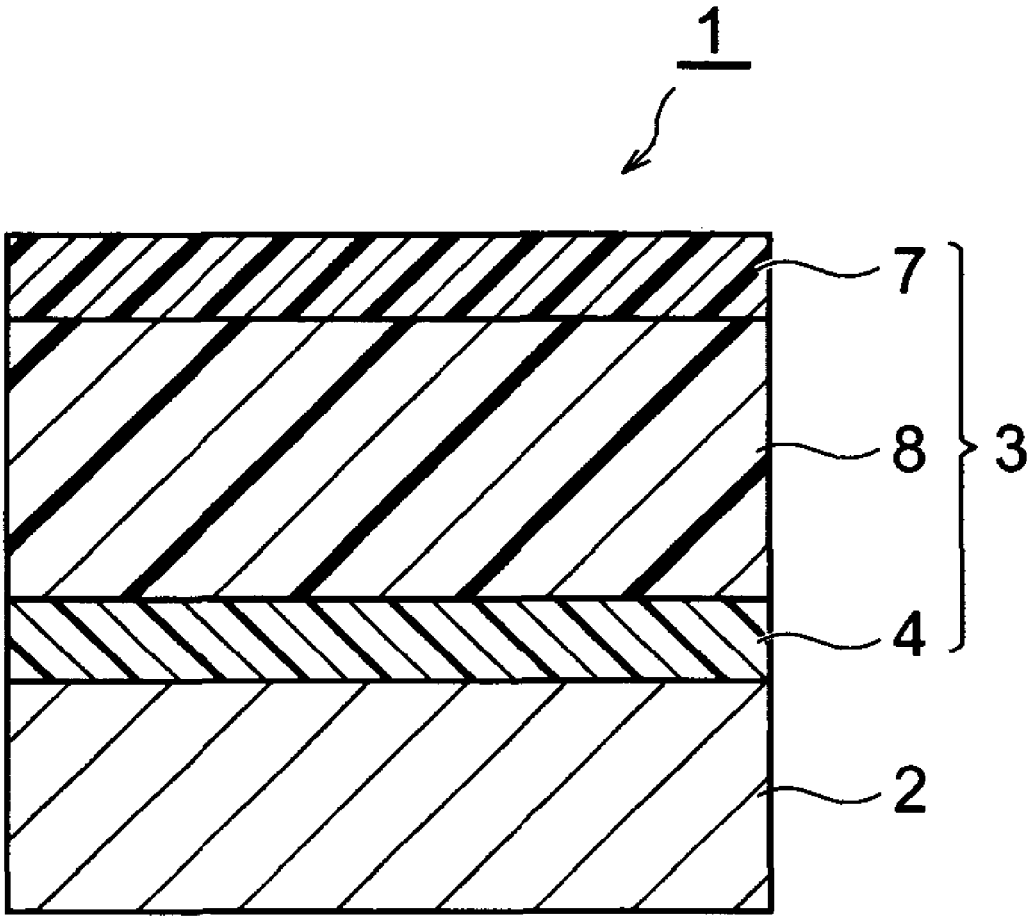
FIG. 4 is a schematic cross sectional view showing a further preferred embodiment of the electrophotographic photoreceptor of the invention.

The electrophotographic photoreceptor 1 shown in FIG. 4 has a structure containing an electroconductive support 2 having accumulated thereon an undercoating layer 4, a single photosensitive layer 8 and a protective layer 7 in this order. The electrophotographic photoreceptor 1 shown in FIG. 5 has a structure containing an electroconductive support 2 having accumulated thereon a single photosensitive layer 8 and a protective layer 7 in this order.

As having been described, the photosensitive layer contained in the electrophotographic photoreceptor of the invention may be either a single photosensitive layer containing a charge generating material and a charge transporting material in the same layer or a function-separated photosensitive layer having a layer containing a charge generating material (charge generating layer) and a layer containing a charge transporting material (charge transporting layer) separately provided. In the case of the function-separated photosensitive layer, the order of accumulation of the charge generating layer and the charge transporting layer is not limited. The function-separated photosensitive layer can attain higher functionality because of the separation in function, i.e., the layers may satisfy only the functions thereof, respectively.

The constitutional elements of the electrophotographic photoreceptor 1 shown in FIG. 1 as a representative example will be described below.

Examples of the electroconductive support 2 include a metallic plate, a metallic drum and a metallic belt constituted by such a material as a metal, e.g., aluminum, copper, zinc, stainless steel, chromium, nickel, molybdenum, vanadium, indium gold and platinum, and an alloy. As the electroconductive support 2, such a material may also be used as paper and a plastic film or belt having coated, vapor-deposited or laminated thereon an electroconductive polymer, an electroconductive compound, such as indium oxide, and a metal or an alloy, such as aluminum, palladium and gold.

The surface of the electroconductive support 2 is preferably roughened to a center line average roughness Ra of from 0.04 to 0.5 μm for preventing interference fringes from occurring upon irradiation with laser light. In the case where the surface roughness Ra of the electroconductive support 2 is less than 0.04 μm, it is closed to a mirror surface to cause such a tendency that interference fringes are insufficiently prevented from occurring. In the case where the surface roughness Ra exceeds 0.5 μm, there is such a tendency that insufficient image quality is obtained even though layers are formed thereon. In the case where incoherent light is used as a light source, there is no necessity of surface roughening for preventing interference fringes from occurring, and the surface of the electroconductive support 2 can be prevented from suffering formation of defects due to irregularity thereon to provide a long service life.

The method of surface roughening is preferably a wet honing method of spraying an abrasive suspended in water onto the support, a centerless grinding method of continuously grinding the support by pressing rotating grinding stone thereon, and an anodic oxidization method.

Other preferred examples of the method of surface roughening include such a method that the surface of the electroconductive support 2 is not directly roughened, but electroconductive or semiconductive powder dispersed in a resin is coated thereon to form a layer on the surface of the support, whereby the surface of the support is roughened with the powder dispersed in the layer.

The anodic oxidation method is to form an oxidation film on a surface of aluminum by subjecting aluminum as an anode to anodic oxidation in an electrolytic solution. Examples of the electrolytic solution include a sulfuric acid solution and an oxalic acid solution. However, the resulting porous anodic oxidation film itself is chemical active and liable to be contaminated, and suffers fluctuation in resistance depending on environments. Accordingly, a sealing treatment is carried out, in which the fine pores of the anodic oxidation film are closed by volume expansion through hydration reaction in pressurized steam or boiling water (to which a metallic salt, such as a nickel salt, may be added) to form a stable hydrous oxide.

The thickness of the anodic oxidation film is preferably from 0.3 to 15 μm. In the case where the thickness is less than 0.3 μm, there is such a tendency that the barrier property against injection is poor to provide insufficient effect. In the case where the thickness exceeds 15 μm, on the other hand, there is such a tendency that the residual potential is increased upon repeated use.

The electroconductive support 2 may be subjected to a treatment with an acidic aqueous solution or a boemite treatment. The treatment with an acidic treating solution containing phosphoric acid, chromic acid and hydrofluoric acid is carried out in the following manner. An acidic treating solution is firstly prepared. The mixing ratio of phosphoric acid, chromic acid and hydrofluoric acid in the acidic treating solution is preferably in a range of from 10 to 11% by weight for phosphoric acid, a range of from 3 to 5% by weight for chromic acid, and a range of from 0.5 to 2% by weight for hydrofluoric acid, and the total concentration of the acids is preferably in a range of from 13.5 to 18% by weight. The treating temperature is preferably from 42 to 48° C., and a thick coating can be formed rapidly by maintaining the treating temperature high. The thickness of the film is preferably from 0.3 to 15 μm. In the case where the thickness is less than 0.3 μm, there is such a tendency that the barrier property against injection is poor to provide insufficient effect. In the case where the thickness exceeds 15 μm, on the other hand, there is such a tendency that the residual potential is increased upon repeated use.

The boemite treatment can be carried out by immersing in pure water at a temperature of from 90 to 100° C. for a period of from 5 to 60 minutes, or making in contact with heated steam at a temperature of from 90 to 120° C. for a period of from 5 to 60 minutes. The thickness of the film is preferably from 0.1 to 5 μm. The film may be further subjected to an anodic oxidation treatment by using an electrolytic solution having a low solubility of the film, such as adipic acid, boric acid, a borate salt, a phosphate salt, a phthalate salt, a maleate salt, a benzoate salt, a tartarate salt and a citrate salt.

The undercoating layer 4 is formed on the electroconductive support 2. The undercoating layer 4 has such a function that charge is prevented from being injected from the electroconductive support 2 to the photosensitive layer 3 upon charging the photosensitive layer 3 having an accumulated structure, and also has a function of an adhesive layer for adhering and retaining the photosensitive layer 3 and the electroconductive support 2 integrally. The undercoating layer 4 may have an antireflection property to light for the electroconductive support 2 in some cases. In the case where a support having been subjected to the acidic solution treatment or the boemite treatment is used, in particular, the support tends to have poor defect hiding power, and thus an undercoating layer is preferably provided.

The electrophotographic photoreceptor of the invention is preferably equipped with an undercoating layer from the standpoint of maintaining an image with high image quality, and the following undercoating layer is preferably provided since the elastic deformation ratio of the photosensitive layer can be easily controlled, and the leakage preventing property can be further improved with suppressing the residual potential from being increased upon repeated use.

The undercoating layer 4 is preferably constituted by containing a composite of an acceptive compound and metallic oxide fine particles, and a binder resin.

As the acceptive compound contained in the composite, any compound may be used that provide the intended characteristics, and a compound having a quinone group is particularly preferably employed. An acceptive compound having an anthraquinone structure is preferably used. Examples of the compound having an anthraquinone structure include, in addition to anthraquinone, a hydroxyanthraquinone compound, an aminoanthraquinone compound and an amonohydroxyanthraquinone compound, which may be preferably used. More specific examples thereof include anthraquinone, alizarine, quinizarin, anthrarufin and purpurin, which may be particularly preferably used.

The metallic oxide fine particles contained in the composite preferably have a powder resistance (volume resistivity) of about from $10^2$ to $10^{11}$ Ω·cm. According to the constitution, the undercoating layer 4 can have a resistance that is suitable for obtaining leakage resistance. In the case where the resistance of the metallic oxide fine particles is lower than the lower limit of the aforementioned range, there is such a tendency that sufficient leakage resistance cannot be obtained, and in the case where it is higher than the upper limit of the range, there is such a tendency that the residual potential is increased.

In this embodiment, it is preferred to use metallic oxide fine particles having the aforementioned resistance, such as tin oxide, titanium oxide, zinc oxide and zirconium oxide. In particular, zinc oxide is preferably used. The metallic oxide fine particles may be a mixture of two or more kinds thereof, such as those having been subjected to different surface treatment, and those having different particle diameters.

The metallic oxide fine particles preferably have a specific surface area of 10 $m^2/g$ or more. Those having a specific surface area less than 10 $m^2/g$ is liable to cause reduction in charging property to provide such a tendency that favorable electrophotographic characteristics cannot be obtained.

Examples of the method of obtaining the composite of an acceptive compound and metallic oxide fine particles include such a method that an acceptive compound dissolved in an organic solvent is added dropwise to metallic oxide fine particles agitated with a mixer having a large shearing force, and the mixture is then sprayed along with dry air or nitrogen to apply the acceptive compound uniformly to the metallic oxide fine particles. The addition and spraying operations of the acceptive compound are preferably carried out at a temperature lower than the boiling point of the solvent. In the case where the spraying operation is carried out at a temperature exceeding the boiling point of the solvent, it is not preferred since the solvent is evaporated before uniformly agitated, and the acceptive compound is locally aggregated to fail to effect a uniform treatment. After the addition or spraying, the mixture may be dried at a temperature exceeding the boiling point of the solvent. Another examples of the method include such a method that metallic oxide fine particles are agitated in a solvent and dispersed with ultrasonic wave, a sand mill, an attritor or a ball mill, to which a solution of an acceptive compound dissolved in an organic solvent is added, and the mixture is agitated or dispersed under refluxing or at a temperature lower than the boiling point of the solvent, followed by removing the solvent, to apply the acceptive compound uniformly to the fine particles. The removal of the solvent may be carried out by filtration, distillation and drying under heating.

The application amount of the acceptive compound may be arbitrary determined within a range providing the intended characteristics, and the acceptive compound is preferably applied to the metallic oxide fine particles in an amount of from 0.01 to 20% by weight, and more preferably applied to the metallic oxide fine particles in an amount of from 0.05 to 10% by weight. In the case where the application amount of the acceptive compound is less than 0.01% by weight, it cannot provide an acceptive property sufficient for contributing to improvement in charge accumulation in the undercoating layer 4, and therefore, it is difficult to obtain an effect of sufficiently suppressing increase in residual potential upon repeated use. In the case where it exceeds 20% by weight, aggregation of the metallic oxide is liable to occur, which complicates formation of a favorable conductive path with the metallic oxide in the undercoating layer 4 upon forming the undercoating layer 4, whereby not only the maintenance property is deteriorated, such as increase in residual potential upon repeated use, but also deficiency in image quality, such as black spots, is liable to occur.

The metallic oxide fine particles may be subjected to a surface treatment before applying the acceptive compound. The surface treating agent may be arbitrarily selected as far as the intended characteristics can be obtained, and may be selected from known materials. Examples thereof include a silane coupling agent, a titanate coupling agent, an aluminum coupling agent and a surfactant. In particular, a silane coupling agent is preferably used since it provides favorable electrophotographic characteristics. A silane coupling agent having an amino group is also preferably used since it imparts favorable blocking property to the undercoating layer 4.

The silane coupling agent having an amino group may be arbitrary selected as far as the intended electrophotographic characteristics can be obtained. Specific examples thereof include γ-aminopropyltriethoxysilane, N-β-(aminoethyl)-γ-aminopropyltrimethoxysilane, N-β-(aminoethyl)-γ-aminopropylmethylmethoxysilane and N,N-bis(β-hydroxyethyl)-γ-aminopropyltriethoxysilane, but the invention is not limited to them.

The silane coupling agent may be used as a mixture of two or more kinds thereof. Examples of a silane coupling agent that can be used in combination with the silane coupling agent having an amino group include vinyltrimethoxysilane, γ-methacryloxypropyl-tris(β-methoxyethoxy)silane, β-(3,4-epoxycyclohexyl)ethyltrimethoxysilane, γ-glycidoxypropyltrimethoxysilane, vinyltriacetoxysilane, γ-mercaptopropyltrimethoxysilane, γ-aminopropyltriethoxysilane, N-β-(aminoethyl)-γ-aminopropyltrimethoxysilane, N-β-(aminoethyl)-γ-aminopropylmethylmethoxysilane, N,N-bis(β-hydroxyethyl)-γ-aminopropyltriethoxysilane and γ-chloropropyltrimethoxysilane, but the invention is not limited to them.

The method of the surface treatment may be arbitrary selected, and a dry method or a wet method may be employed.

In the case where the surface treatment is effected by the dry method, a silane coupling agent is added directly or after dissolving in organic solvent dropwise to metallic oxide fine particles agitated with a mixer having a large shearing force, and the mixture is then sprayed along with dry air or nitrogen to treat uniformly. The addition and spraying operations are preferably carried out at a temperature lower than the boiling point of the solvent. In the case where the spraying operation is carried out at a temperature exceeding the boiling point of the solvent, it is not preferred since the solvent is evaporated before uniformly agitated, and the silane coupling agent is locally aggregated to fail to effect a uniform treatment. After the addition or spraying, the mixture may be subjected to a baking operation at 100° C. or more. The baking operation may be carried out at an arbitrary temperature for an arbitrary period of time as far as the intended electrophotographic characteristics are obtained.

In the case where the surface treatment is effected by the wet method, metallic oxide fine particles are agitated in a solvent and dispersed with ultrasonic wave, a sand mill, an attritor or a ball mill, to which a solution of a silane coupling agent dissolved in an organic solvent is added, and the solvent is removed to treat uniformly. The removal of the solvent may be carried out by filtration, distillation and drying under heating. After removing the solvent, the mixture may be subjected to a baking operation at 100° C. or more. The baking operation may be carried out at an arbitrary temperature for an arbitrary period of time as far as the intended electrophotographic characteristics are obtained. In the wet method, water contained in the metallic oxide fine particles may be removed before adding the surface treating agent, and examples of the method include a method of removing water under agitation and heating in the solvent used for the surface treatment, and a method of removing water through azeotropy with the solvent.

The amount of the silane coupling agent to the metallic oxide fine particles in the undercoating layer 4 may be arbitrarily determined as far as the intended electrophotographic characteristics are obtained.

The binder resin contained in the undercoating layer 4 may be arbitrarily selected from known materials as far as it can form a favorable film, and the intended characteristics are obtained, and examples thereof include known polymer resins, such as an acetal resin, such as polyvinylacetal, a polyvinyl alcohol resin, casein, a polyamide resin, a cellulose resin, gelatin, a polyurethane resin, a polyester resin, a methacrylic resin, an acrylic resin, a polyvinyl chloride resin, a polyvinyl acetate resin, a vinyl chloride-vinyl acetate-maleic anhydride resin, a silicone resin, a silicone-alkyd resin, a phenol resin, a phenol-formaldehyde resin, a melamine resin and a urethane resin, a charge transporting resin having a charge transporting group, and an electroconductive resin, such as polyaniline. Among these, it is preferred to use such a resin that is insoluble in a solvent used for coating an upper layer, and in particular, a butyral resin, a phenol resin, a phenol-formaldehyde resin, a melamine resin, a urethane resin and an epoxy resin are preferably used.

The undercoating layer 4 is preferably constituted by containing metallic oxide fine particles, an acceptive compound having a group capable of being bonded to the metallic oxide fine particles through reaction therewith (hereinafter, sometimes simply referred to as an acceptive compound having a reactive functional group), and a binder resin.

The acceptive compound having a reactive functional group may be selected from any compound that has such a group that is capable of reacting with metallic oxide fine particles providing the intended characteristics, and in particular, a compound having a hydroxyl group is preferably used. An acceptive compound having an anthraquinone structure having a hydroxyl group is preferably used. Examples of the compound having an anthraquinone structure having a hydroxyl group include a hydroxyanthraquinone compound and an aminohydroxyanthraquinone compound, both of which may be preferably used. Specific examples thereof include alizarine, quinizarin, anthrarufin, purpurin, 1-hydroxyanthraquinone, 2-amino-3-hydroxyanthraquinone and 1-amino-4-hydroxyanthraquinone, which may be particularly preferably used.

As the metallic oxide fine particles, those similar to the metallic oxide fine particles used in the aforementioned composite may be used. The metallic oxide fine particles may be subjected to a surface treatment, and a surface treating agent and a surface treating method may be similar to those used in the aforementioned composite.

The acceptive compound having a reactive functional group is preferably mixed in the undercoating layer 4 in an amount of from 0.01 to 20% by weight, and more preferably from 0.05 to 10% by weight, based on the metallic oxide fine particles.

The undercoating layer 4 can be formed by using a coating composition for forming an undercoating layer obtained by dispersing the components constituting the undercoating layer in a solvent. The mixing ratio of the composite and the binder resin, and the mixing ratio of the metallic oxide fine particles, the acceptive compound having a reactive functional group and the binder resin, in the coating composition for forming an undercoating layer may be arbitrary determined within such a range that the intended characteristics of the electrophotographic photoreceptor can be obtained.

Various kinds of additives may be added to the coating composition for forming an undercoating layer in order to improve the environmental stability and image quality. Examples of the additive include such known materials as a quinone compound, such as chloranil and bromoanil, a tetracyanoquinodimethane compound, a fluorenone compound, such as 2,4,7-trinitrofluorenone and 2,4,5,7-tetranitro-9-fluorenone, an oxadiazole compound, such as 2-(4-biphenyl)-5-(4-t-butylphenyl)-1,3,4-oxadiazole, 2,5-bis(4-naphthyl)-1,3,4-oxadiazole and 2,5-bis(4-diethylaminophenyl)-1,3,4-oxadiazole, a xanthone compound, a thiophene compound, a diphenoquinone compound, such as 3,3',5,5'-tetra-t-butyldiphenoquinone, an electron transporting pigment, such as a polycyclic condensed compound and an azo compound, a zirconium chelate compound, a titanium chelate compound, an aluminum chelate compound, a titanium alkoxide compound, an organic titanium compound and a silane coupling agent.

A silane coupling agent is used for the surface treatment of the metallic oxide fine particles, and may also be used as the additive for the coating composition. Specific examples of the silane coupling agent used herein include vinyltrimethoxysilane, γ-methacryloxypropyl-tris(β-methoxyethoxy)silane, β-(3,4-epoxycyclohexyl)ethyltrimethoxysilane, γ-glycidoxypropyltrimethoxysilane, vinyltriacetoxysilane, γ-mercaptopropyltrimethoxysilane, γ-aminopropyltriethoxysilane, N-β-(aminoethyl)-γ-aminopropyltrimethoxysilane, N-β-(aminoethyl)-γ-aminopropylmethylmethoxysilane, N,N-bis(β-hydroxyethyl)-γ-aminopropyltriethoxysilane and γ-chloropropyltrimethoxysilane.

Examples of the zirconium chelate compound include zirconium botoxide, zirconium ethyl acetoacetate, zirconium triethanolamine, acetylacetonate zirconium butoxide, ethyl acetoacetate zirconium butoxide, zirconium acetate, zirconium oxalate, zirconium lactate, zirconium phosphonate, zirconium octanoate, zirconium naphthenoate, zirconium laurate, zirconium stearate, zirconium isostearate, methacrylate zirconium butoxide, stearate zirconium butoxide and isostearate zirconium butoxide.

Examples of the titanium chelate compound include tetraisoprpoyl titanate, tetra-n-butyl titanate, butyl titanate dimer, tetra(2-ethylhexyl)titanate, titanium acetylacetonate, polytitanium acetylacetonate, titanium octylelene glycolate, titanium lactate ammonium salt, titanium lactate, titanium lactate ethyl ester, titanium triethanolaminate and polyhydroxytitanium stearate.

Examples of the aluminum chelate compound include aluminum isopropylate, monobutoxyaluminum diisopropylate, aluminum butylate, diethylacetoacetate aluminum diisopropylate and aluminum tris(ethyl acetoacetate).

These compounds may be used solely or as a mixture or a polycondensate of plural compounds.

The solvent for preparing the coating composition for forming an undercoating layer may be arbitrarily selected from known organic solvent, such as an alcohol solvent, an aromatic solvent, a halogenated hydrocarbon solvent, a ketone solvent, a ketone alcohol solvent, an ether solvent and an ester solvent. Specifically, examples thereof include organic solvents ordinarily used, such as methanol, ethanol, n-propanol, iso-propanol, n-butanol, benzyl alcohol, methylcellosolve, ethylcellosolve, acetone, methyl ethyl ketone, cyclohexanone, methyl acetate, ethyl acetate, n-butyl acetate, dioxane, tetrahydrofuran, methylene chloride, chloroform, chlorobenzene and toluene. These solvents may be used as a mixture of plural kinds thereof. In the case where the solvents are used as a mixture of plural kinds thereof, any combination may be used that can dissolve the binder resin.

The method of dispersing the component may be any known method, such as a roll mill, a ball mill, a vibration ball mill, an attritor, a sand mill, a colloid mill and a paint shaker.

The method of coating the coating composition for forming an undercoating layer may be any ordinary method, such as a blade coating method, a wire bar coating method, a spray coating method, a dip coating method, a bead coating method, an air knife coating method and a curtain coating method.

The undercoating layer is formed by coating the coating composition and then drying the coated composition, and the drying operation may be carried out at any temperature that is capable of evaporating the solvent to form a film.

The undercoating layer 4 preferably has a dynamic hardness of $15\times10^9$ N/m$^2$ or more and an elastic deformation ratio of 25% or more.

The thickness of the undercoating layer 4 may be arbitrarily determined as far as the intended characteristics are obtained, and is preferably 15 μm or more, and more preferably from 15 to 50 μm. In the case where the thickness of the undercoating layer is less than 15 μm, there is such a tendency that sufficient leakage resistance cannot be obtained, and in the case where it exceeds 50 μm, there is such a tendency that the remaining potential remains upon use for a long period of time to cause abnormality in image density.

The surface roughness of the under coating layer 4 is preferably controlled to a range of from ¼n of the wavelength λ of laser light for exposure (wherein n represents the refractive index of the upper layer) to ½λ. In order to control the surface roughness to the range, for example, resin particles may be added to the undercoating layer. Examples of the resin particles include silicone resin particles and crosslinked PMMA resin particles.

The undercoating layer may be polished to control the surface roughness. Examples of the polishing method include a buff polishing method, a sand blasting treatment, a wet honing method and a grinding treatment.

The charge generating layer 5 is constituted by containing a charge generating material or by containing a charge generating material and a binder resin.

Examples of the charge generating material include an azo pigment, such as a bisazo pigment and a trisazo pigment, a perylene pigment, a pyrrolopyrrole pigment, a phthalocyanine pigment, zinc oxide and trigonal selenium. Among these, a metallic or non-metallic phthalocyanine pigment is preferred to laser exposure in a near infrared range, and in particular, hydroxygallium phthalocyanine disclosed in JP-A-5-263007 and JP-A-5-279591, chlorogallium phthalocyanine disclosed in JP-A-5-98181, dichlorotin phthalocyanine disclosed in JP-A-5-140472 and JP-A-5-140473, and titanyl phthalocyanine disclosed in JP-A-4-189873 and JP-A-5-43823 are preferably used. A condensed ring aromatic pigment, such as dibormoanthanthracene, a thioindigo pigment, a porphiradine compound, zinc oxide and trigonal selenium are more preferred to laser exposure in a near ultraviolet range.

The binder resin may be selected from a wide variety of insulating resins, and may be also selected from an organic electroconductive polymer, such as poly-N-vinylcarbazole, polyvinylpyrrolidone, polyvinylpyrene and polysilane. Preferred examples of the binder resin include a polyvinyl butyral resin, a polyarylate resin (such as a polycondensate of a bisphenol compound and an aromatic dicarboxylic acid), a polycarbonate resin, a polyester resin, a phenoxy resin, a vinyl chloride-vinyl acetate copolymer, a polyamide resin, an acrylic resin, a polyacrylamide resin, a polyvinylpyridine resin, a cellulose resin, a urethane resin, an epoxy resin, casein, a polyvinyl alcohol resin and a polyvinylpyrrolidone resin. These binder resins may be used solely or as a mixture of plural kinds thereof. The mixing ratio of the charge generating material and the binder resin is preferably in a range of from 10/1 to 1/10 by weight.

The charge generating layer 5 can be formed by using a coating composition having the charge generating material and the binder resin dispersed in a prescribed solvent. Examples of the solvent include methanol, ethanol, n-propanol, n-butanol, benzyl alcohol, methylcellosolve, ethylcellosolve, acetone, methyl ethyl ketone, cyclohexanone, methyl acetate, n-butyl acetate, dioxane, tetrahydrofuran, methylene chloride, chloroform, chlorobenzene and toluene, which may be used solely or as a mixture of plural kinds thereof.

Examples of the method for dispersing the charge generating material and the binder resin in the solvent include ordinary dispersing methods, such as a ball mill dispersion method, an attritor dispersion method and a sand mill dispersion method. The crystal form of the charge generating material can be prevented from being altered by using these dispersing methods. It is effective on dispersing the charge generating material that the average particle diameter of the charge generating material is 0.5 μm or less, preferably 0.3 μm or less, and more preferably 0.15 μm or less.

The charge generating layer 5 may be formed by using an ordinary coating method, such as a blade coating method, a Meyer bar coating method, a spray coating method, a dip coating method, a bead coating method, an air knife coating method and a curtain coating method.

The thickness of the charge generating layer 5 thus obtained is preferably from 0.1 to 5 μm, and more preferably from 0.2 to 2.0 μm.

The charge transporting layer 6 is constituted by containing a charge transporting material and a binder resin, or by containing a polymer charge transporting material.

Examples of the charge transporting material include an electron transporting compound, examples of which include a quinone compound, such as p-benzoquinone, chloranil, bromoanyl and anthraquinone, a tetracyanoquinodimethane compound, a fluorenone compound, such as 2,4,7-trinitrofluorenone, a xanthone compound, a benzophenone compound, a cyanovinyl compound and an ethylene compound, and a positive hole transporting compound, examples of which include a triarylamine compound, a benzidine compound, an arylalkane compound, an aryl-substituted ethylene compound, a stilbene compound, an anthracene compound and a hydrazone compound. The charge transporting materials may be used solely or as a mixture of plural kinds thereof.

A polymer charge transporting material may also be used as the charge transporting material. Examples of the polymer charge transporting material include known compounds having charge transporting property, such as poly-N-vinylcarbazole and polysilane. In particular, a polyester polymer charge transporting material disclosed in JP-A-8-176293 and JP-A-8-208820 is particularly preferred owing to the high charge transporting property thereof. The polymer charge transporting material may be formed into a film only by itself and may be formed into a film by mixing with a binder resin described later.

A compound represented by the following general formula (a-1), (a-2) or (a-3) is preferred as the charge transporting material from the standpoint of mobility.

(a-1)

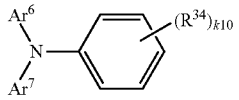

wherein $R^{34}$ represents a hydrogen atom or a methyl group, k10 represents 1 or 2, and $Ar^6$ and $Ar^7$ each represents a substituted or unsubstituted aryl group, $—C_6H_4—C(R^{38})=C(R^{39})(R^{40})$ or $—C_6H_4—CH=CH—CH=(Ar)_2$. Examples of the substituent include a halogen atom, an alkyl group having from 1 to 5 carbon atoms, an alkoxy group having from 1 to 5 carbon atoms, and a substituted amino group substituted with an alkyl group having from 1 to 3 carbon atoms. $R^{38}$, $R^{39}$ and $R^{40}$ each represents a hydrogen atom, a substituted or unsubstituted alkyl group or a substituted or unsubstituted aryl group, and Ar represents a substituted or unsubstituted aryl group.

(a-2)

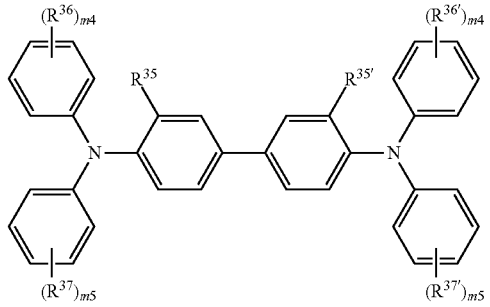

wherein $R^{35}$ and $R^{35'}$ each independently represents a hydrogen atom, a halogen atom, an alkyl group having from 1 to 5 carbon atoms or an alkoxy group having from 1 to 5 carbon atoms, $R^{36}$, $R^{36'}$, $R^{37}$ and $R^{37'}$ each independently represents a halogen atom, an alkyl group having from 1 to 5 carbon atoms, an alkoxy group having from 1 to 5 carbon atoms, an amino group substituted with an alkyl group having 1 or 2 carbon atoms, a substituted or unsubstituted aryl group, —C($R^{38}$)=C($R^{39}$)($R^{40}$) or —CH=CH—CH=C(Ar)$_2$, $R^{38}$, $R^{39}$ and $R^{40}$ each independently represents a hydrogen atom, a substituted or unsubstituted alkyl group or a substituted or unsubstituted aryl group, Ar represents a substituted or unsubstituted aryl group, and m4 and m5 each independently represents an integer of from 0 to 2.

(a-3)

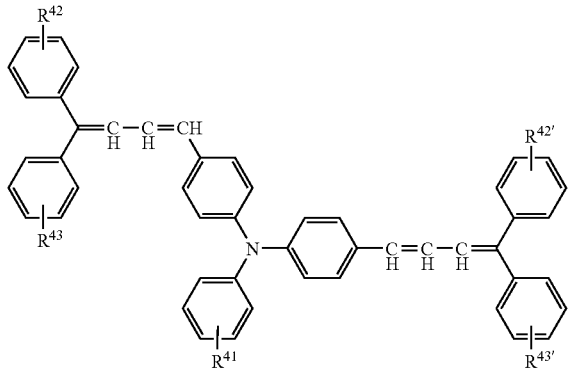

wherein $R^{41}$ represents a hydrogen atom, an alkyl group having from 1 to 5 carbon atoms, an alkoxy group having from 1 to 5 carbon atoms, a substituted or unsubstituted aryl group or —CH=CH—CH=C(Ar)$_2$, Ar represents a substituted or unsubstituted aryl group, $R^{42}$, $R^{42'}$, $R^{43}$ and $R^{43'}$ each independently represents a hydrogen atom, a halogen atom, an alkyl group having from 1 to 5 carbon atoms, an alkoxy group having from 1 to 5 carbon atoms, an amino group substituted with an alkyl group having from 1 or 2 carbon atoms, or a substituted or unsubstituted aryl group.

Examples of the binder resin used in the charge transporting layer 6 include a polycarbonate resin, a polyester resin, a polyarylate resin, a methacrylic resin, an acrylic resin, a polyvinyl chloride resin, a polyvinylidene chloride resin, a polystyrene resin, a polyvinyl acetate resin, a styrene-butadiene copolymer, a vinylidene chloride-acrylonitrile copolymer, a vinyl chloride-vinyl acetate copolymer, a vinyl chloride-vinyl acetate-maleic anhydride copolymer, a silicone resin, a silicone-alkyd resin, a phenol-formaldehyde resin, a styrene-alkyd resin, poly-N-vinylcarbazole resin and polysilane. As having been described, a polymer charge transporting material, such as a polyester polymer charge transporting material, disclosed in JP-A-8-176293 and JP-A-8-208820, may also be used. These binder resins may be used solely or as a mixture of plural kinds thereof. The mixing ratio of the charge transporting material and the binder resin is preferably from 10/1 to 1/5 by weight.

The charge transporting layer 6 can be formed by using a coating composition obtained by dispersing the charge transporting material and the binder resin in a prescribed solvent. Examples of the solvent include ordinary organic solvent, such as an aromatic solvent, such as benzene, toluene, xylene and chlorobenzene, a ketone solvent, such as acetone and 2-butanone, a halogenated aliphatic hydrocarbon solvent, such as methylene chloride, chloroform and ethylene chloride, and a cyclic or linear ether solvent, such as tetrahydrofuran and ethyl ether, which may be used solely or as a mixture of plural kinds thereof.

Examples of the coating method include ordinary coating methods, such as a blade coating method, a Meyer bar coating method, a spray coating method, a dip coating method, a bead coating method, an air knife coating method and a curtain coating method.

The thickness of the charge transporting layer 6 is preferably from 5 to 50 μm, and more preferably from 10 to 30 μm.

The protective layer 7 is preferably a phenol resin-containing layer constituted by containing a phenol resin having charge transporting property and a crosslinked structure. The phenol resin of this kind is preferably that constituted by containing a phenol derivative having a methylol group and a charge transporting material having a reactive functional group. The charge transporting material having a reactive functional group is preferably incorporated in the crosslinked structure as a constitutional component of the phenol resin.

Examples of the phenol derivative having a methylol group include a monomer, such as a monomethylolphenol compound, a dimethylolphenol compound and a trimethylolphenol compound, a mixture thereof, an oligomer thereof, and a mixture of the monomer and the oligomer. The phenol derivative having a methylol group is obtained by reacting a compound having a phenol structure, such as resorcin and bisphenol, a substituted phenol compound having one hydroxyl group, such as phenol, cresol, xylenol, p-alkylphenol and p-phenylphenol, a substituted phenol having two hydroxyl groups, such as catechol, resorcinol and hydroquinone, a bisphenol compound, such as bisphenol A and bisphenol Z, and a bisphenol compound, with formaldehyde, paraformaldehyde or the like in the presence of an acidic catalyst or an alkaline catalyst, and compounds that are commercially available as a phenol resin can be generally used. The term "oligomer" herein means a molecule having a relatively large number of repeating units of about from 2 to 20, and a molecule having a molecular weight smaller than the oligomer is referred to as "monomer" herein.

Examples of the acidic catalyst include sulfuric acid, p-toluenesulfonic acid and phosphoric acid. Examples of the alkaline catalyst include a hydroxide of an alkali metal or an alkaline earth metal, such as NaOH, KOH, $Ca(OH)_2$ and $Ba(OH)_2$, and an amine catalyst.

Examples of the amine catalyst include ammonia, hexamethylenetetramine, trimethylamine, triethylamine and triethanolamine, but the invention is not limited thereto. In the case where a basic catalyst is used, there is such a tendency that carriers are considerably trapped with the catalyst remaining to deteriorate the electrophotographic characteristics. Accordingly, it is preferred that the basic catalyst is deactivated or removed by neutralizing with an acid, or by making in contact with an absorbent, such as silica gel, or an ion exchange resin.

Examples of the charge transporting material having a reactive functional group include a charge transporting material having at least one selected from a hydroxyl group, a carboxyl group, an alkoxy group, an epoxy group, a carbonate group, a thiol group and an amino group.

Preferred examples of the charge transporting material having a reactive functional group include compounds represented by the following general formula (I), (II), (III), (IV) or (V) since they are excellent in film forming property, mechanical strength and stability:

$$F[—(X^1)_n—R^1\text{-}Z^1H]_m \quad (I)$$

wherein F represents an organic group derived from a compound having a positive hole transporting capability, $X^1$ represents an oxygen atom or a sulfur atom, $R^1$ represents an alkylene group, $Z^1$ represents an oxygen atom, a sulfur atom, NH or COO, n represents 0 or 1, and m represents an integer of from 1 to 4, $$F[—(X^2)_{n1}—(R^2)_{n2}\text{-}(Z^2)_{n3}G]_{n4} \quad (II)$$

wherein F represents an organic group derived from a compound having a positive hole transporting capability, $X^2$ represents an oxygen atom or a sulfur atom, $R^2$ represents an alkylene group, $Z^2$ represents an oxygen atom, a sulfur atom, NH or COO, G represents an epoxy group, n1, n2 and n3 each independently represents 0 or 1, and n4 represents an integer of from 1 to 4, $$F[\text{-}D'\text{-}Si(R^3)_{(3-a)}Q_a]_b \quad (III)$$

wherein F represents an organic group derived from a compound having a positive hole transporting capability, D' represents a divalent group having flexibility, $R^3$ represents a hydrogen atom, a substituted or unsubstituted alkyl group (preferably having from 1 to 15 carbon atoms, and more preferably having from 1 to 10 carbon atoms) or a substituted or unsubstituted aryl group (preferably having from 6 to 20 carbon atoms, and more preferably having from 6 to 15 carbon atoms), Q represents a hydrolyzable group, a represents an integer of from 1 to 3, and b represents an integer of from 1 to 4, (IV)

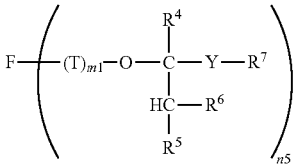

wherein F represents a n5-valent organic group having a positive hole transporting capability, T represents a divalent group, Y represents an oxygen atom or a sulfur atom, $R^4$, $R^5$ and $R^6$ each independently represents a hydrogen atom or a monovalent organic group, $R^7$ represents a monovalent organic group, m1 represents 0 or 1, and n5 represents an integer of from 1 to 4, provided that $R^6$ and $R^7$ may be bonded to form a heterocyclic ring containing Y as a hetero atom, (V)

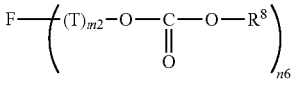

wherein F represents a n6-valent organic group having a positive hole transporting capability, T represents a divalent group, $R^8$ represents a monovalent organic group, m2 represents 0 or 1, and n6 represents an integer of from 1 to 4.

Among the charge transporting materials represented by the general formulae (I) to (V), a compound having a structure represented by the following general formula (VI) is more preferred:

(VI)

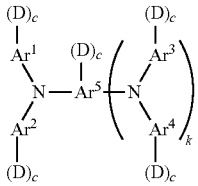

wherein Ar1 to Ar4, which may be the same or different, each represents a substituted or unsubstituted aryl group, Ar5 represents a substituted or unsubstituted aryl group or an arylene group, c each independently represents 0 or 1, k represents 0 or 1, and D represents a monovalent organic group represented by the following general formula (VII), (VIII), (IX), (X) or (XI), provided that the total number of c is from 1 to 4:

$$—(X^1)_n—R^1\text{-}Z^1H \quad (VII)$$

wherein $X^1$ represents an oxygen atom or a sulfur atom, $R^1$ represents an alkylene group, $Z^1$ represents an oxygen atom, a sulfur atom, NH or COO, and n represents 0 or 1, $$—(X^2)_{n1}—(R^2)_{n2}\text{-}(Z^2)_{n3}G \quad (VIII)$$

wherein $X^2$ represents an oxygen atom or a sulfur atom, $R^2$ represents an alkylene group, $Z^2$ represents an oxygen atom, a sulfur atom, NH or COO, G represents an epoxy group and n1, n2 and n3 each independently represents 0 or 1, $$\text{-}D'\text{-}Si(R^3)_{(3-a)}Q_a \quad (IX)$$

wherein $D^1$ represents a divalent group having flexibility, $R^3$ represents a hydrogen atom, a substituted or unsubstituted alkyl group or a substituted or unsubstituted aryl group, Q represents a hydrolyzable group, and a represents an integer of from 1 to 3, (X)

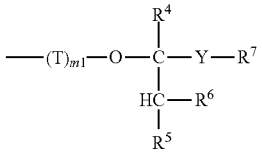

wherein T represents a divalent group, Y represents an oxygen atom or a sulfur atom, $R^4$, $R^5$ and $R^6$ each independently represents a hydrogen atom or a monovalent organic group, $R^7$ represents a monovalent organic group, and m1 represents 0 or 1, provided that $R^6$ and $R^7$ may be bonded to form a heterocyclic ring containing Y as a hetero atom, (XI)

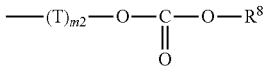

wherein T represents a divalent group, $R^8$ represents a monovalent organic group, and m2 represents 0 or 1.

As the substituted or unsubstituted aryl group represented by $Ar^1$ to $Ar^4$ in the general formula (VI), aryl groups represented by the following general formulae (1) to (7) are preferred.

(1)

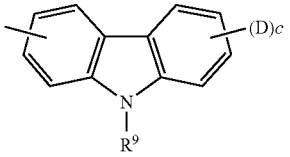

(2)

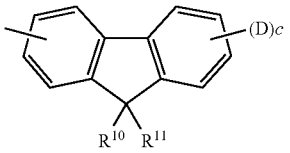

(3)

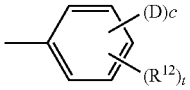

(4)

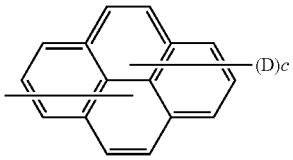

(5)

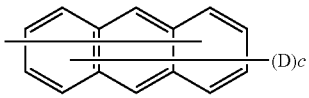

(6)

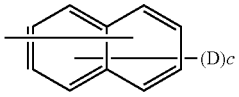

(7)

In the general formulae (1) to (7), $R^9$ represents a hydrogen atom, an alkyl group having from 1 to 4 carbon atoms, an alkoxy group having from 1 to 4 carbon atoms, a phenyl group substituted with these groups, an unsubstituted phenyl group or an aralkyl group having from 7 to 10 carbon atoms, $R^{10}$ to $R^{12}$ each represents a hydrogen atom, an alkyl group having from 1 to 4 carbon atoms, an alkoxy group having from 1 to 4 carbon atoms, an alkoxy group having from 1 to 4 carbon atoms, a phenyl group substituted with these groups, an unsubstituted phenyl group, an aralkyl group having from 7 to 10 carbon atoms or a halogen atom, Ar represents a substituted or unsubstituted arylene group, D represents one of structures represented by the general formulae (VII) to (XI), Z' represents a divalent group, c and s each represents 0 or 1, and t represents an integer of from 1 to 3.

As the group represented by Ar in the aryl group represented by the general formula (7), arylene groups represented by the following general formulae (8) and (9) are preferred:

(8)

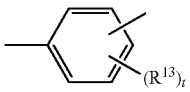

-continued (9)

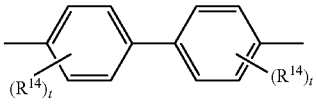

In the general formulae (8) and (9), $R^{13}$ and $R^{14}$ each represents a hydrogen atom, an alkyl group having from 1 to 4 carbon atoms, an alkoxy group having from 1 to 4 carbon atoms, a phenyl group substituted with an alkoxy group having from 1 to 4 carbon atoms, an unsubstituted phenyl group, an aralkyl group having from 7 to 10 carbon atoms or a halogen atom, and t each represents an integer of from 1 to 3.

As the group represented by Z'in the aryl group represented by the general formula (7), divalent groups represented by the following general formulae (10) to (17) are preferred:

(10)

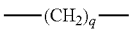

(11)

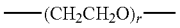

(12)

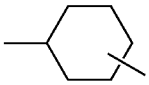

(13)

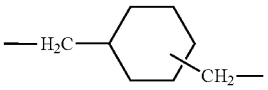

(14)

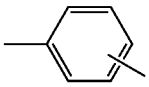

(15)

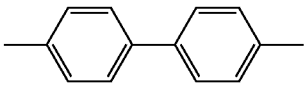

(16)

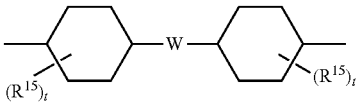

(17)

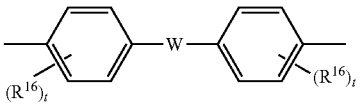

In the general formulae (10) to (17), $R^{15}$ and $R^{16}$ each represents a hydrogen atom, an alkyl group having from 1 to 4 carbon atoms, an alkoxy group having from 1 to 4 carbon atoms, a phenyl group substituted with an alkoxy group having from 1 to 4 carbon atoms, an unsubstituted phenyl group, an aralkyl group having from 7 to 10 carbon atoms or a halogen atom, W represents a divalent group, q and r each represents an integer of from 1 to 10, and t each represents an integer of from 1 to 3.

In the general formulae (16) and (17), W represents a divalent group represented by one of the following general formulae (18) to (26), in which u in the general formula (25) represents an integer of from 0 to 3:

(18) $—CH_2—$

(19) $—C(CH_3)_2—$

(20) —O—

(21) —S—

(22) $—C(CF_3)_2—$

(23) $—Si(CH_3)_2—$ (24)

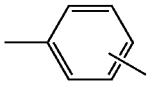

(25)

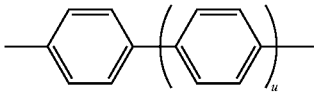

(26)

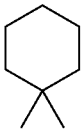

Specific examples of the structure of $Ar^5$ in the general formula (VI) include the aforementioned specific structures of $Ar^1$ to $Ar^4$ where c=1 for the case of k=0, and the aforementioned specific structures of $Ar^1$ to $Ar^4$ where c=0 for the case of k=1.

Specific examples of the compound represented by the general formula (I) include the following compounds (I-1) to (I-37). In the following formulae representing the compounds, a chemical bond shown with no substituent represents a methyl group.

I-1

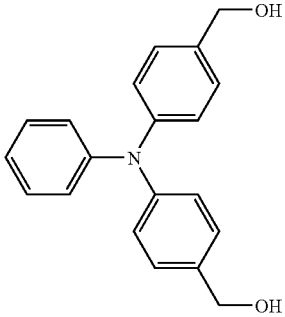

-continued

I-2

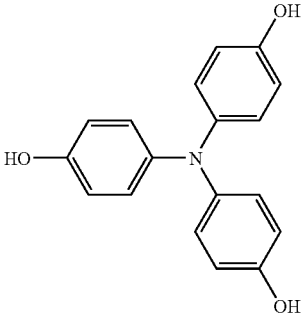

I-3

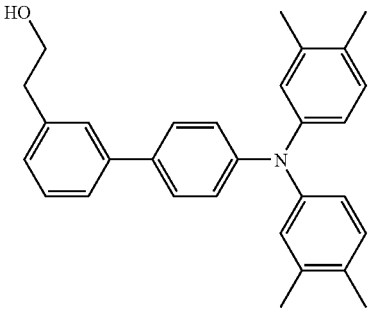

I-4

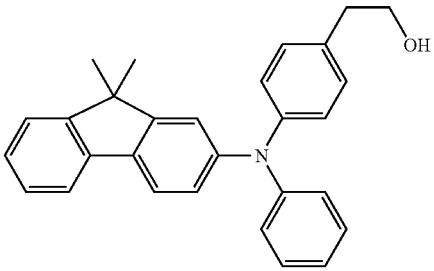

I-5

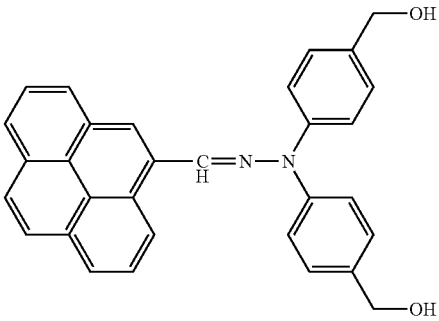

I-6

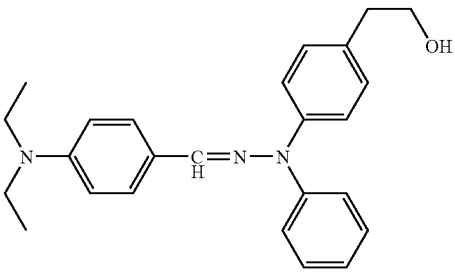

-continued
I-7
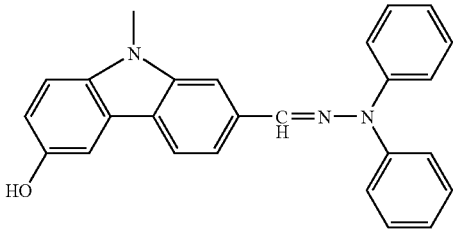
I-8
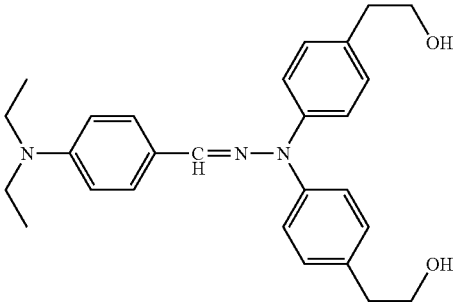
I-9
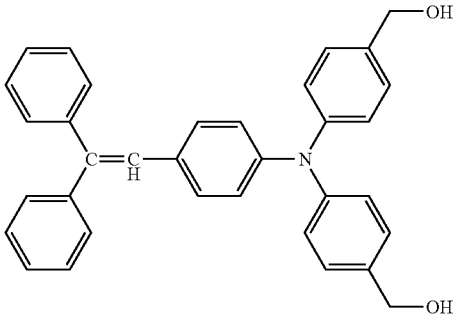
I-10
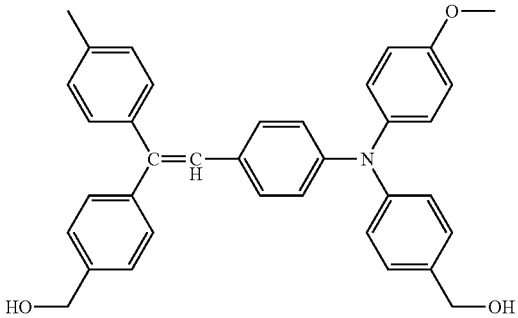
I-11
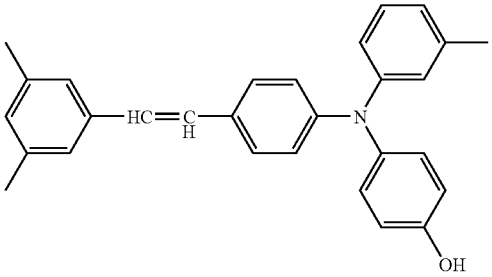
-continued
I-12
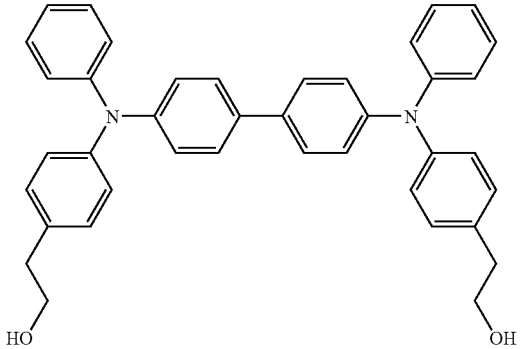
I-13
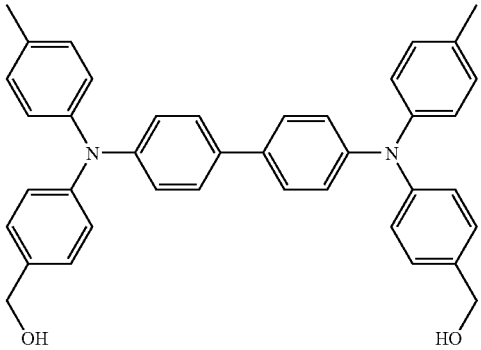
I-14
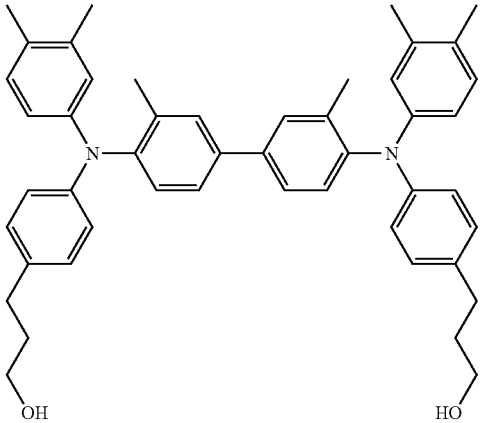
I-15
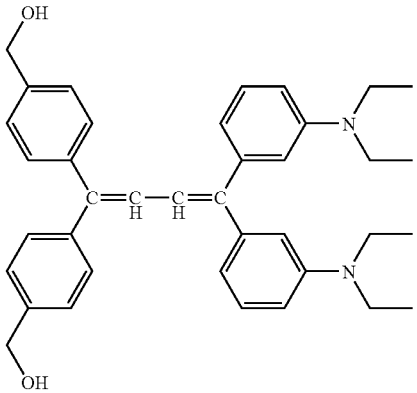

-continued
I-16
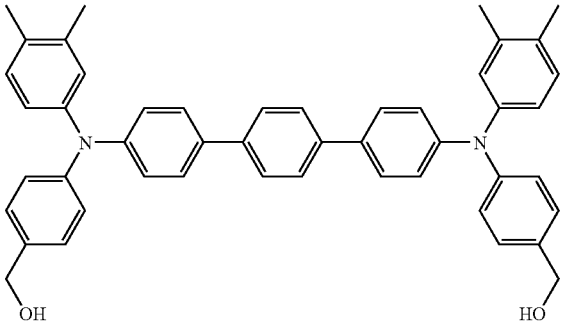
I-17
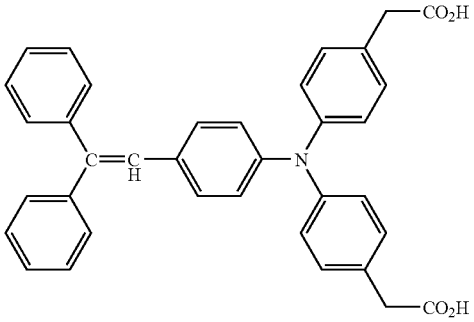
I-18
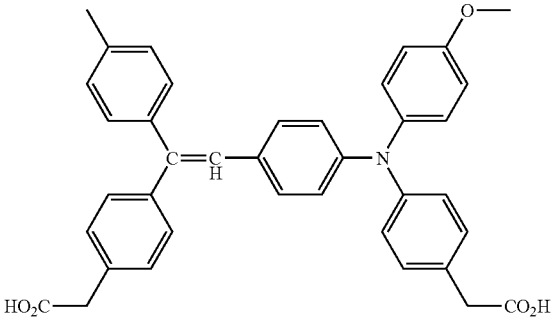
I-19
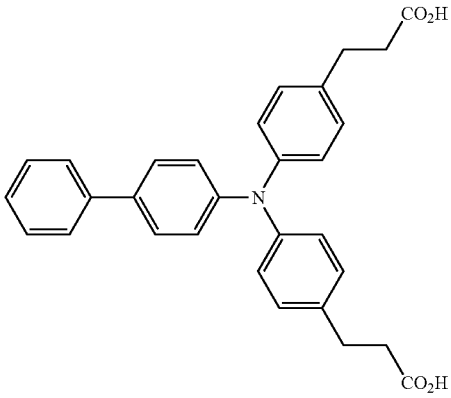
-continued
I-20
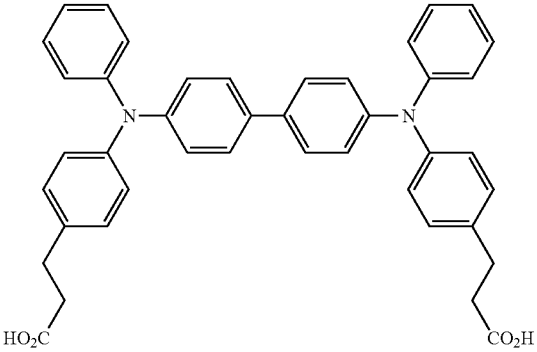
I-21
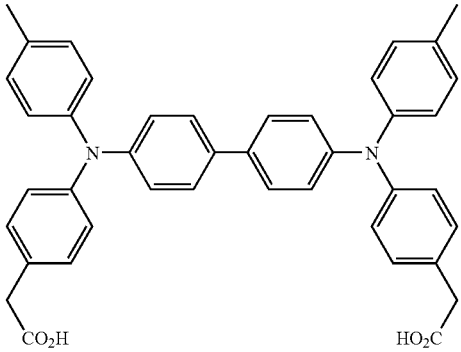
I-22
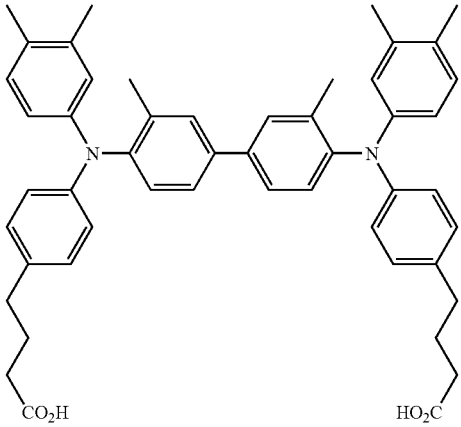
I-23
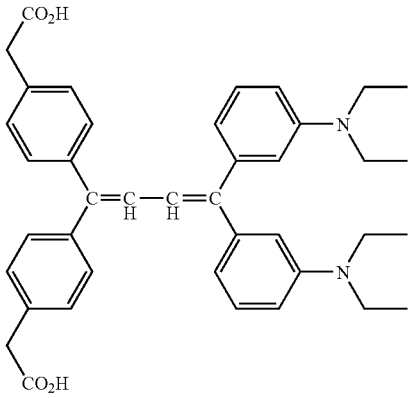

-continued
I-24
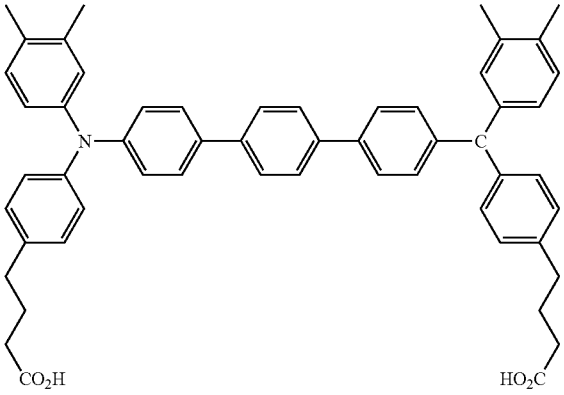
I-25
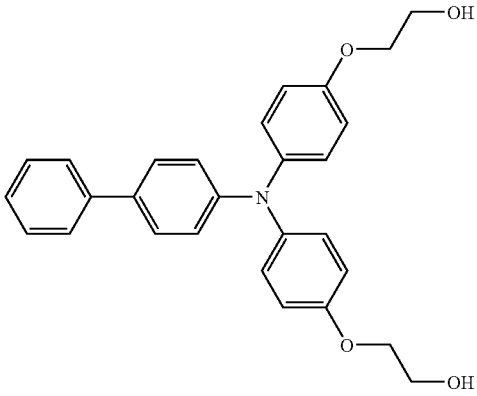
I-26
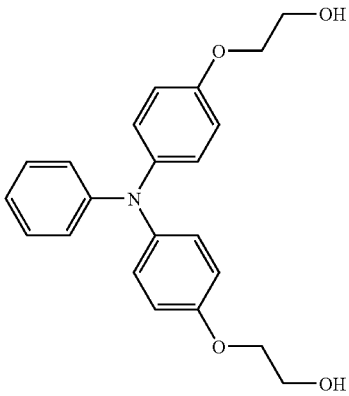
I-27
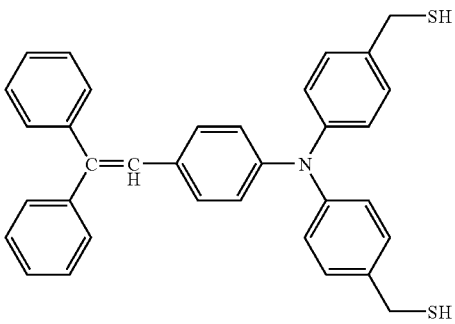
-continued
I-28
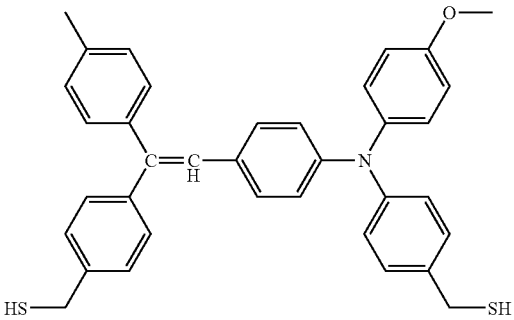
I-29
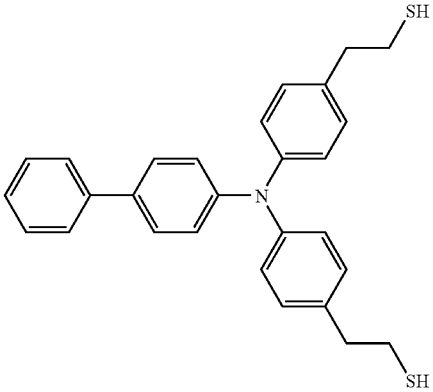
I-30
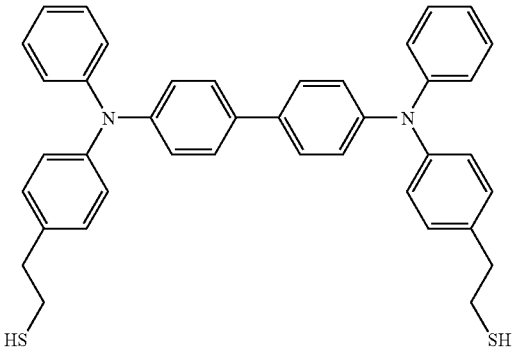
I-31
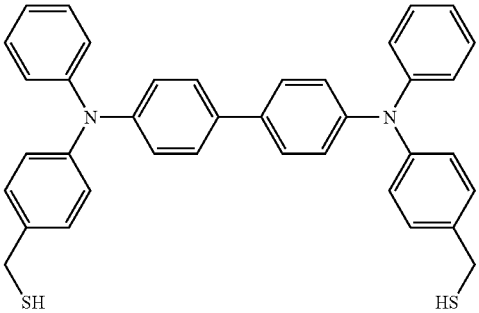

-continued
I-32
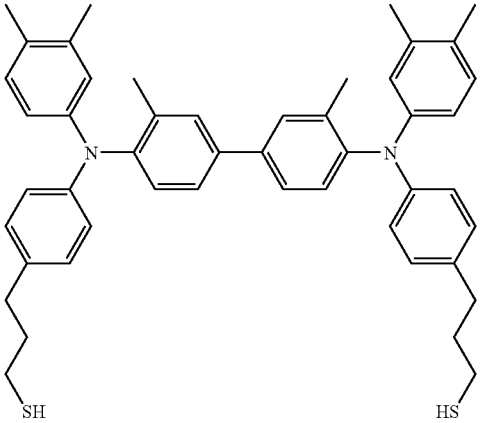
I-33
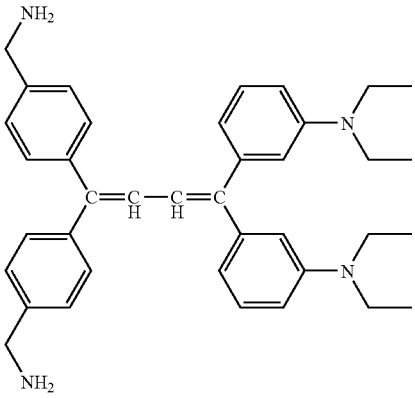
I-34
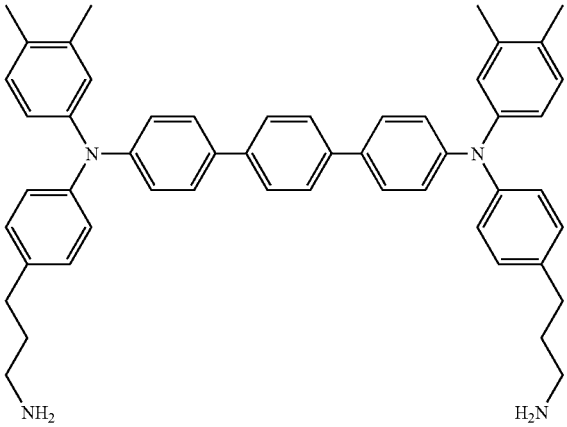
I-35
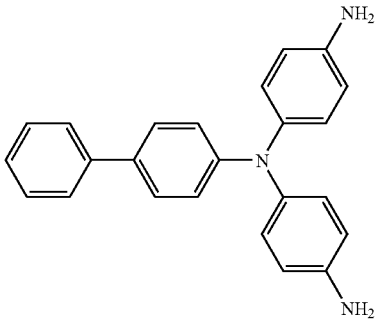
-continued
I-36
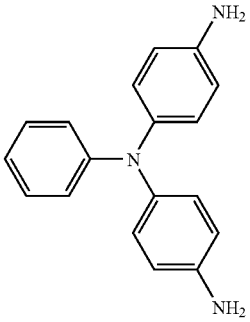
I-37
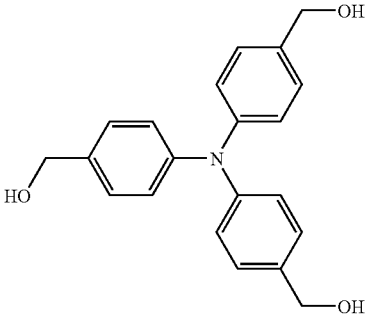
Specific examples of the compound represented by the general formula (II) include the following compounds (II-1) to (II-47). In the following formulae representing the compounds, Me and a chemical bond shown with no substituent each represents a methyl group, and Et represents an ethyl group.
II-1
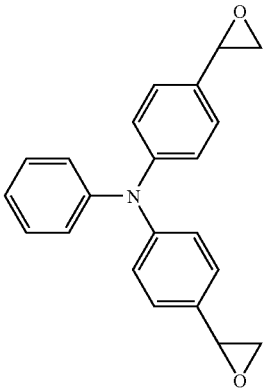

-continued
II-2
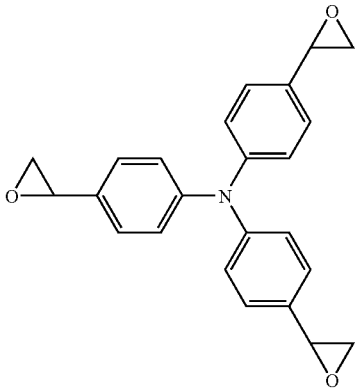
II-3
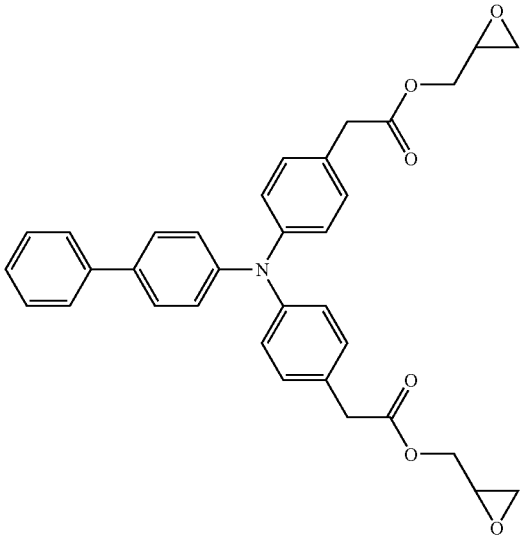
II-4
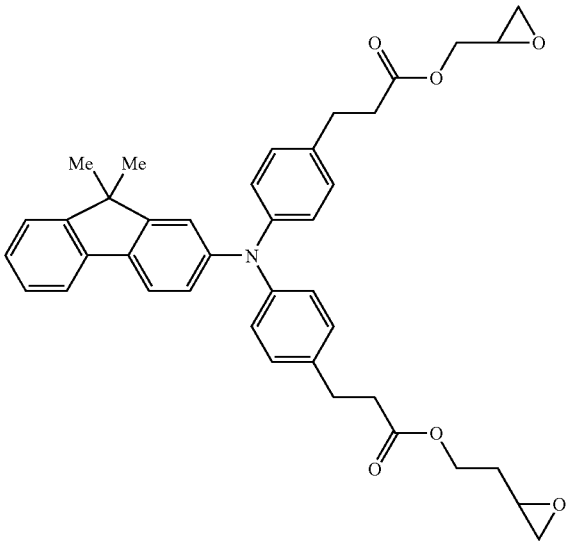
-continued
II-5
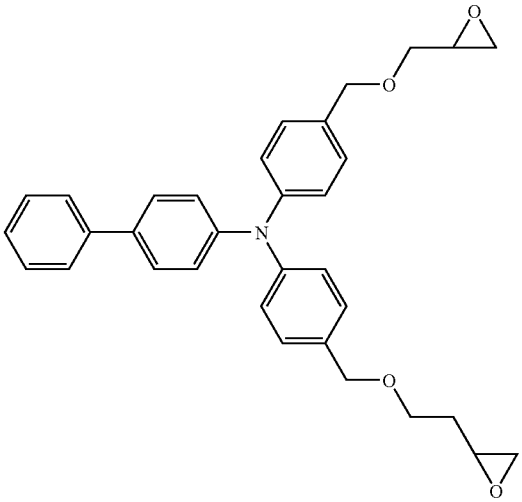
II-6
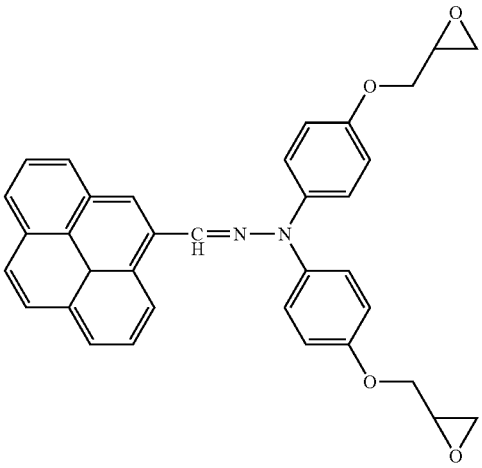
II-7
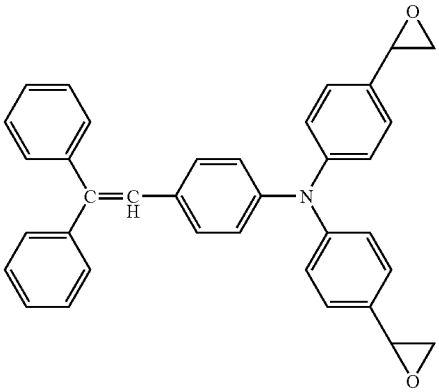

-continued
II-8
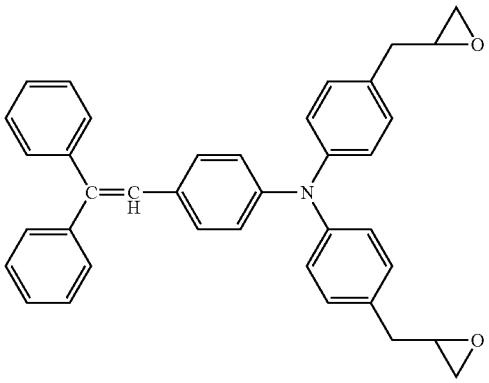
II-9
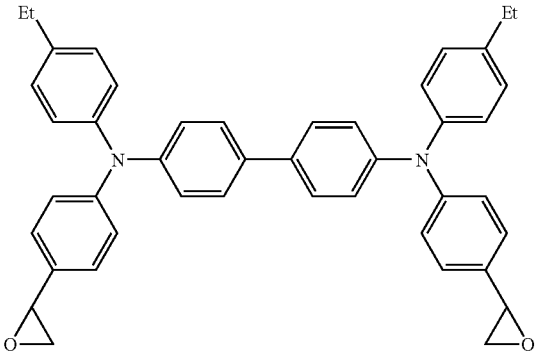
II-10
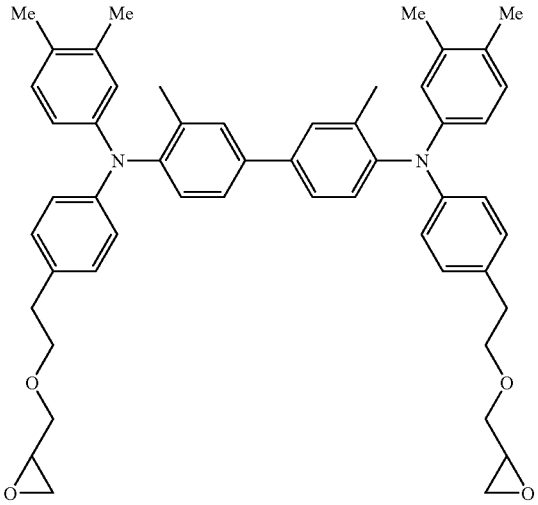
-continued
II-11
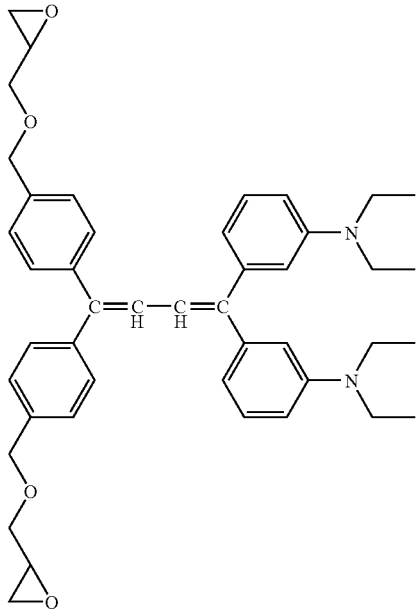
II-12
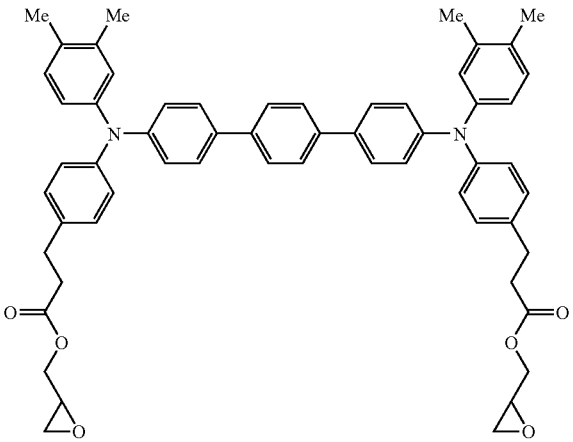
II-13
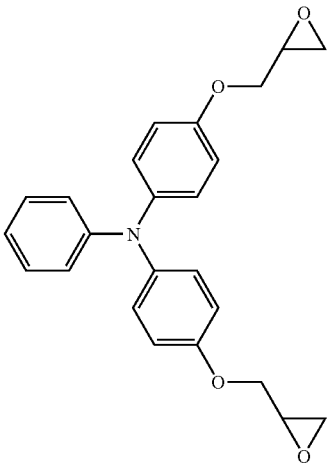

-continued
II-14
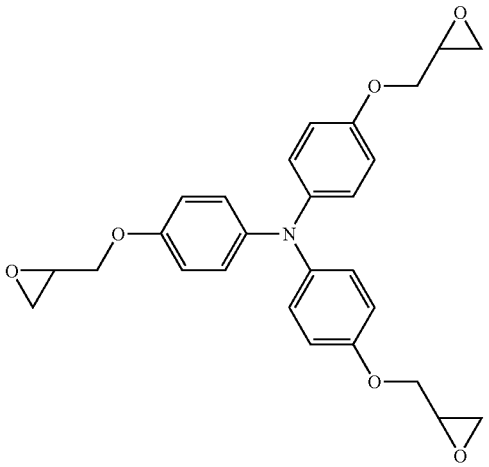
II-15
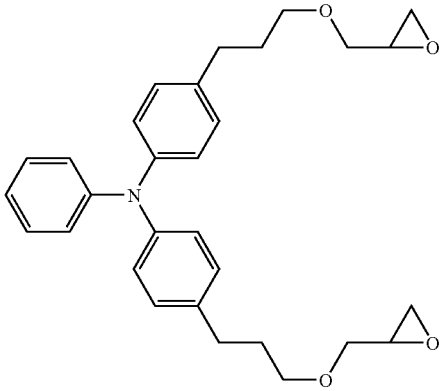
II-16
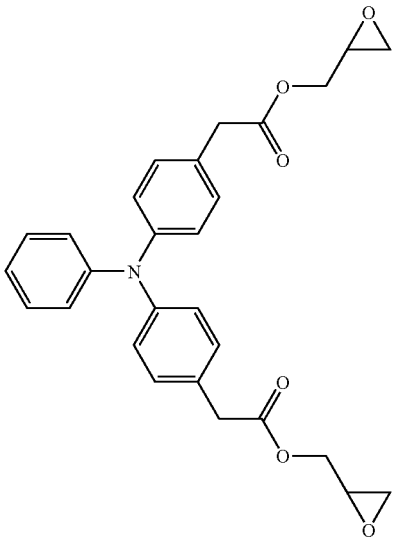
-continued
II-17
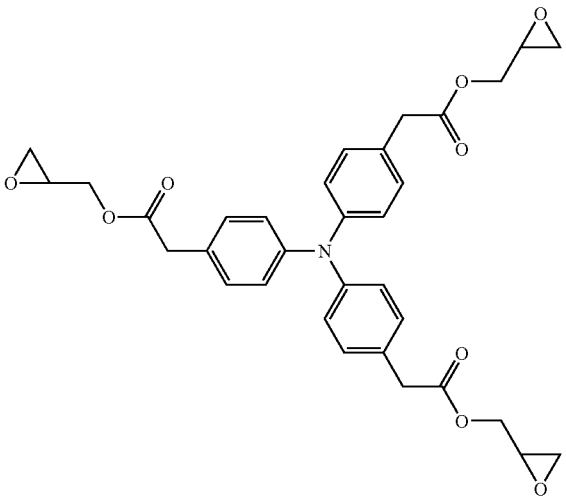
II-18
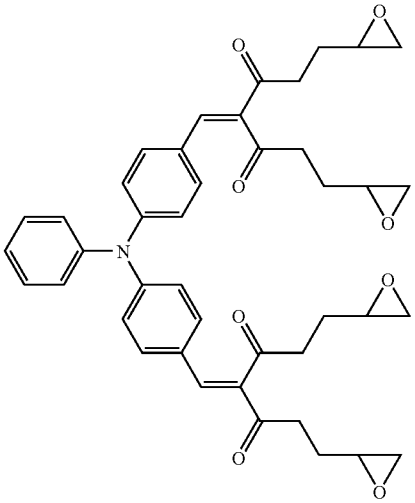
II-19
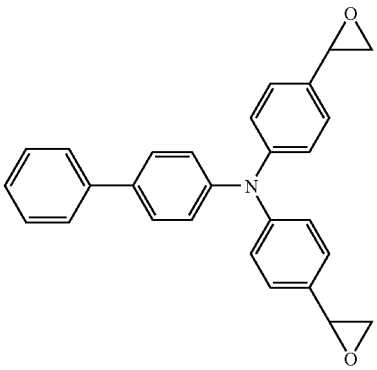

-continued
II-20
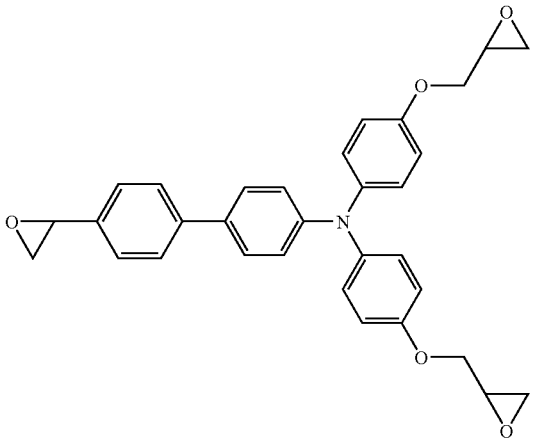
II-21
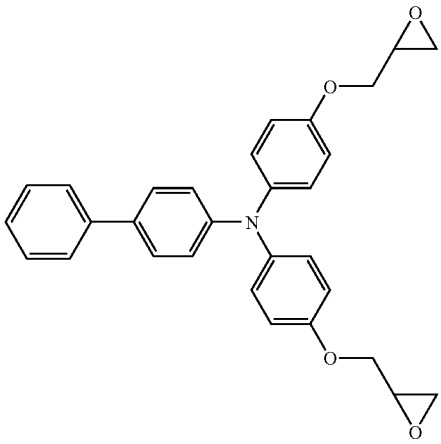
II-22
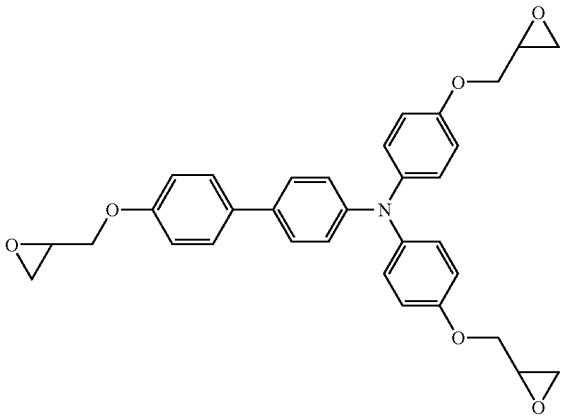
-continued
II-23
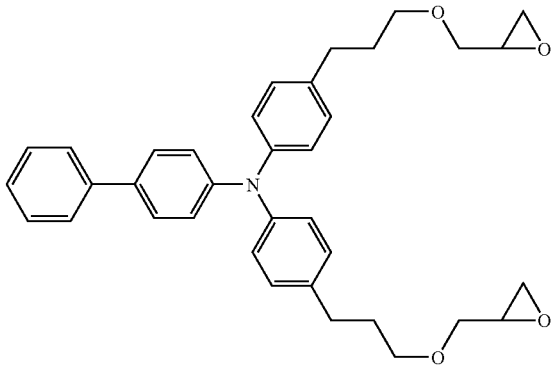
II-24
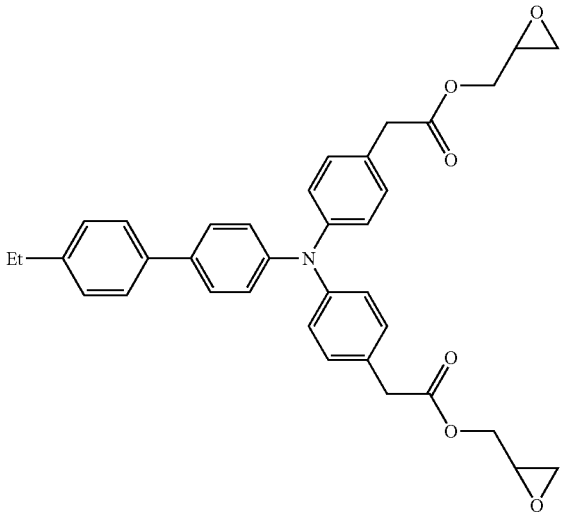
II-25
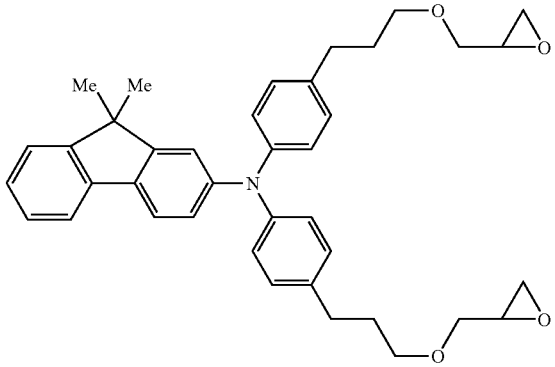

-continued
II-26
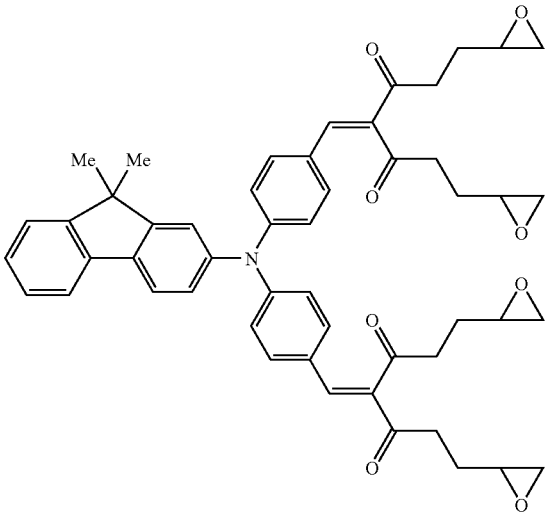
II-27
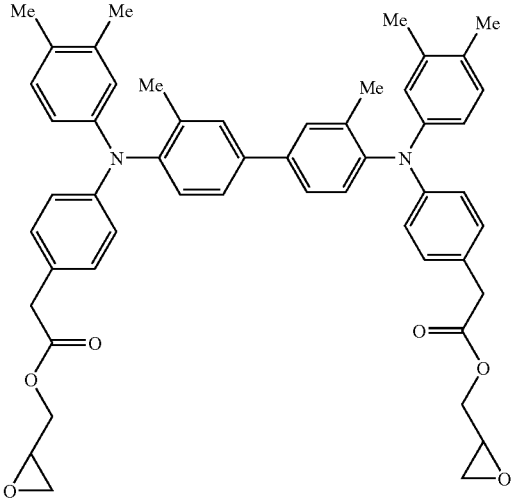
II-28
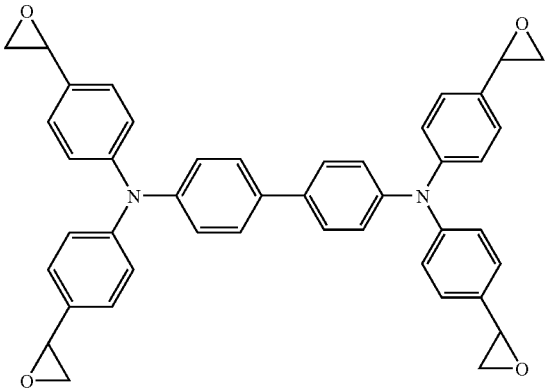
-continued
II-29
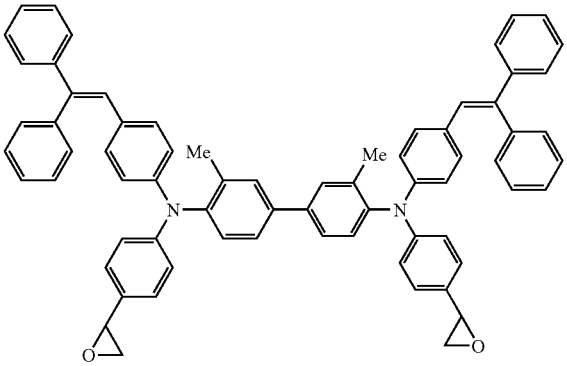
II-30
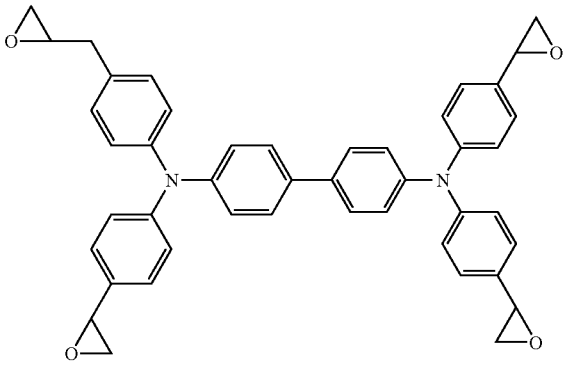
II-31
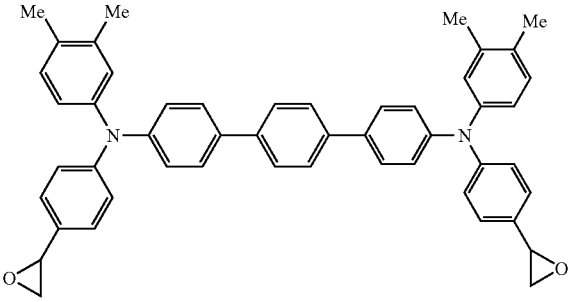
II-32
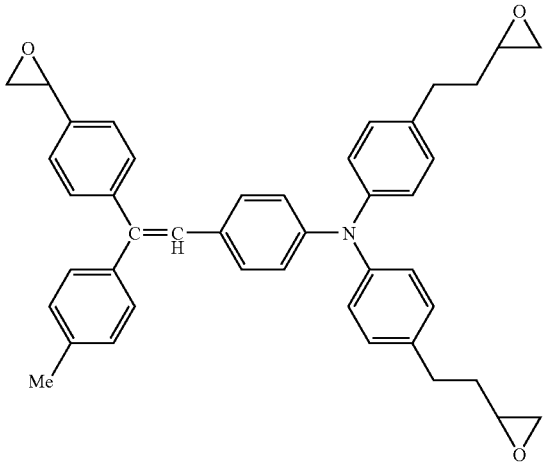

-continued
II-33
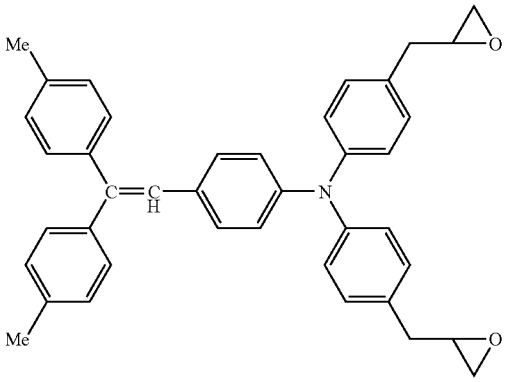
II-34
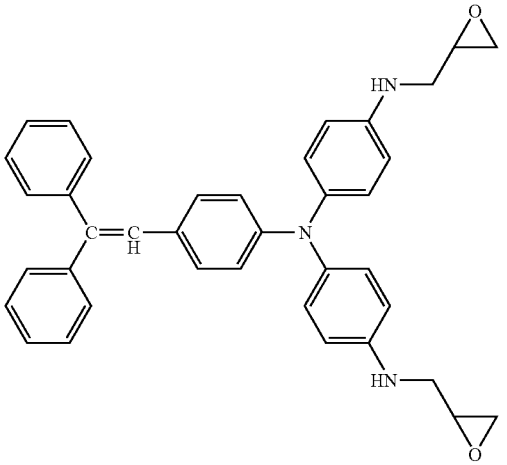
II-35
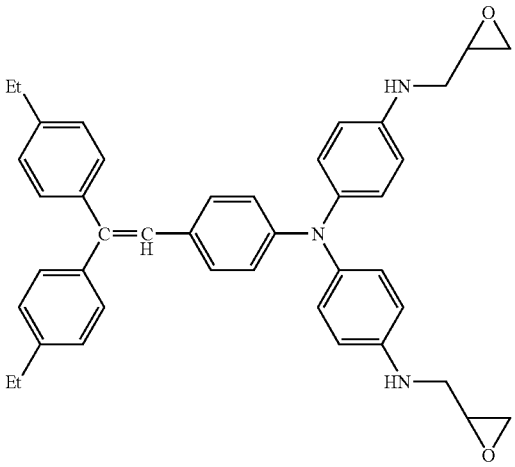
-continued
II-36
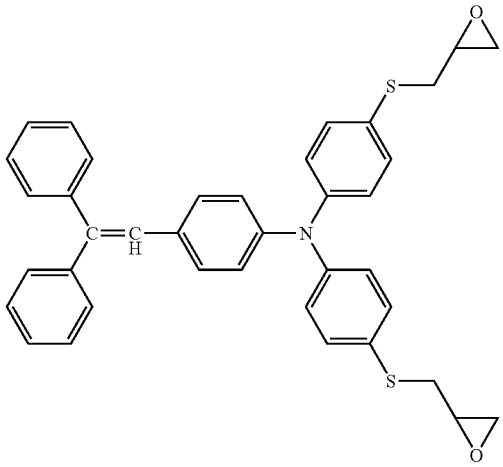
II-37
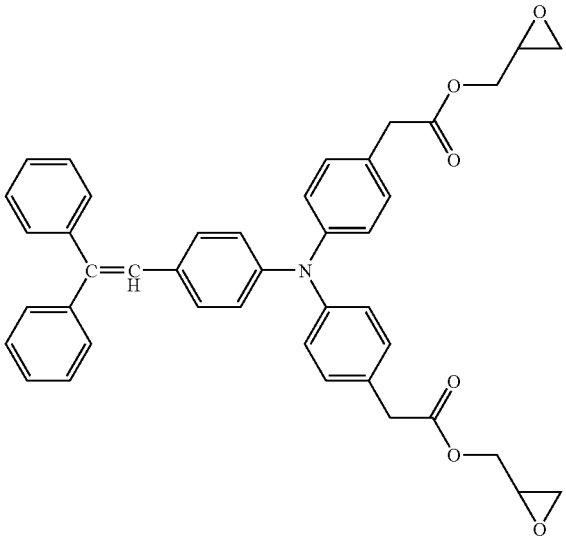
II-38
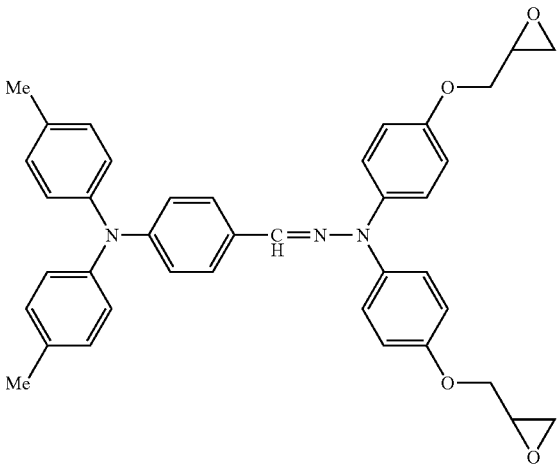

-continued
II-39
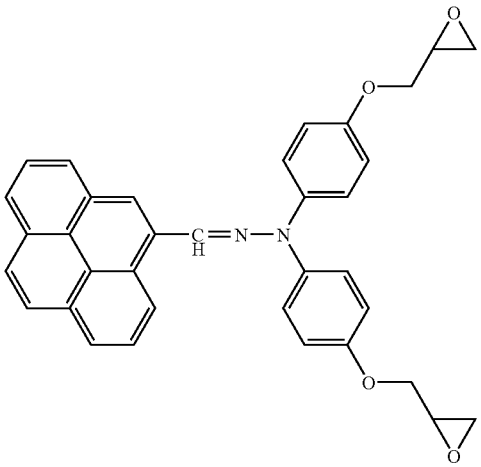
II-40
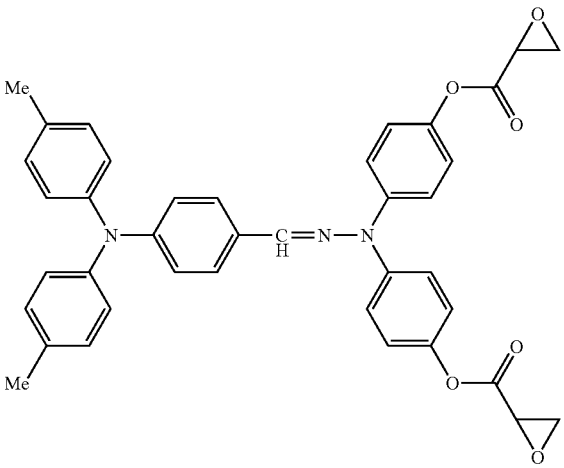
II-41
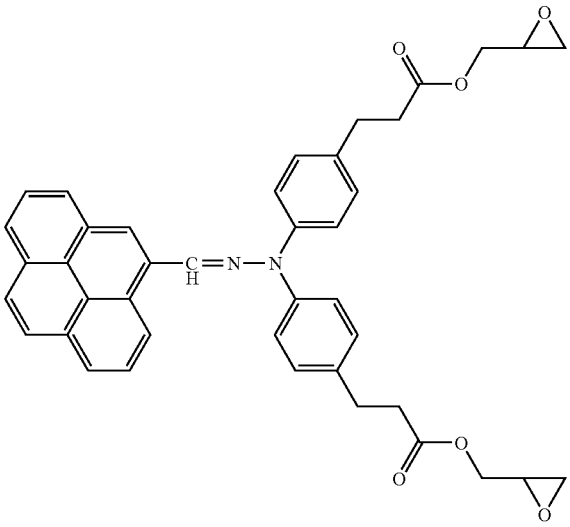
-continued
II-42
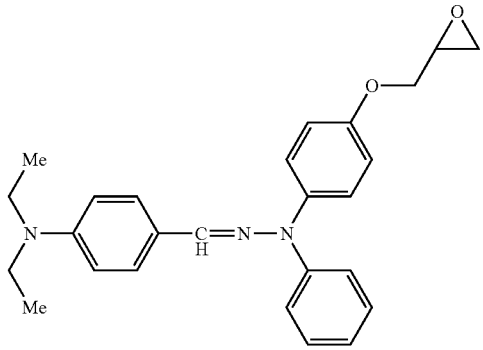
II-43
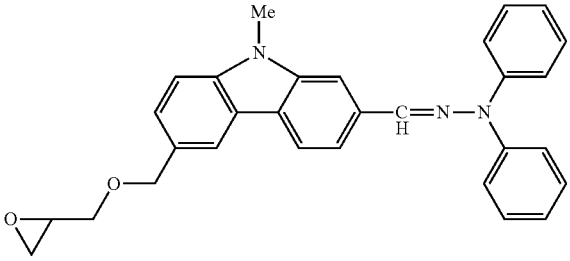
II-44
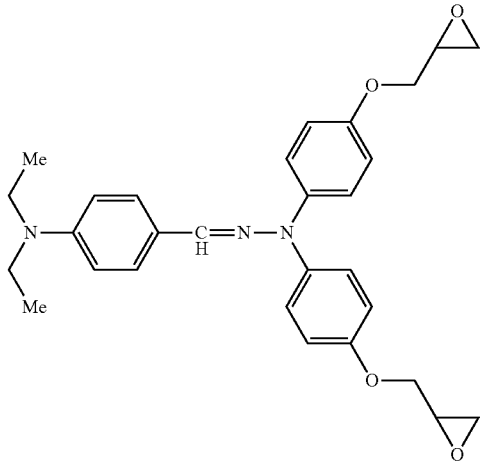

-continued

II-45

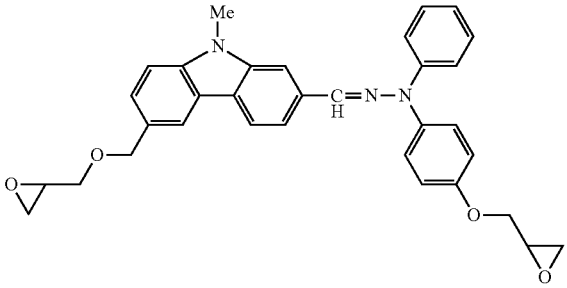

II-46

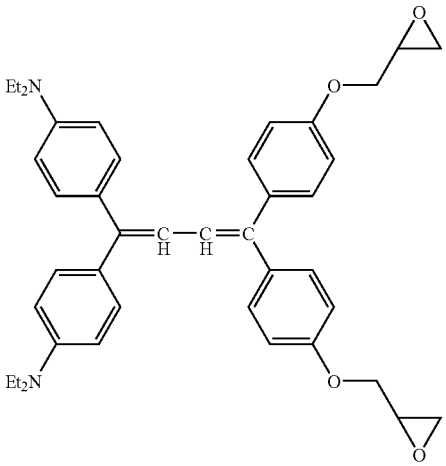

-continued

II-47

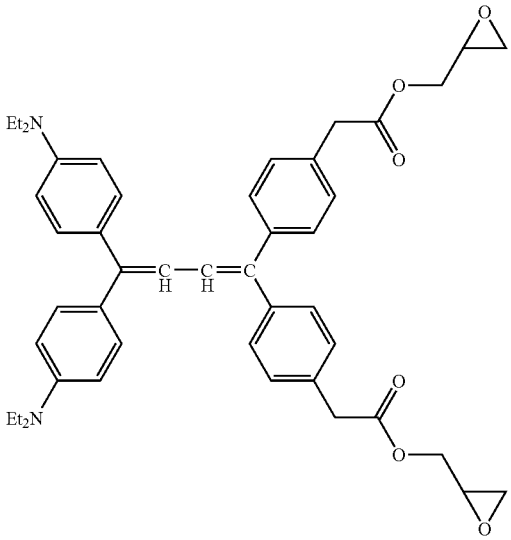

Specific examples of the compound represented by the general formula (III) include the compounds (III-1) to (III-61) shown by the following tables. The following compound (III-1) to (III-61) are such compounds that $Ar^1$ to $Ar^5$ and k in the compound represented by the general formula (VI) are defined as the combinations shown in the table below, and the alkoxysilyl group represented by S is defined as in the table below.

| No. | $Ar^1$ | $Ar^2$ | $Ar^3$ |
|---|---|---|---|
| III-1 | 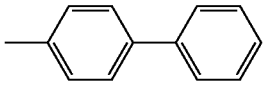 | 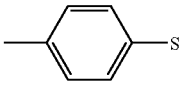 | — |
| III-2 | 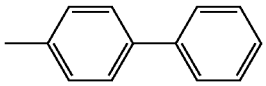 | 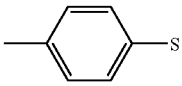 | — |
| III-3 | 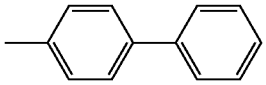 | 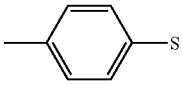 | — |
| III-4 | 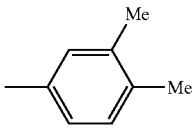 | 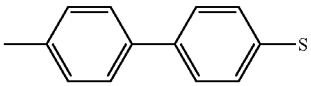 | — |
| III-5 | 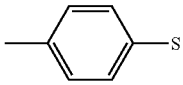 | 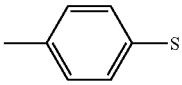 | — |
| III-6 | 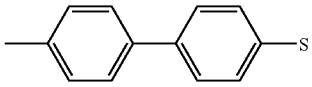 | 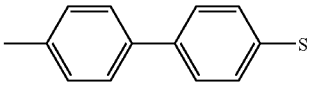 | — |
| III-7 | 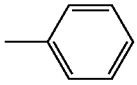 | 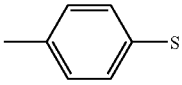 | 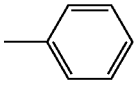 |

-continued
| | | | |
|---|---|---|---|
| III-8 | 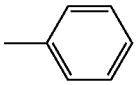 | 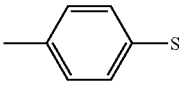 | 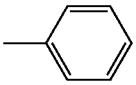 |
| III-9 | 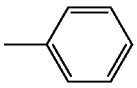 | 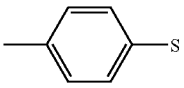 | 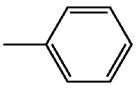 |
| III-10 | 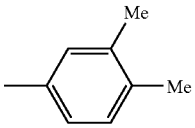 | 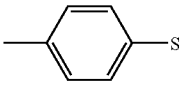 | 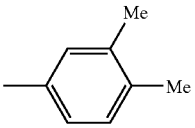 |
| III-11 | 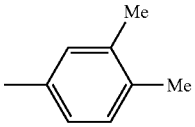 | 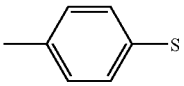 | 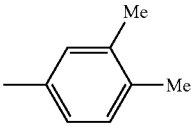 |
| III-12 | 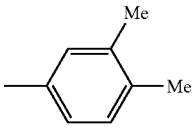 | 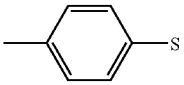 | 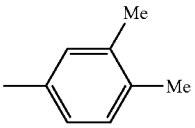 |
| III-13 | 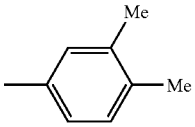 | 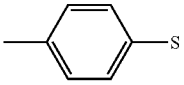 | 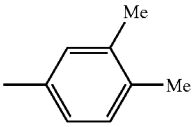 |
| III-14 | 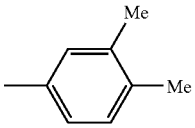 | 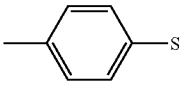 | 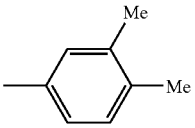 |
| III-15 | 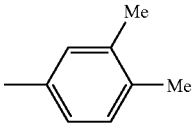 | 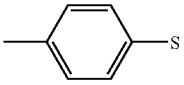 | 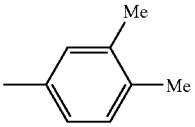 |
| III-16 | 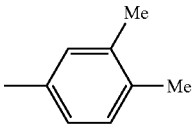 | 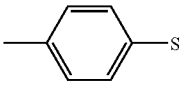 | 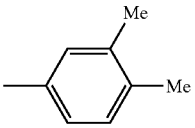 |
| III-17 | 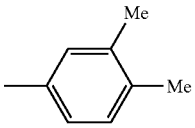 | 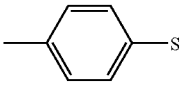 | 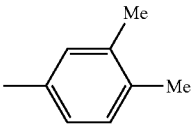 |
| III-18 | 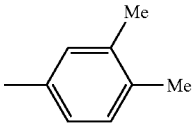 | 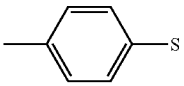 | 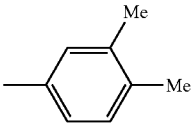 |
| III-19 | 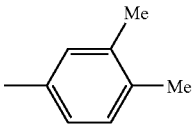 | 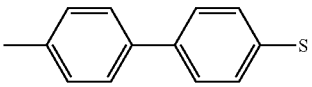 | 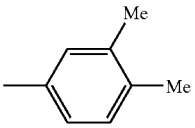 |

-continued
| | | | |
|---|---|---|---|
| III-20 | 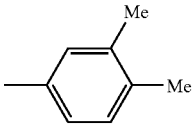 | 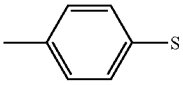 | 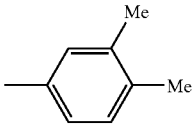 |
| III-21 | 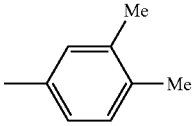 | 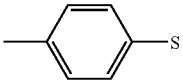 | 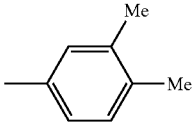 |
| III-22 | 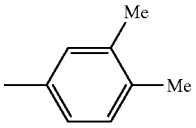 | 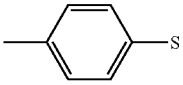 | 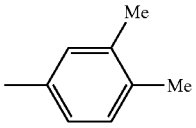 |
| III-23 | 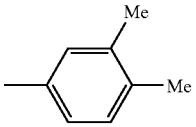 | 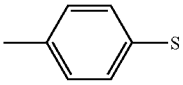 | 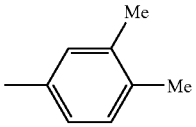 |
| III-24 | 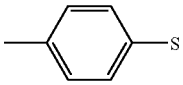 | 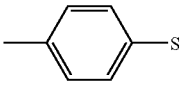 | 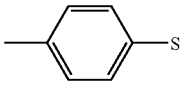 |
| III-25 | 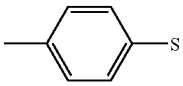 | 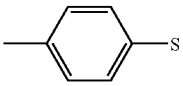 | 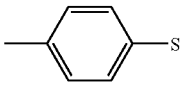 |
| III-26 | 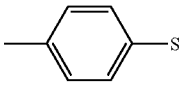 | 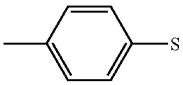 | 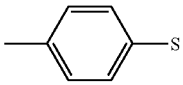 |
| III-27 | 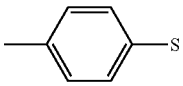 | 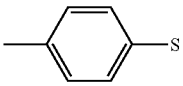 | 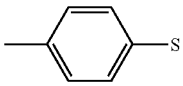 |
| III-28 | 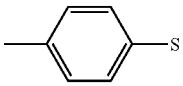 | 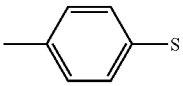 | 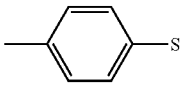 |
| III-29 | 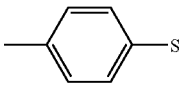 | 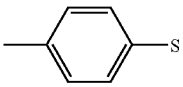 | 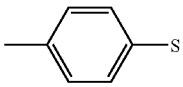 |
| III-30 | 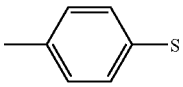 | 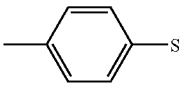 | 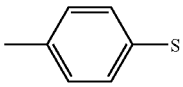 |
| III-31 | 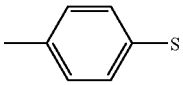 | 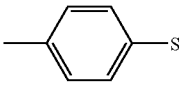 | 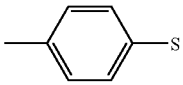 |
| III-32 | 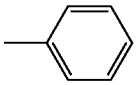 | 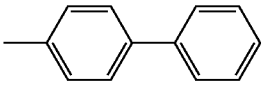 | — |
| III-33 | 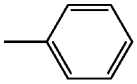 | 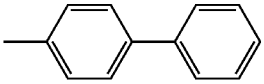 | — |
| III-34 | 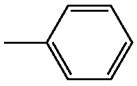 | 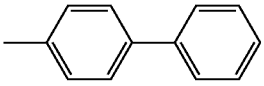 | — |

-continued
| | | | |
|---|---|---|---|
| III-35 | 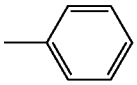 | 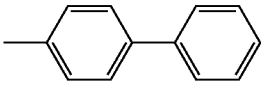 | — |
| III-36 | 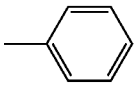 | 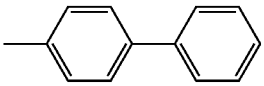 | — |
| III-37 | 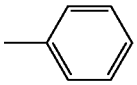 | 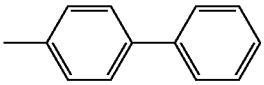 | — |
| III-38 | 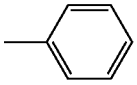 | 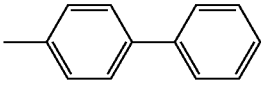 | — |
| III-39 | 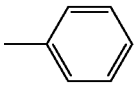 | 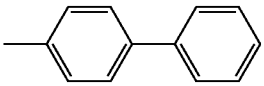 | — |
| III-40 | 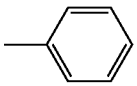 | 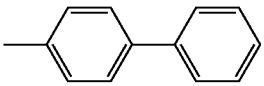 | — |
| III-41 | 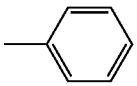 | 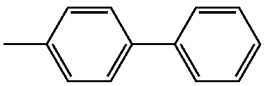 | — |
| III-42 | 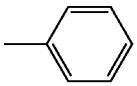 | 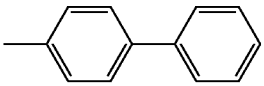 | — |
| III-43 | 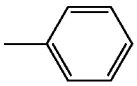 | 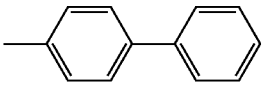 | — |
| III-44 | 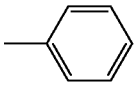 | 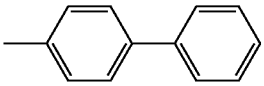 | — |
| III-45 | 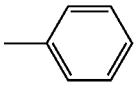 | 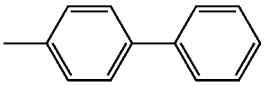 | — |
| III-46 | 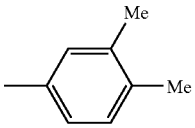 | 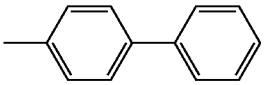 | — |
| III-47 | 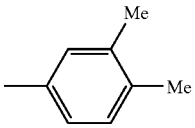 | 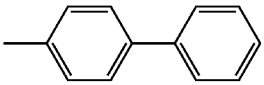 | — |
| III-48 | 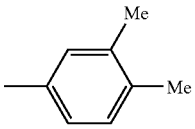 | 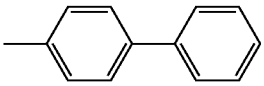 | — |

-continued
| | | | |
|---|---|---|---|
| III-49 | 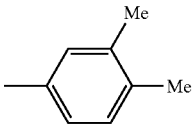 | 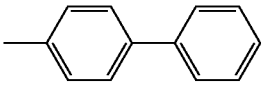 | — |
| III-50 | 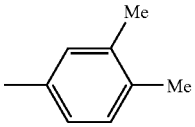 | 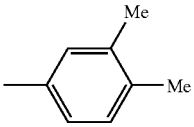 | — |
| III-51 | 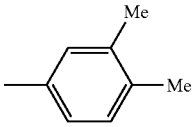 | 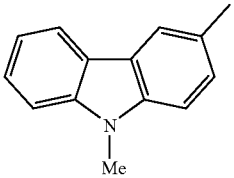 | — |
| III-52 | 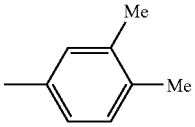 | 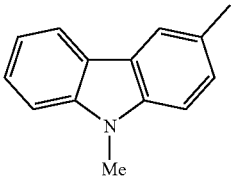 | — |
| III-53 | 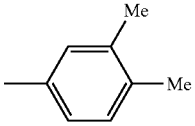 | 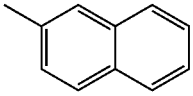 | — |
| III-54 | 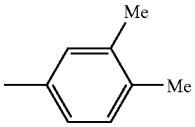 | 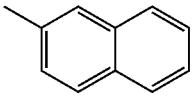 | — |
| III-55 | 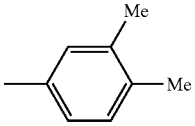 | 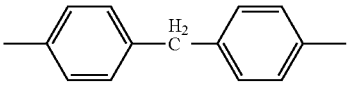 | — |
| III-56 | 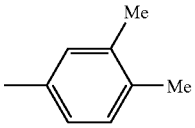 | 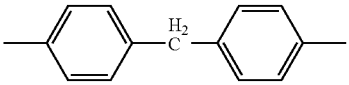 | — |
| III-57 | 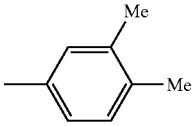 | 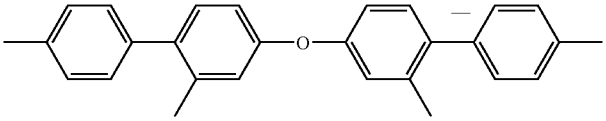 | — |
| III-58 | 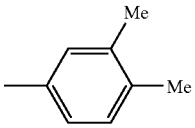 | 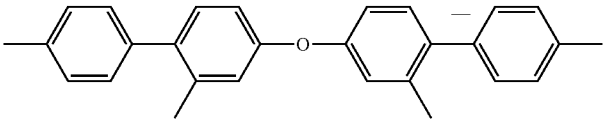 | — |

-continued
| | | | |
|---|---|---|---|
| III-59 | 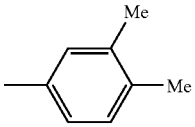 | 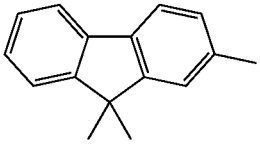 | — |
| III-60 | 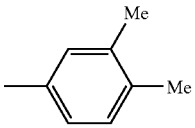 | 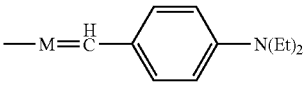 | — |
| III-61 | 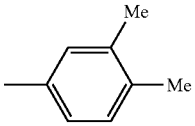 | 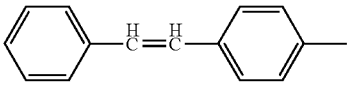 | — |
| No. | $Ar^4$ | $Ar^5$ | k | S |
|---|---|---|---|---|
| III-1 | — | 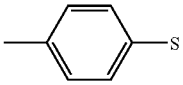 | 0 | —(CH2)2—COO—(CH2)3—Si(OiPr)3 |
| III-2 | — | 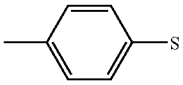 | 0 | —(CH2)2—COO—(CH2)3—Si(OiPr)2Me |
| III-3 | — | 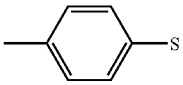 | 0 | —(CH2)2—COO—(CH2)3—Si(OiPr)Me2 |
| III-4 | — | 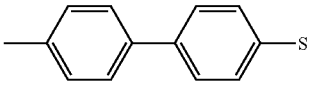 | 0 | —COO—(CH2)3—Si(OiPr)3 |
| III-5 | — | 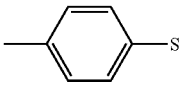 | 0 | —(CH2)2—COO—(CH2)3—Si(OiPr)3 |
| III-6 | — | 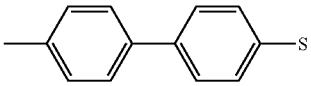 | 0 | —COO—(CH2)3—Si(OiPr)3 |
| III-7 | 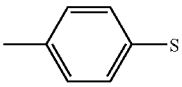 | 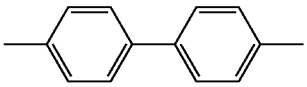 | 1 | —(CH2)4—Si(OEt)3 |
| III-8 | 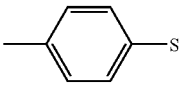 | 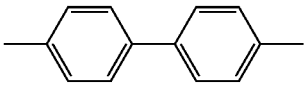 | 1 | —(CH2)4—Si(OiPr)3 |
| III-9 | 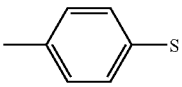 | 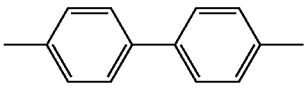 | 1 | —CH═CH—(CH2)2—Si(OiPr)3 |
| III-10 | 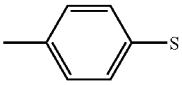 | 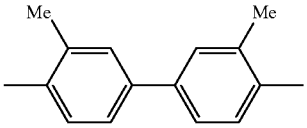 | 1 | —(CH2)4—Si(OMe)3 |
| III-11 | 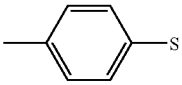 | 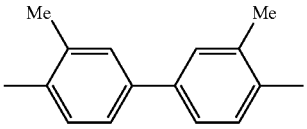 | 1 | —(CH2)4—Si(OiPr)3 |

-continued
| | | | |
|---|---|---|---|
| III-12 | 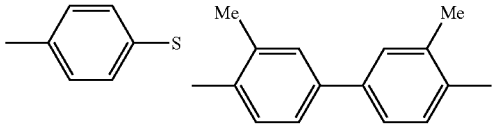 | 1 | —CH═CH—(CH2)2—Si(OiPr)3 |
| III-13 | 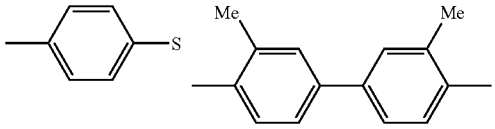 | 1 | —CH═N—(CH2)3—Si(OiPr)3 |
| III-14 | 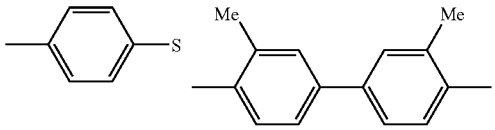 | 1 | —O—(CH2)3—Si(OiPr)3 |
| III-15 | 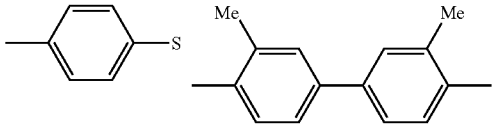 | 1 | —COO—(CH2)3—Si(OiPr)3 |
| III-16 | 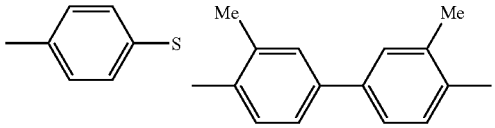 | 1 | —(CH2)2—COO—(CH2)3—Si(OiPr)3 |
| III-17 | 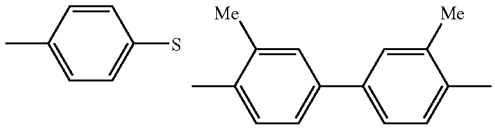 | 1 | —(CH2)2—COO—(CH2)3—Si(OiPr)2Me |
| III-18 | 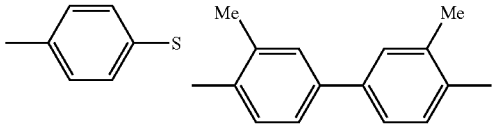 | 1 | —(CH2)2—COO—(CH2)3—Si(OiPr)Me2 |
| III-19 | 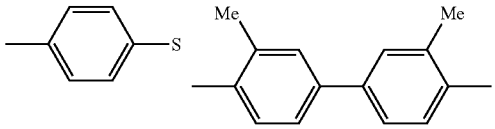 | 1 | —COO—(CH2)3—Si(OiPr)3 |
| III-20 | 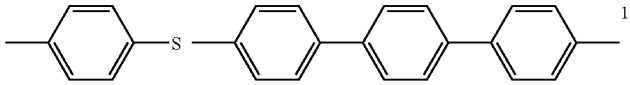 | 1 | —(CH2)4—Si(OiPr)3 |
| III-21 | 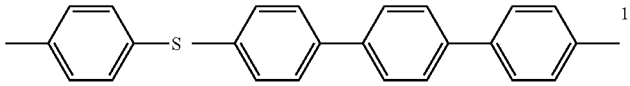 | 1 | —CH═CH—(CH2)2—Si(OiPr)3 |
| III-22 | 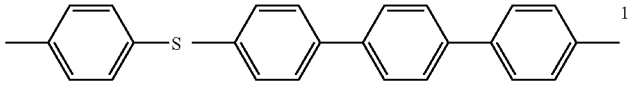 | 1 | —(CH2)2—COO—(CH2)3—Si(OiPr)3 |
| III-23 | 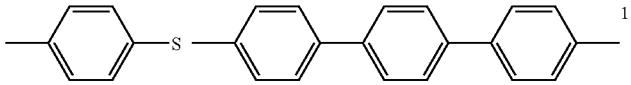 | 1 | —(CH2)2—COO—(CH2)3—Si(OiPr)2Me |
| III-24 | 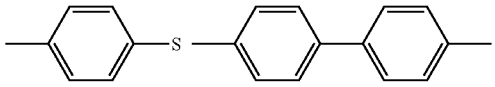 | 1 | —COO—(CH2)3—Si(OiPr)3 |

-continued
| | | | | |
|---|---|---|---|---|
| III-25 | 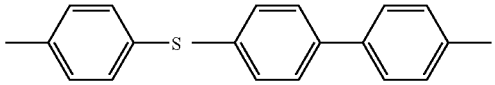 | | 1 | —(CH2)2—COO—(CH2)3—Si(OiPr)3 |
| III-26 | 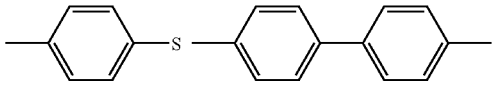 | | 1 | —(CH2)2—COO—(CH2)3—Si(OiPr)2Me |
| III-27 | 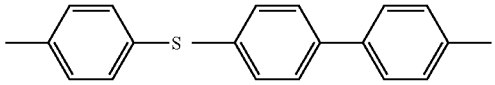 | | 1 | —(CH2)2—COO—(CH2)3—So(OiPr)Me2 |
| III-28 | 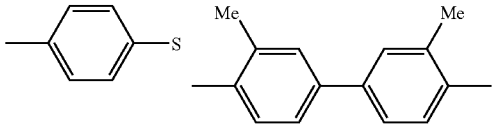 | | 1 | —COO—(CH2)3—Si(OiPr)3 |
| III-29 | 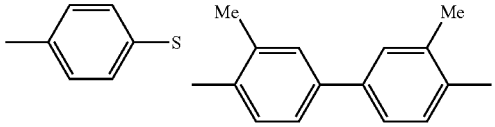 | | 1 | —(CH2)2—COO—(CH2)3—Si(OiPr)3 |
| III-30 | 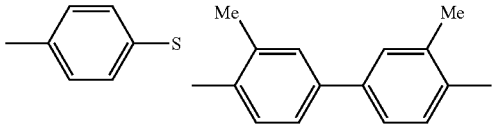 | | 1 | —(CH2)2—COO—(CH2)3—Si(OiPr)2Me |
| III-31 | 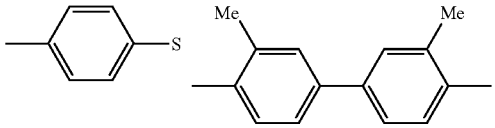 | | 1 | —(CH2)2—COO—(CH2)3—Si(OiPr)Me2 |
| III-32 | — | 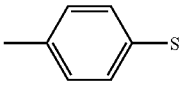 | 0 | —(CH2)4—Si(OiPr)3 |
| III-33 | — | 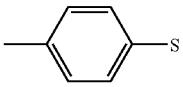 | 0 | —(CH2)4—Si(Oet)3 |
| III-34 | — | 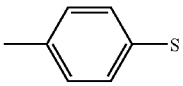 | 0 | —(CH2)4—Si(OMe)3 |
| III-35 | — | 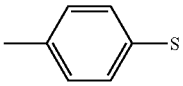 | 0 | —(CH2)4—SiMe(OMe)$_2$ |
| III-36 | — | 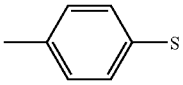 | 0 | —(CH2)4—SiMe(OiPr)2 |
| III-37 | — | 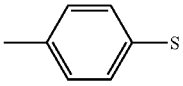 | 0 | —CH═CH—(CH2)2—Si(OiPr)3 |
| III-38 | — | 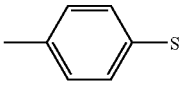 | 0 | —CH═CH—(CH2)2—Si(OMe)3 |

-continued
| | | | | |
|---|---|---|---|---|
| III-39 | — | 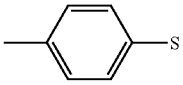 | 0 | —CH═N—(CH2)3—Si(OiMe)3 |
| III-40 | — | 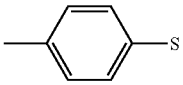 | 0 | —CH═N—(CH2)3—Si(OiPr)3 |
| III-41 | — | 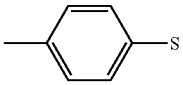 | 0 | —O—(CH2)3—Si(OiPr)3 |
| III-42 | — | 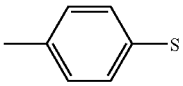 | 0 | —COO—(CH2)3—Si(OiPr)3 |
| III-43 | — | 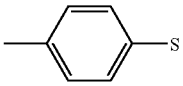 | 0 | —(CH2)2—COO—(CH2)3—Si(OiPr)3 |
| III-44 | — | 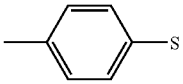 | 0 | —(CH2)2—COO—(CH2)3—Si(OiPr)2Me |
| III-45 | — | 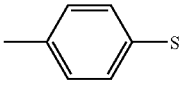 | 0 | —(CH2)2—COO—(CH2)3—Si(OiPr)Me2 |
| III-46 | — | 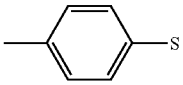 | 0 | —(CH2)4—Si(OMe)3 |
| III-47 | — | 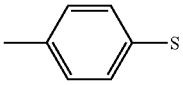 | 0 | —(CH2)2—COO—(CH2)3—Si(OiPr)3 |
| III-48 | — | 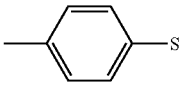 | 0 | —(CH2)2—COO—(CH2)3—SiMe(OiPr)2 |
| III-49 | — | 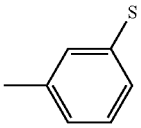 | 0 | —O—(CH2)3—Si(OiPr)3 |
| III-50 | — | 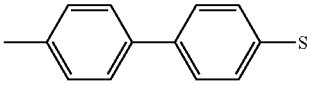 | 0 | —COO—(CH2)3—Si(OiPr)3 |
| III-51 | — | 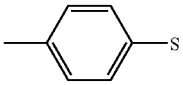 | 0 | —(CH2)4—Si(OiPr)3 |
| III-52 | — | 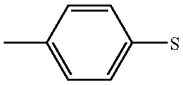 | 0 | —(CH2)2—COO—(CH2)3—Si(OiPr)3 |
| III-53 | — | 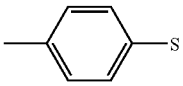 | 0 | —(CH2)4—Si(OiPr)3 |
| III-54 | — | 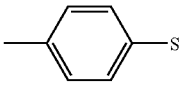 | 0 | —(CH2)2—COO—(CH2)3—Si(OiPr)3 |

-continued

| | | | | |
|---|---|---|---|---|
| III-55 | — | 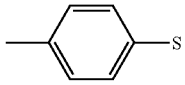 | 0 | —(CH2)4—Si(OiPr)3 |
| III-56 | — | 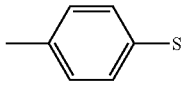 | 0 | —(CH2)2—COO—(CH2)3—Si(OiPr)3 |
| III-57 | — | 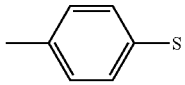 | 0 | —(CH2)4—Si(OiPr)3 |
| III-58 | — | 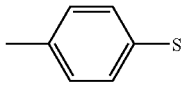 | 0 | —(CH2)2—COO—(CH2)3—Si(OiPr)3 |
| III-59 | — | 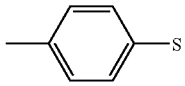 | 0 | —(CH2)2—COO—(CH2)3—Si(OiPr)3 |
| III-60 | — | 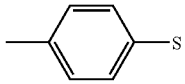 | 0 | —(CH2)2—COO—(CH2)3—Si(OiPr)3 |
| III-61 | — | 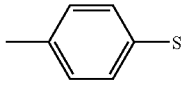 | 0 | —(CH2)2—COO—(CH2)3—Si(OiPr)3 |

Specific examples of the compound represented by the general formula (IV) include the following compounds (IV-1) to (IV-40). In the following formulae representing compounds, Me and a chemical bond shown with no substituent each represents a methyl group, and Et represents an ethyl group.

IV-1

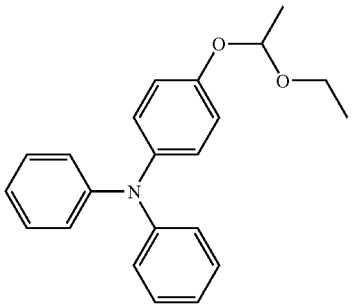

IV-2

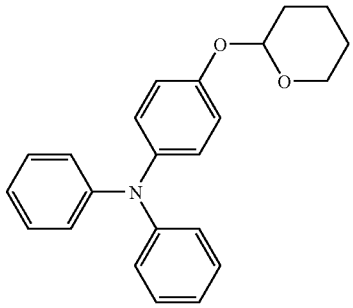

IV-3

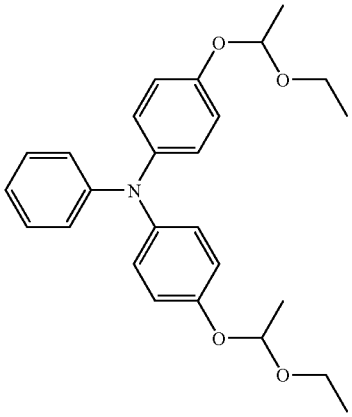

IV-4

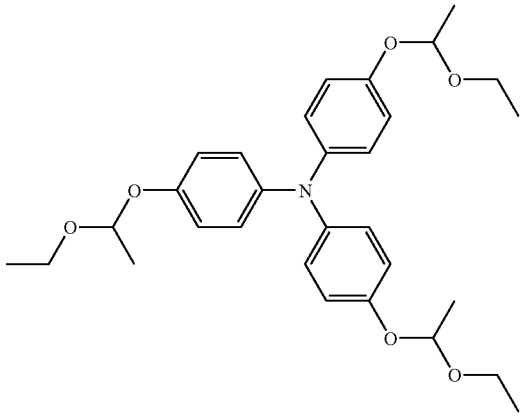

-continued
IV-5
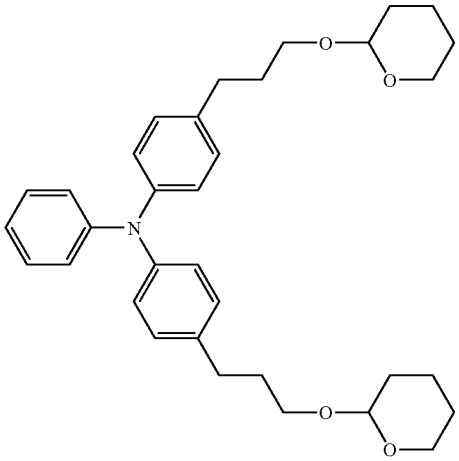
IV-6
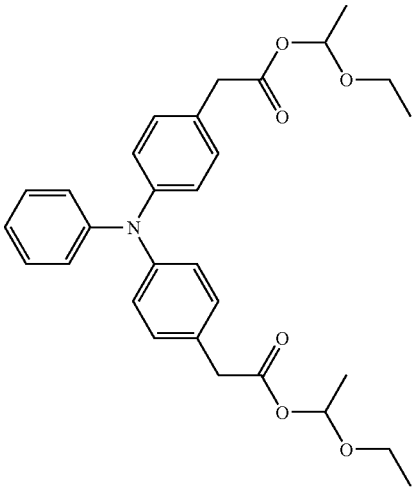
IV-7
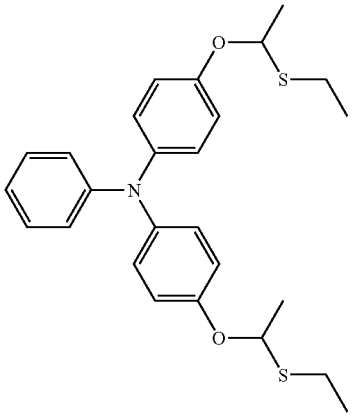
IV-8
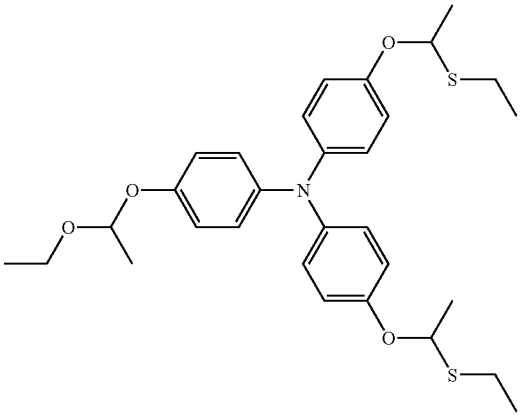
IV-9
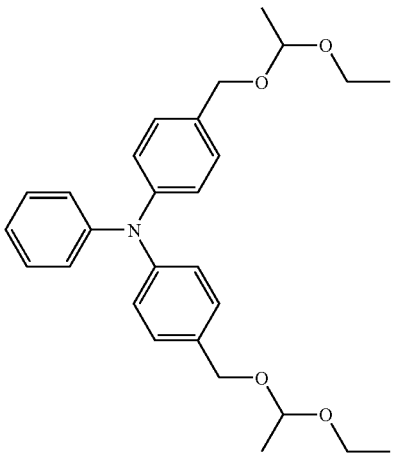
IV-10
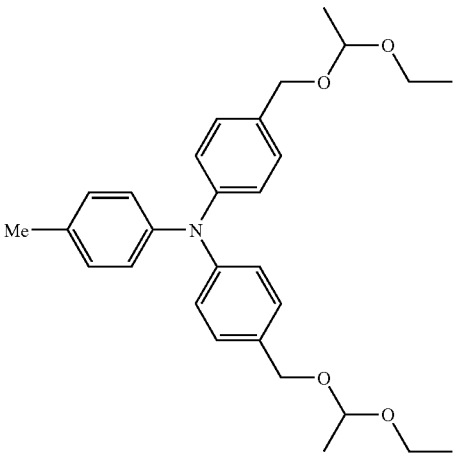

-continued
IV-11
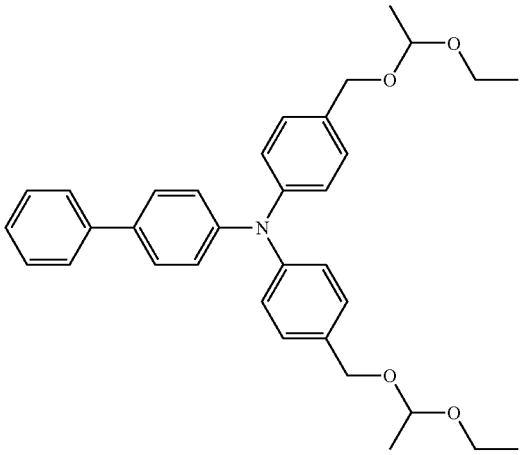
IV-12
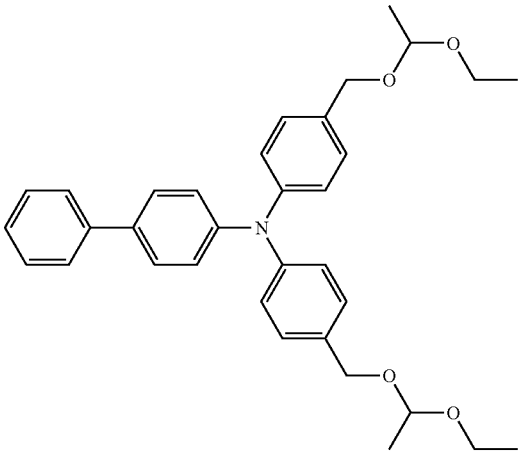
IV-13
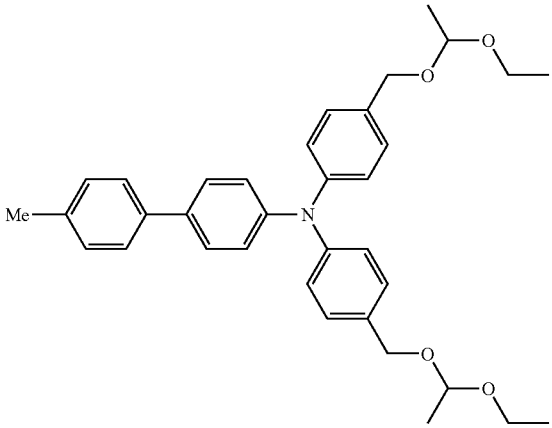
IV-14
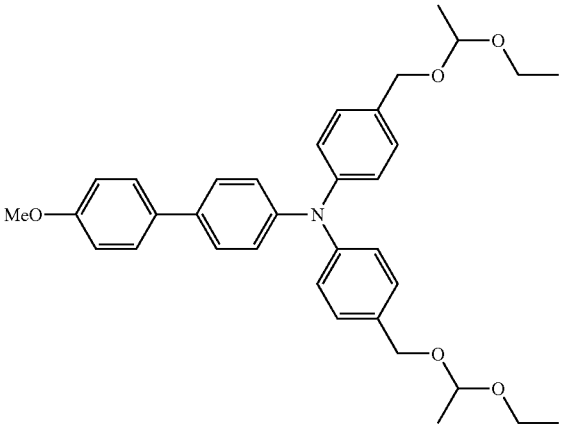
IV-15
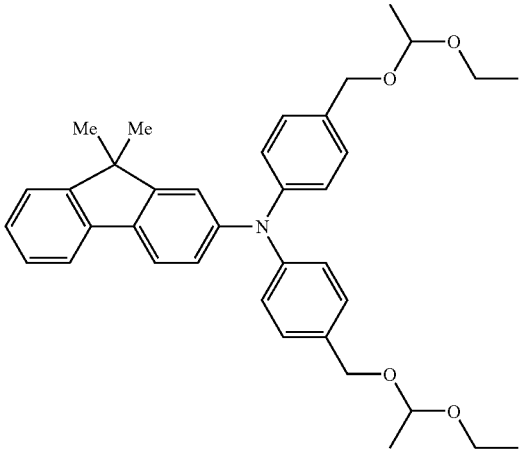

-continued
IV-16
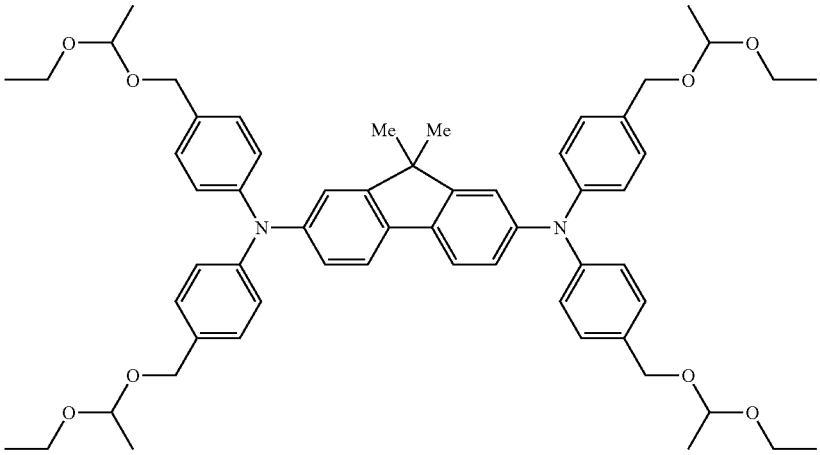
IV-17
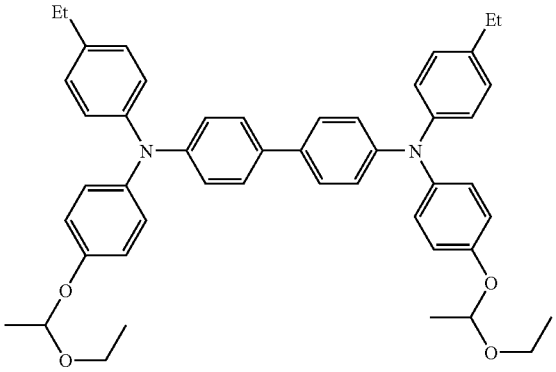
IV-18
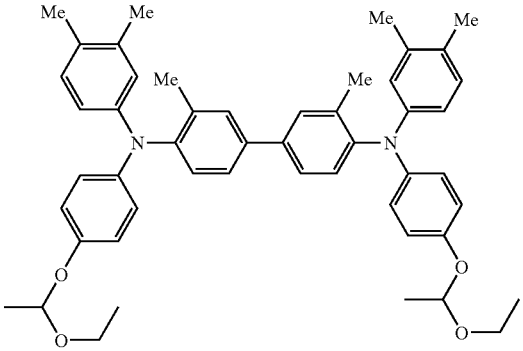
IV-19
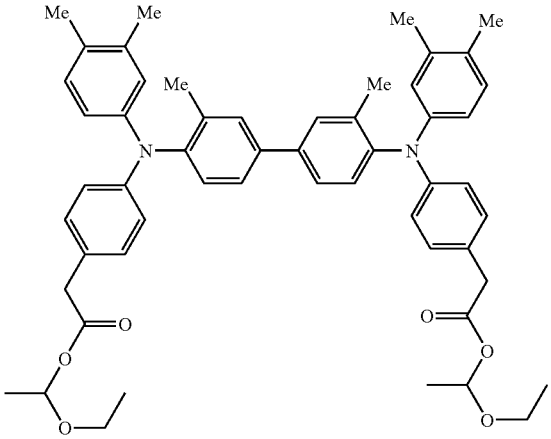
IV-20
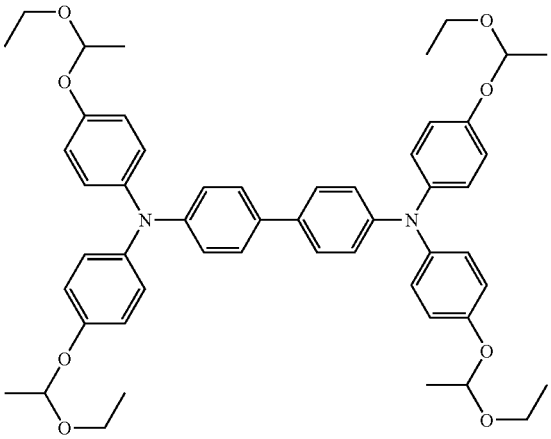

-continued
IV-21
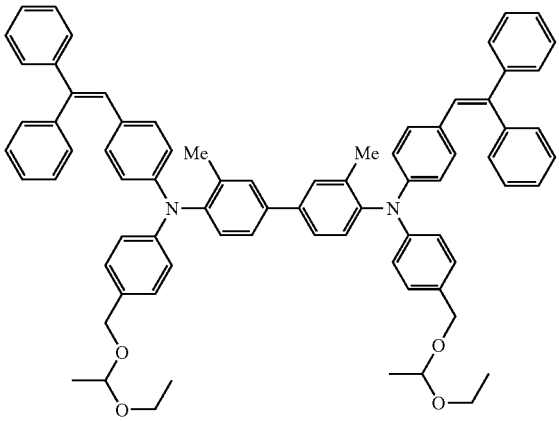
IV-22
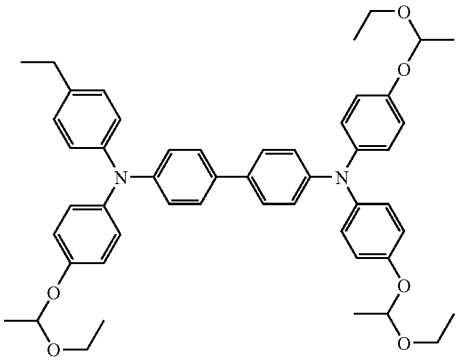
IV-23
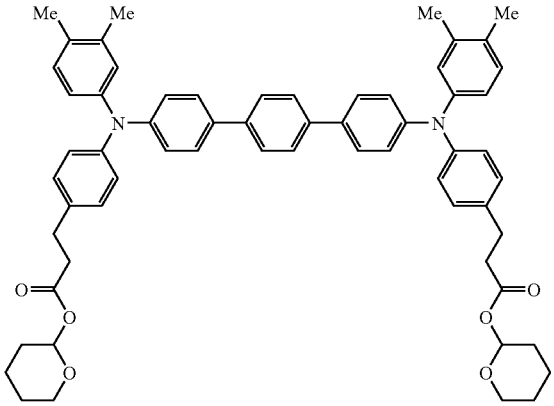
IV-24
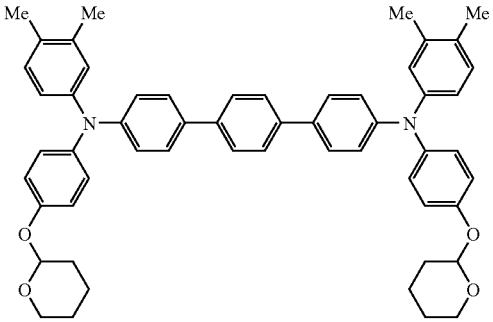
IV-25
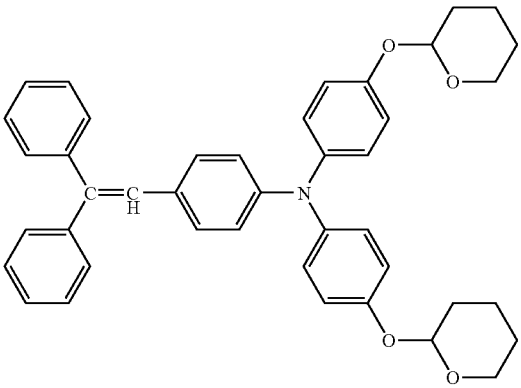
IV-26
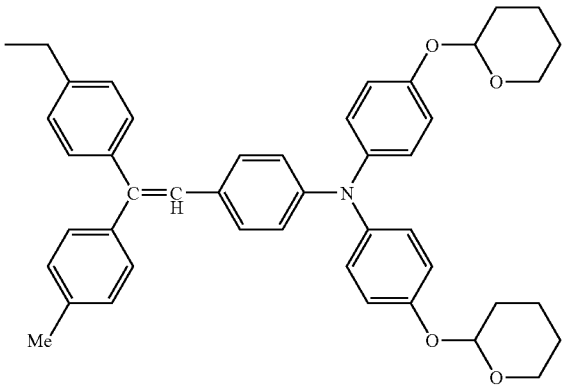
IV-27
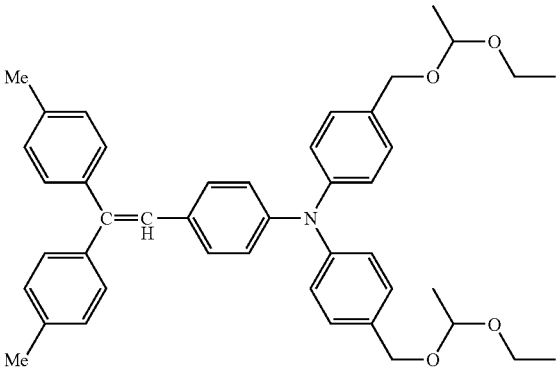
IV-28
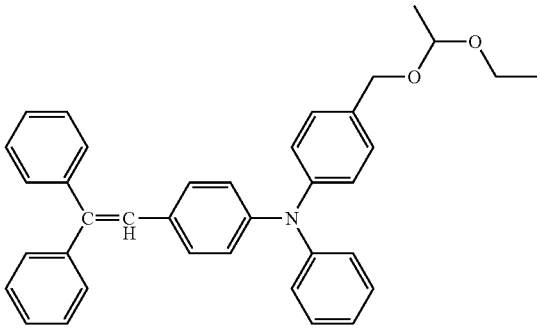

-continued
IV-29
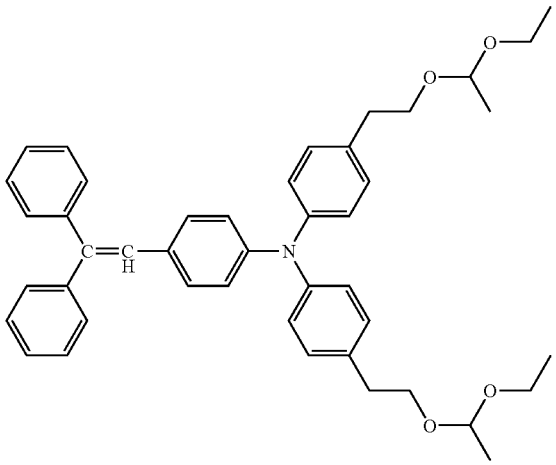
IV-30
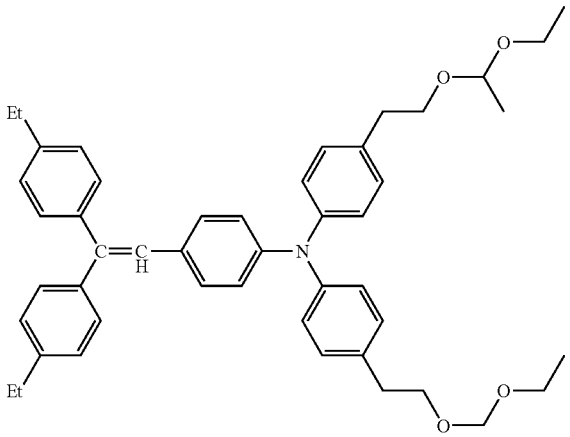
IV-31
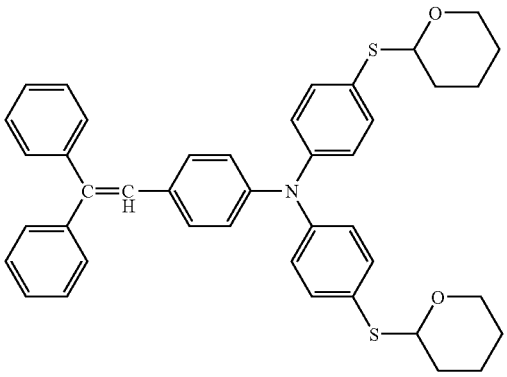
IV-32
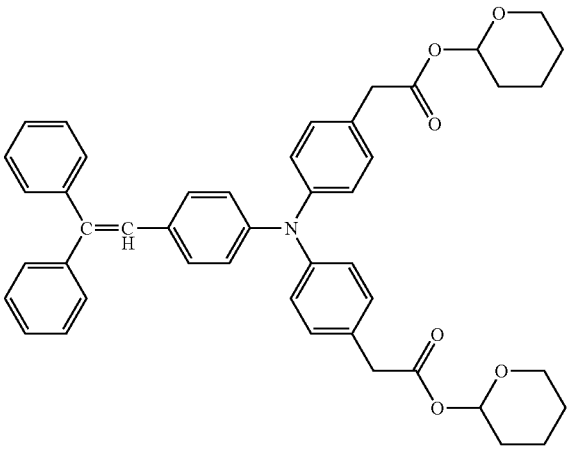
IV-33
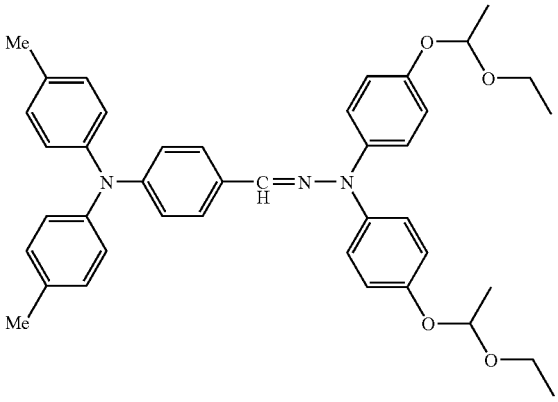
IV-34
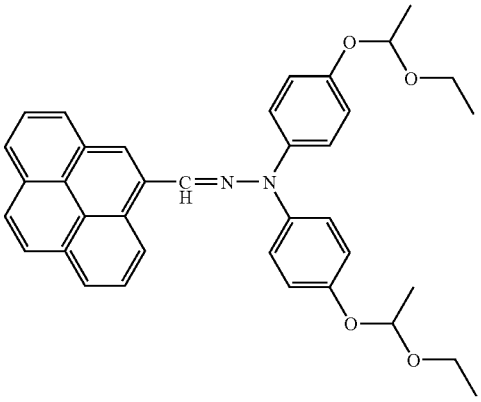

-continued
IV-35
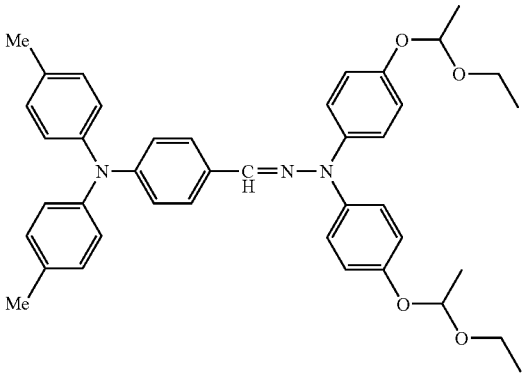
IV-36
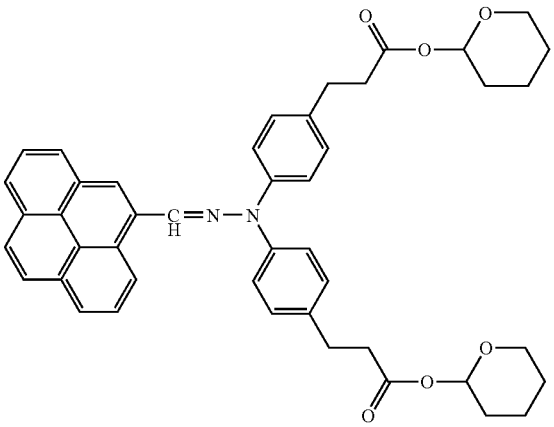
IV-37
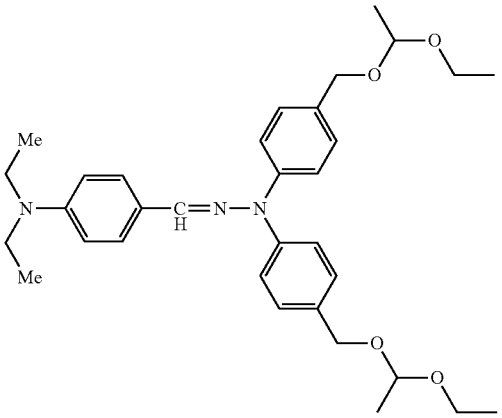
IV-38
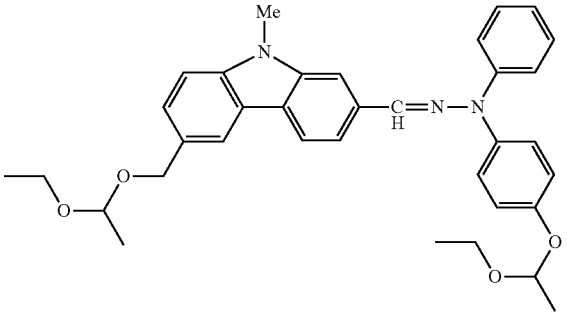
IV-39
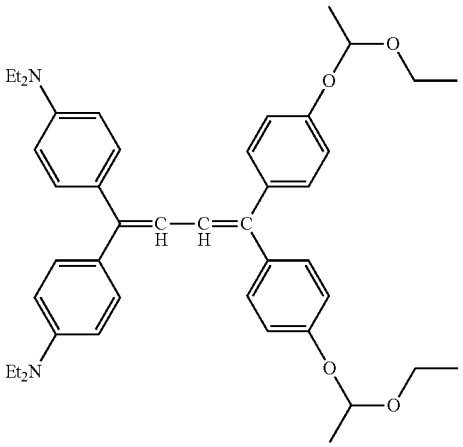
IV-40
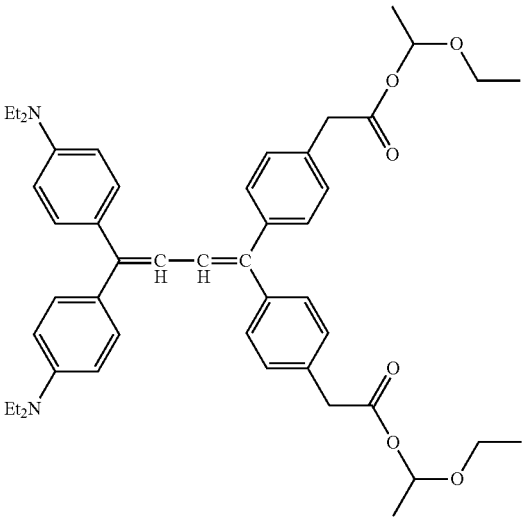

Specific examples of the compound represented by the general formula (V) include the following compounds (V-1) to (V-55). In the following formulae representing the compounds, Me and a chemical bond shown with no substituent each represents a methyl group.
(V-1)
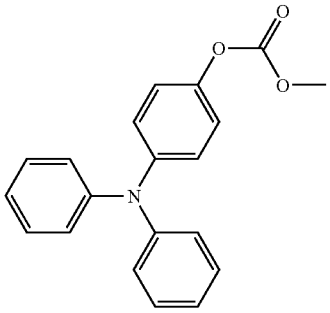
(V-2)
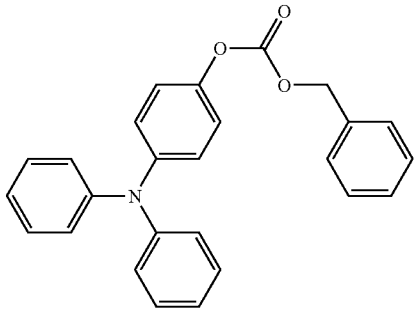
(V-3)
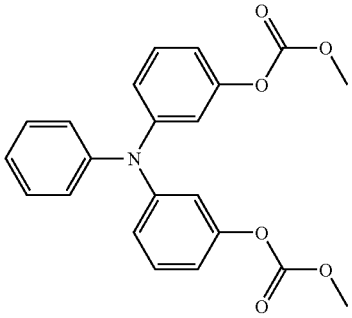
(V-4)
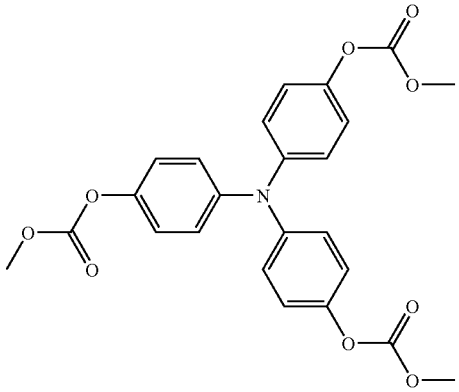
(V-5)
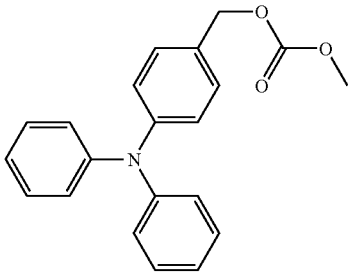
(V-6)
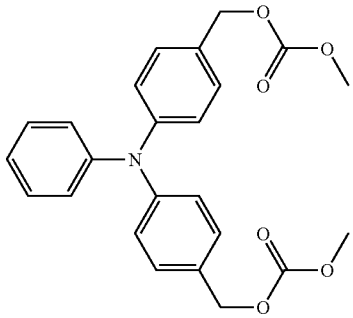
(V-7)
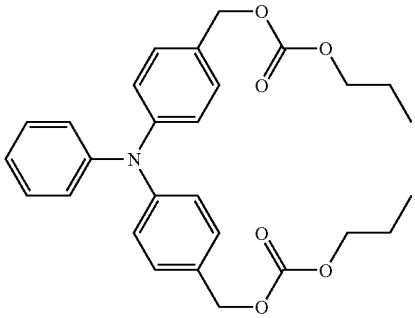
(V-8)
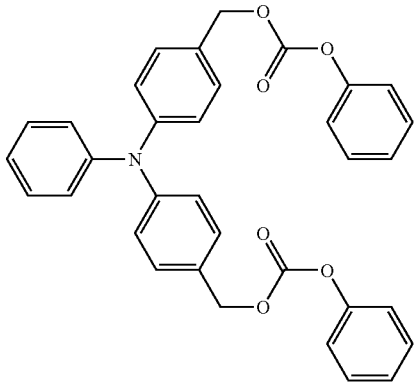

-continued
(V-9)
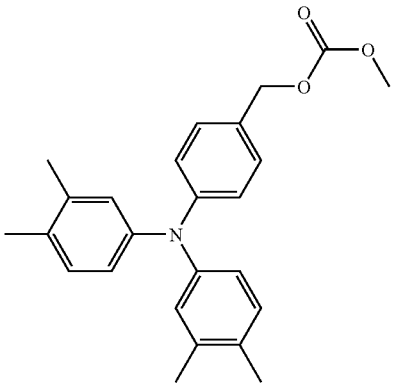
(V-10)
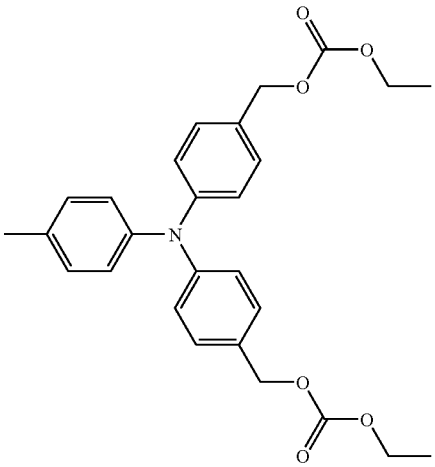
(V-11)
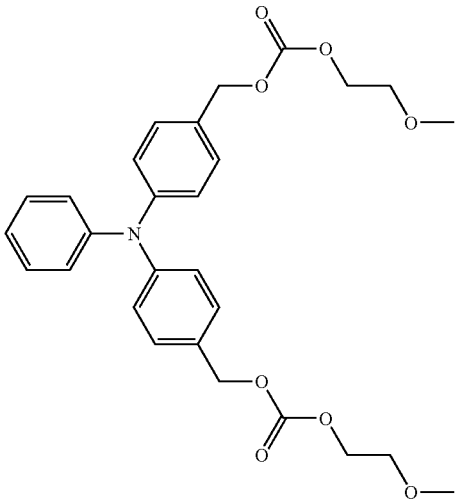
(V-12)
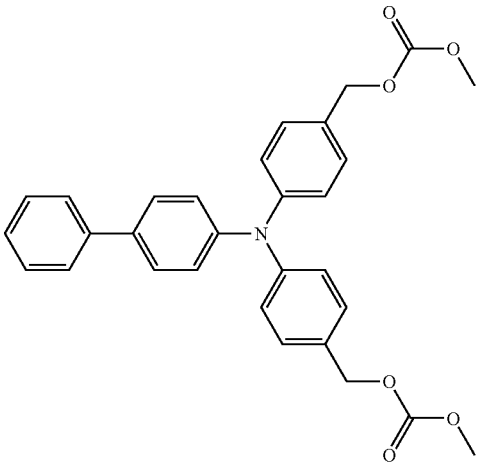
(V-13)
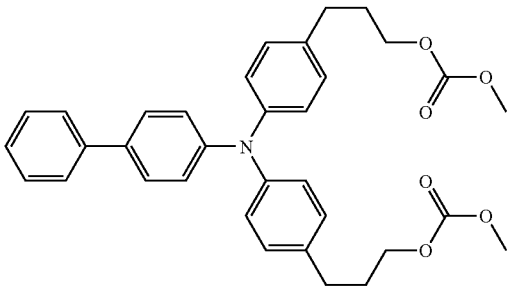
(V14)
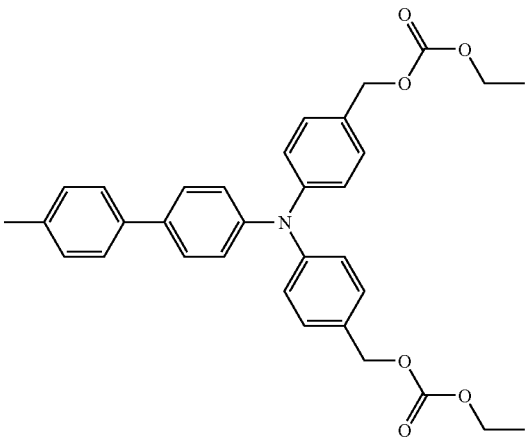

-continued
(V-15)
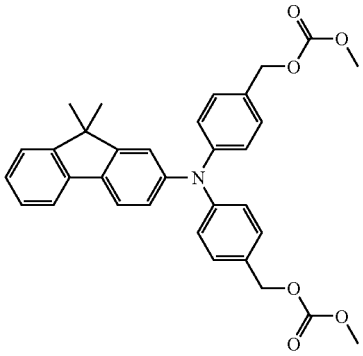
(V-16)
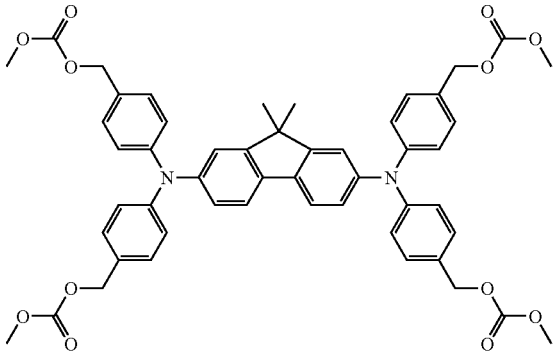
(V-17)
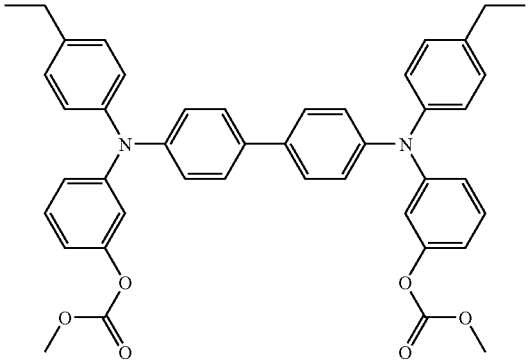
(V-18)
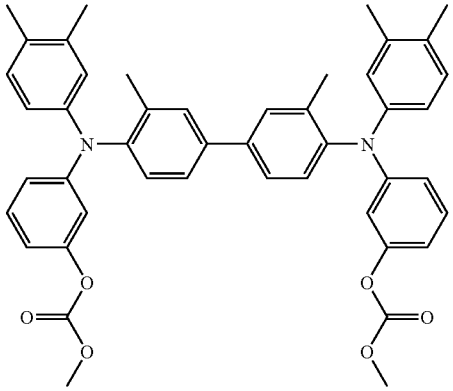
(V-19)
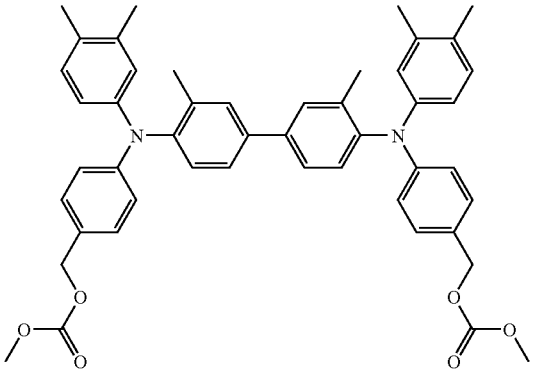
(V-20)
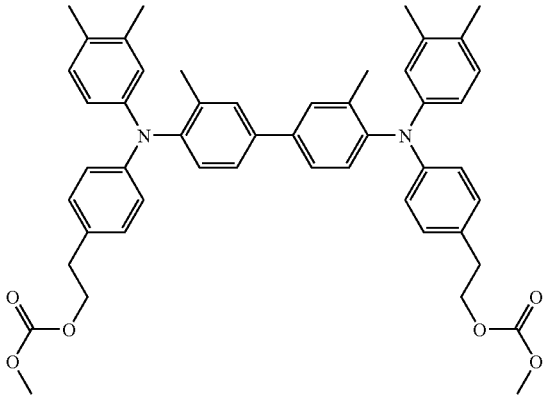

-continued
(V-21)
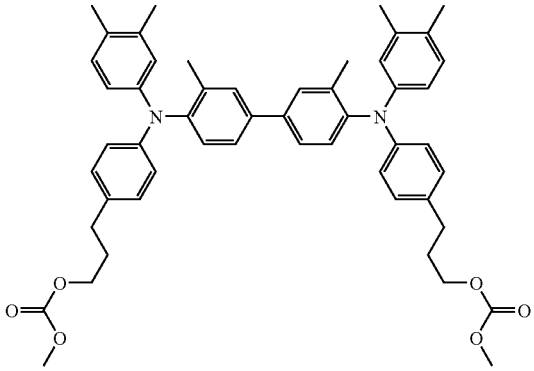
(V-22)
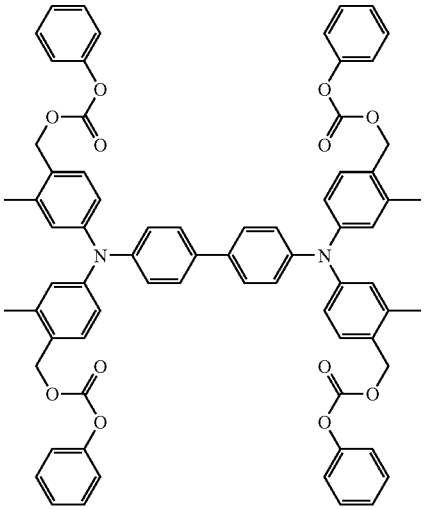
(V-23)
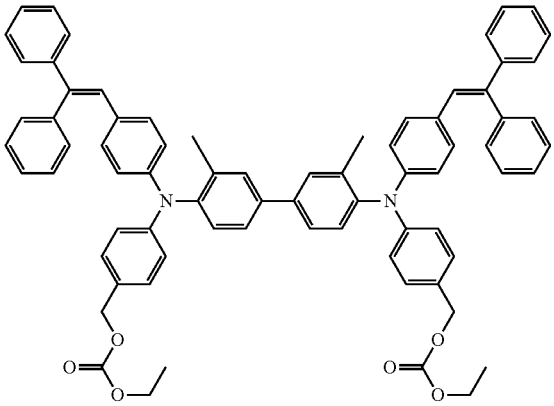
(V-24)
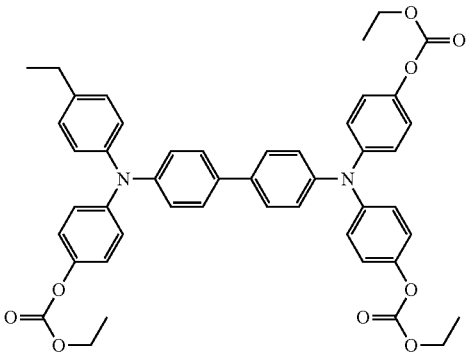
(V-25)
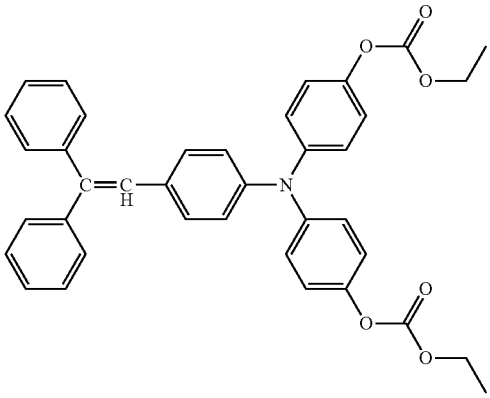
(V-26)
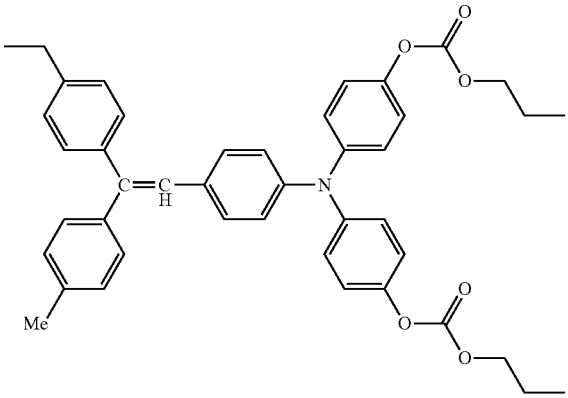

-continued
(V-27)
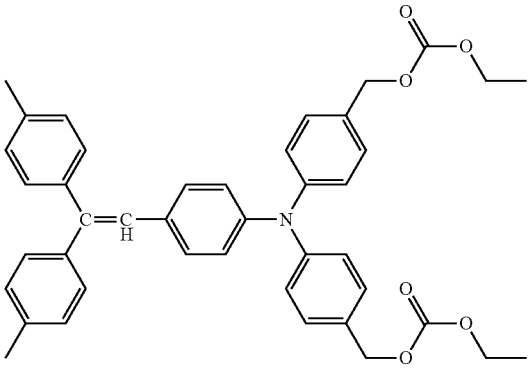
(V-28)
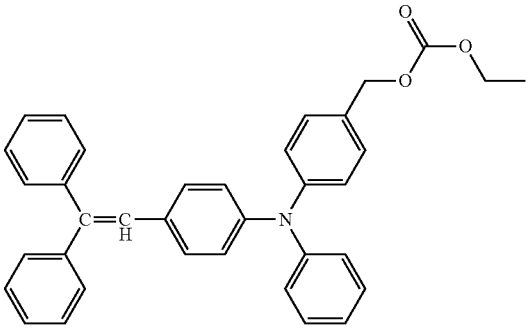
(V-29)
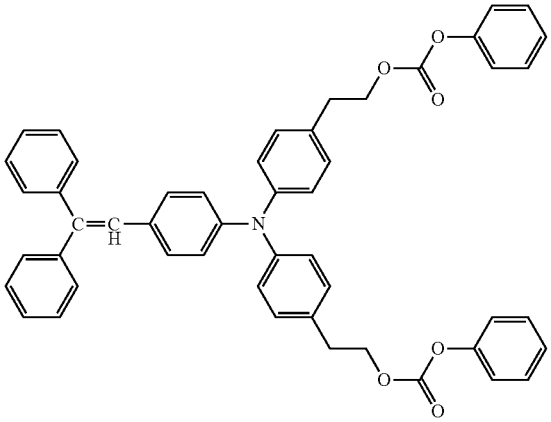
(V-30)
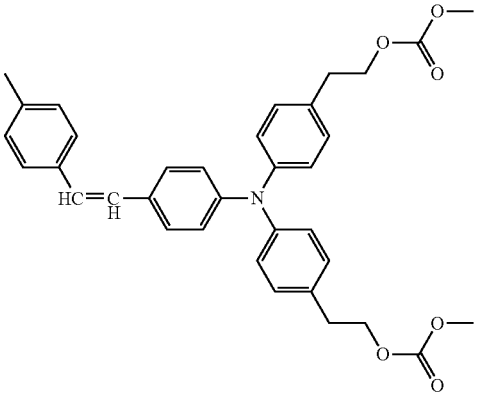
(V-31)
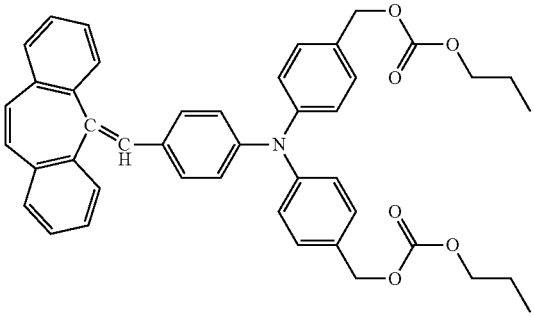
(V-32)
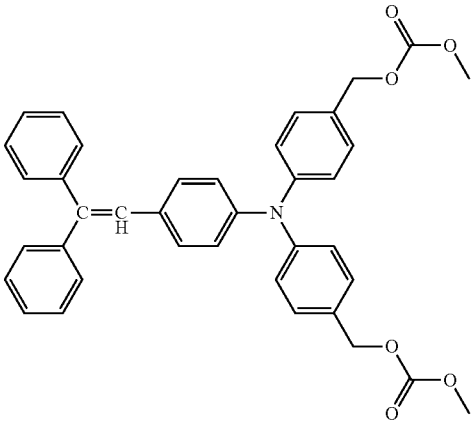
(V-33)
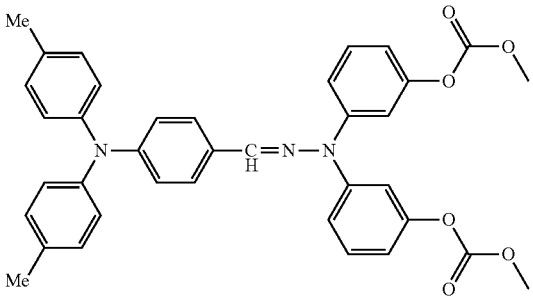
(V-34)
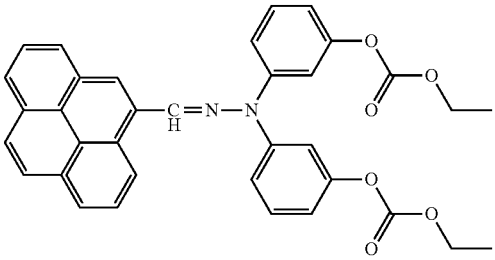

-continued
(V-35)
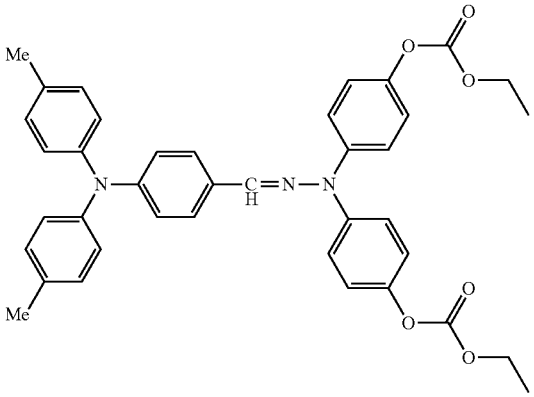
(V-36)
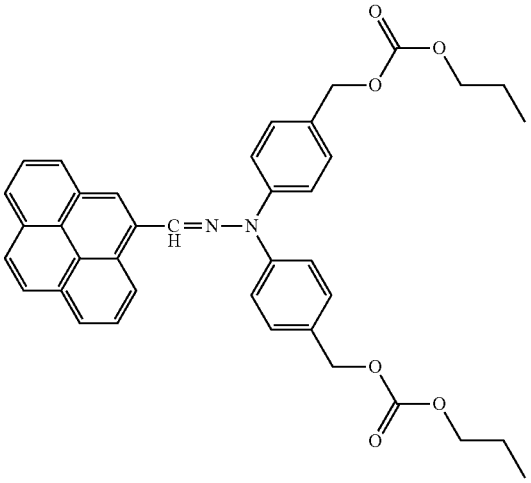
(V-37)
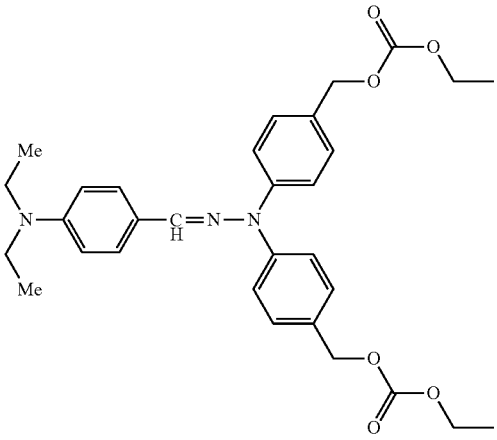
(V-38)
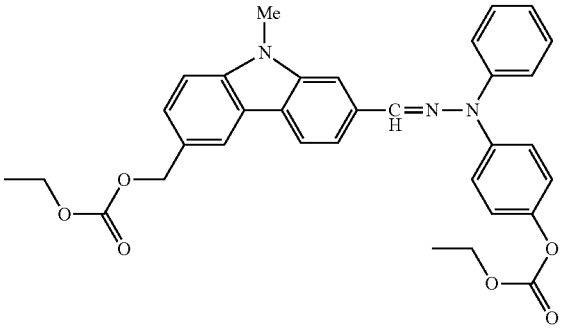
(V-39)
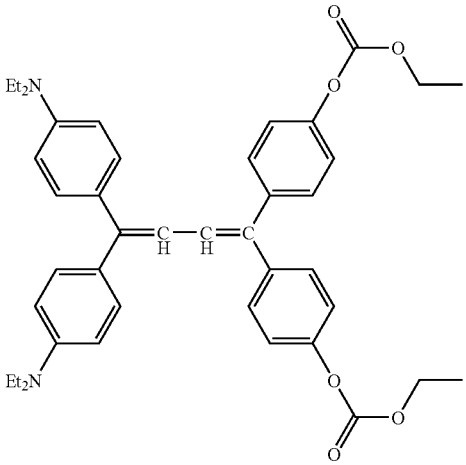
(V-40)
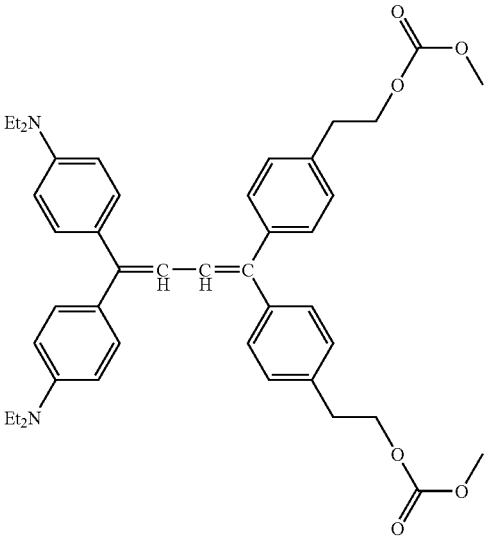

-continued
(V-41)
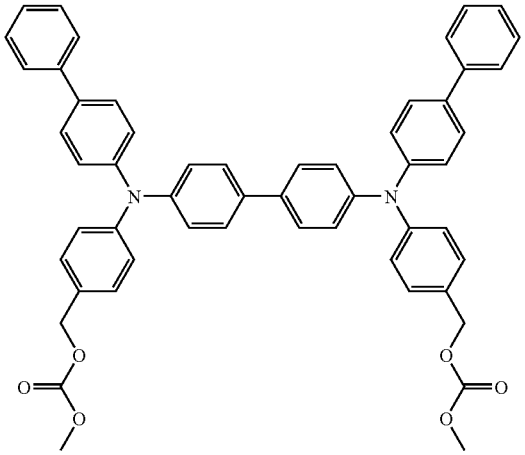
(V-42)
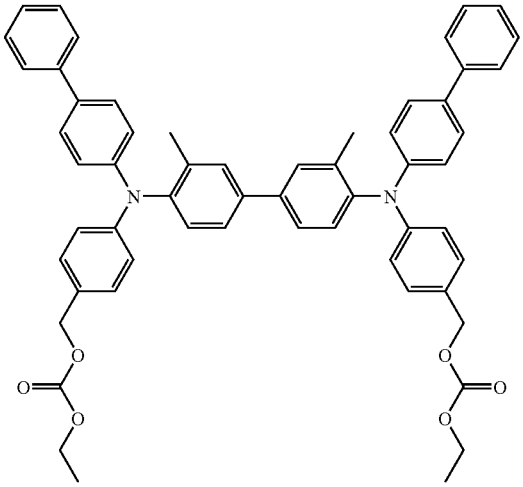
(V-43)
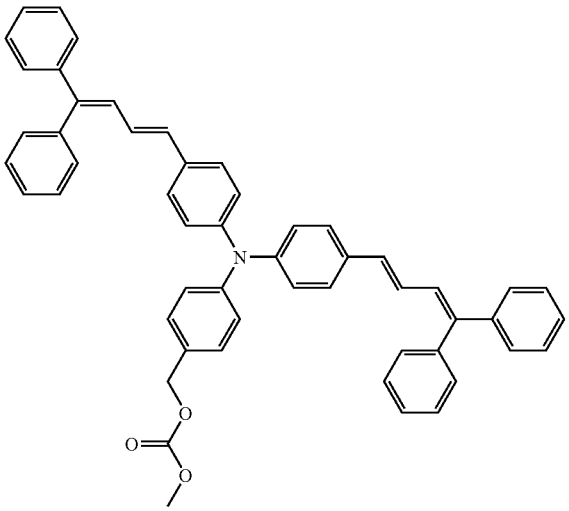
(V-44)
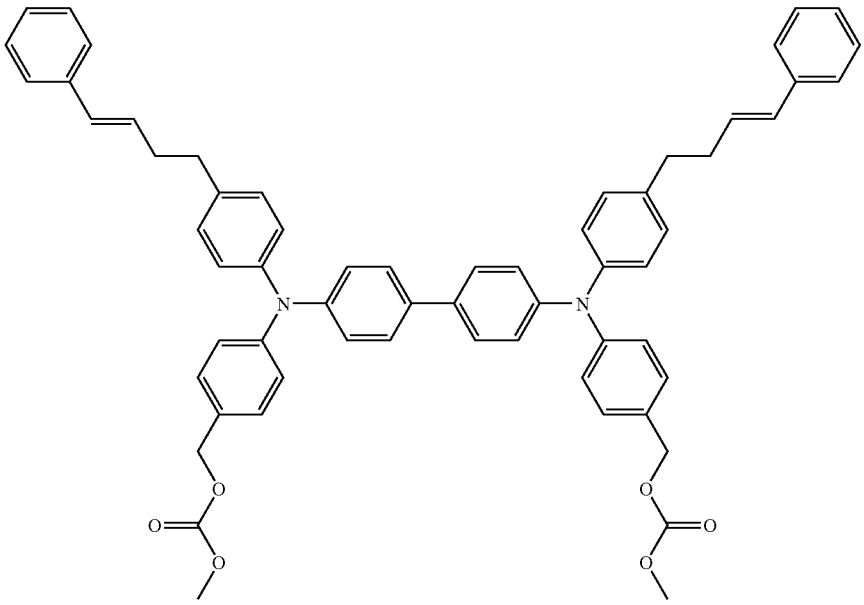

-continued
(V-45)
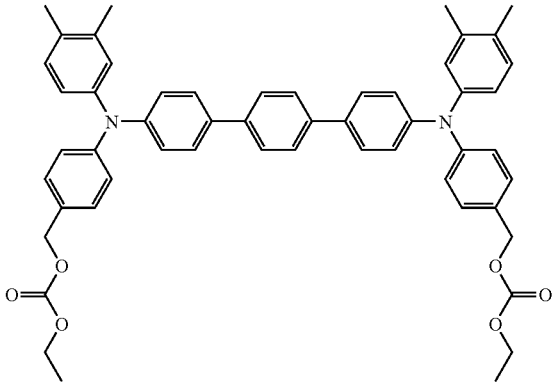
(V-46)
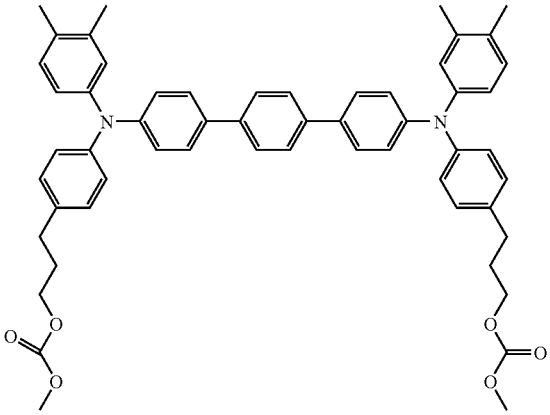
(V-47)
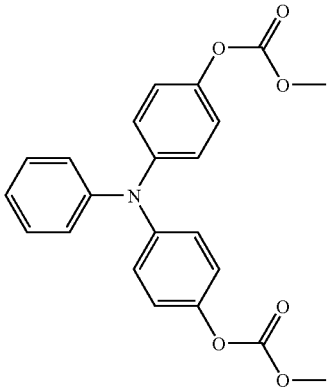
(V-48)
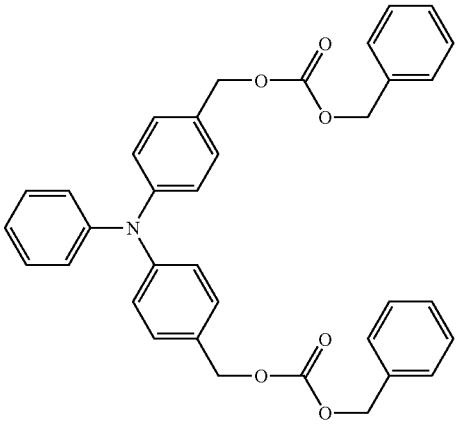
(V-49)
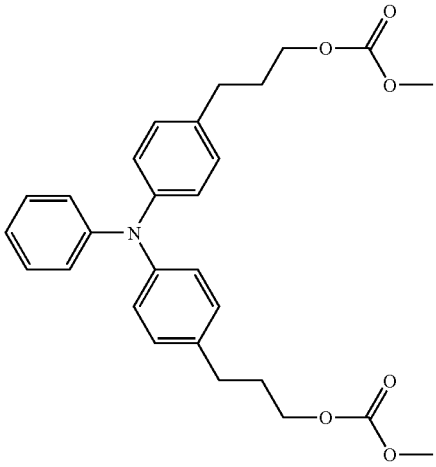
(V-50)
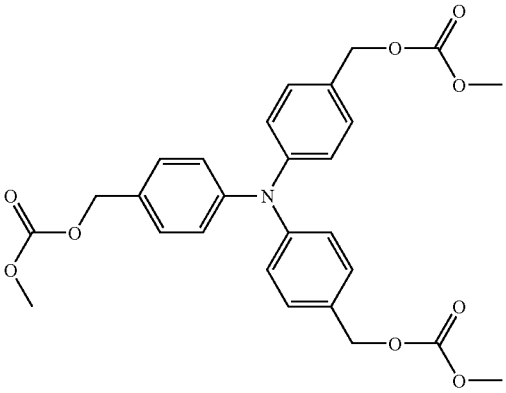

-continued (V-51)

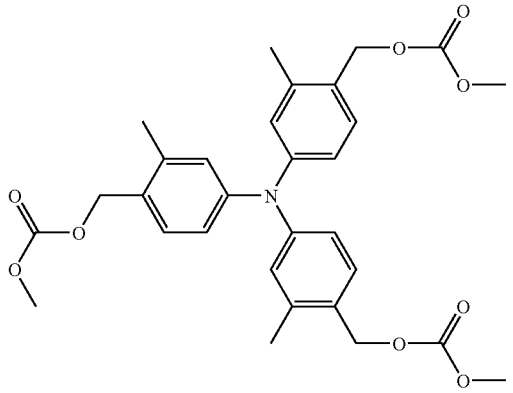

(V-52)

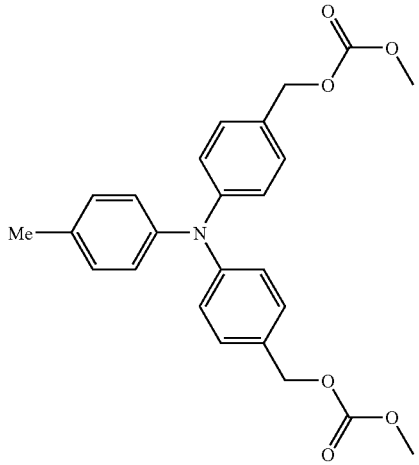

(V-53)

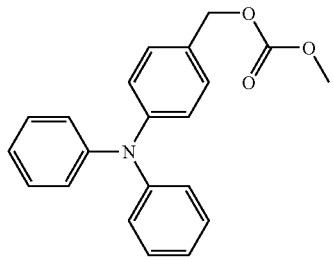

(V-54)

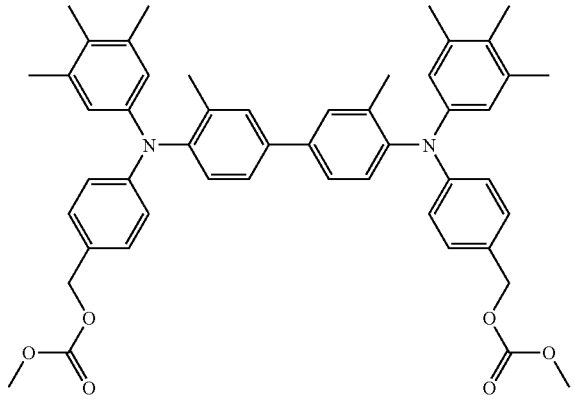

(V-55)

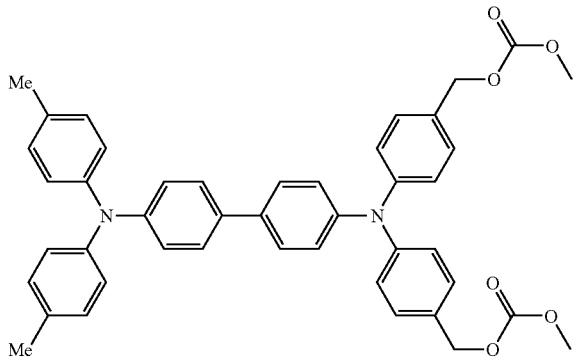

A compound represented by the following general formula (XII) may be added to the protective layer 7 for controlling various properties, such as strength and film resistance, of the protective layer 7.

$$Si(R^{50})_{(4-c)}Q_c \quad \text{(XII)}$$

wherein $R^{50}$ represents a hydrogen atom, an alkyl group or a substituted or unsubstituted aryl group, Q represents a hydrolyzable group, and c represents an integer of from 1 to 4.

Specific examples of the compound represented by the general formula (XII) include the following silane coupling agents. Examples of the silane coupling agent include a tetrafunctional alkoxysilane (c=4), such as tetramethoxysilane and tetraethoxysilane; a trifunctional alkoxysilane (c=3), such as methyltrimethoxysilane, methyltriethoxysilane, ethyltrimethoxysilane, methyltrimethoxyethoxysilane, vinyltrimethoxysilane, vinyltriethoxysilane, phenyltrimethoxysilane, γ-glycidoxypropylmethyldiethoxysilane, γ-glycidoxypropyltrimethoxysilane, γ-aminopropyltriethoxysilane, γ-aminopropyltrimethoxysilane, γ-aminopropylmethyldimethoxysilane, N-β-(aminoethyl)-γ-aminopropyltriethoxysilane, (tridecafluoro-1,1,2,2-tetrahydrooctyl) triethoxysilane, (3,3,3-trifluoropropyl)trimethoxysilane, 3-(heptafluoroisopropoxy)propyltriethoxysilane, 1H,1H,2H,2H-perfluoroalkyltriethoxysilane, 1H,1H,2H,2H-perfluorodecyltriethoxysilane and 1H,1H,2H,2H-perfluorooctyltriethoxysilane; a difunctional alkoxysilane (c=2), such as dimethyldimethoxysilane, diphenyldimethoxysilane and methylphenyldimethoxysilane; and a monofunctional alkoxysilane (c=1), such as trimethylmethoxysilane. Trifunctional and tetrafunctional alkoxysilane are preferred for improving the strength of the film, and monofunctional and difunctional alkoxysilane are preferred for improving the flexibility and the film forming property.

The silane coupling agent may be used in an arbitrary amount, and in the case where a fluorine-containing compound is used, the amount of the fluorine-containing compound is preferably 0.25 time by weight or less the amount of the compound containing no fluorine. In the case where the amount exceeds the aforementioned range, there are some cases where a problem occurs in film forming property of the crosslinked film.

A silicone hardcoat agent produced with the coupling agent may also be used. Examples of the commercially available hardcoat agent include KP-85, X-40-9740 and X-40-2239 (produced by Shin-Etsu Silicone Co., Ltd.), and AY42-440, AY42-441 and AY49-208 (produced by Toray Dow Corning Co., Ltd.).

A compound having two or more silicon atoms represented by the following general formula (XIII) is preferably added to the protective layer 7 for improving the strength thereof:

$$B—(Si(R^{51})_{(3-d)}Q_d)^2 \quad \text{(XIII)}$$

wherein B represents a divalent organic group, $R^{51}$ represents a hydrogen atom, an alkyl group or a substituted or unsubstituted aryl group, Q represents hydrolyzable group, and d represents an integer of from 1 to 3. More specifically, preferred examples of the compound represented by the general formula (XIII) include the following compounds (XIII-1) to (XIII-16).

XIII-1 $(MeO)_3Si—(CH_2)_2—Si(OMe)_3$
XIII-2 $(MeO)_2MeSi—(CH_2)_2—SiMe(OMe)_2$
XIII-3 $(MeO)_2MeSi—(CH_2)_6—SiMe(OMe)_2$
XIII-4 $(MeO)_3Si—(CH_2)_6—Si(OMe)_3$
XIII-5 $(EtO)_3Si—(CH_2)_6—Si(Oet)_3$
XIII-6 $(MeO)_2MeSi—(CH_2)_{10}—SiMe(OMe)_2$
XIII-7 $(MeO)_3Si—(CH_2)_3—NH—(CH_2)_3—Si(OMe)_3$
XIII-8 $(MeO)_3Si—(CH_2)_3—NH—(CH_2)_2—Si(OMe)_3$

XIII-9

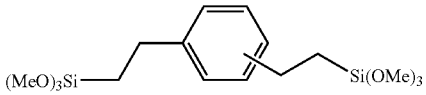

XIII-10

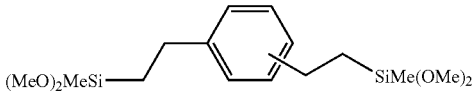

XIII-11

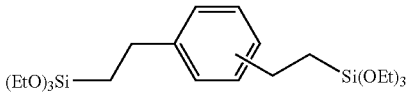

XIII-12

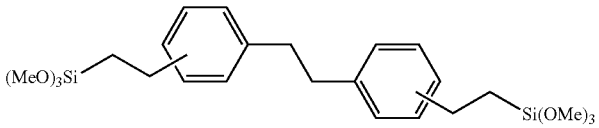

XIII-13

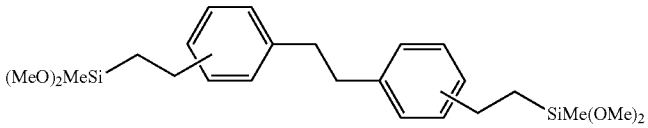

XIII-14

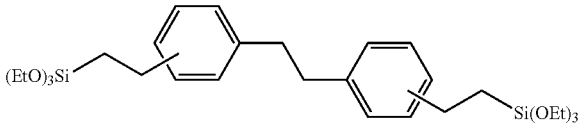

XIII-15 $(MeO)_3SiC_3H_6—O—CH_2CH\{—O—C_3H_6Si(OMe)_3\}—CH_2\{—O—C_3H_6Si(OMe)_3\}$
XIII-16 $(MeO)_3SiC_2H_4—SiMe_2—O—SiMe_2—O—SiMe_2—C_2H_4Si(OMe)_3$

A resin may be added to the protective layer 7 for such various purposes as discharge gas resistance, mechanical strength, flaw resistance, particle dispersibility, control of viscosity, reduction in torque, control of wear amount and improvement in pot life. In the embodiment, a resin soluble in an alcohol is preferably further added. Examples of the resin soluble in an alcohol include a polyvinyl butyral resin, a polyvinyl formal resin, a polyvinyl acetal resin, such as a partially acetalized polyvinyl acetal resin, in which a part of butyral is modified with formal, acetoacetal or the like, (such as S-LEC B and K, produced by Sekisui Chemical Co., Ltd.), a polyamide resin, a cellulose resin and a polyvinyl phenol resin. A polyvinyl acetal resin and a polyvinyl phenol resin are preferred from the standpoint of improvement in electric characteristics.

The molecular weight of the resin is preferably from 2,000 to 100,000, and more preferably from 5,000 to 50,000. In the case where the molecular weight is less than 2,000, there is such a tendency that the intended effect cannot be obtained, and in the case where it exceeds 100,000, there is such a tendency that the addition amount is restricted due to the lowered solubility thereof, and film formation failure occurs upon coating. The addition amount of the resin is preferably from 1 to 40% by weight, more preferably from 1 to 30% by weight, and most preferably from 5 to 20% by weight. In the case where the addition amount is less than 1% by weight, the intended effect may be hardly obtained, and in the case where it exceeds 40% by weight, there is such a possibility that image blur occurs under a high temperature and high humidity environment. The resin may be used solely or as a mixture of plural kinds thereof.

A cyclic compound having a repeating unit represented by the following general formula (XIV) or a derivative derived from the compound is preferably added to the protective layer 7 for improving the pot life and for controlling the film characteristics:

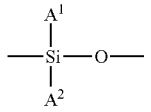

(XIV)

wherein $A^1$ and $A^2$ each independently represents a monovalent organic group.

Examples of the cyclic compound having a repeating unit represented by the general formula (XIV) include commercially available cyclic siloxane compound. Specific examples of the cyclic siloxane compound include a cyclic dimethylcyclosiloxane compound, such as hexamethylcyclotrisiloxane, octamethylcyclotetrasiloxane, decamethylcyclpentasiloxane and dodecamethylcyclohexasiloxane, a cyclic methylphenylcyclosiloxane compound, such as 1,3,5-trimethyl-1,3,5-triphenylcyclotrisiloxane, 1,3,5,7-tetramethyl-1,3,5,7-tetraphenylcyclotetrasiloxane and 1,3,5,7,9-pentamethyl-1,3,5,7,9-pentaphenylcyclopentasiloxane, a cyclic phenylcyclosiloxane compound, such as hexaphenylcyclotrisiloxane, a fluorine atom-containing cyclosiloxane compound, such as 3-(3,3,3-trifluoropropyl)methylcyclotrisiloxane, a hydrosilyl group-containing cyclosiloxane compound, such as a methylhydrosiloxane mixture, pentamethylcyclopentasiloxane and phenylhydrocyclosiloxane, a vinyl group-containing cyclosiloxane compound, such as pentavinylpentamethylcyclopentasiloxane. The cyclic siloxane compound may be used solely or as a mixture of plural kinds thereof.

Various kinds of fine particles may be added to the protective layer 7 for controlling the resistance to adhesion of contaminants, the lubricating property, the hardness and the like of the surface of the electrophotographic photoreceptor. The fine particles may be added solely or as a mixture of plural kinds thereof.

Examples of the fine particles include silicon atom-containing fine particles and fluorine atom-containing resin fine particles. The silicon atom-containing fine particles are fine particles containing silicon as a constitutional element, and specific examples thereof include colloidal silica and silicone fine particles. The colloidal silica used as the silicon atom-containing fine particles preferably has a volume average particle diameter of from 1 to 100 nm, and more preferably from 10 to 30 nm. The colloidal silica is preferably selected from those dispersed in an organic solvent, such as an alcohol, a ketone and an ester, and may be selected from commercially available products. The solid content of the colloidal silica in the protective layer 7 is not particularly limited, and is preferably in a range of from 0.1 to 50% by weight, and more preferably in a range of from 0.1 to 30% by weight, based on the total solid content of the protective layer 7, from the standpoint of film forming property, electric characteristics and strength.

Silicone fine particles used as the silicon atom-containing fine particles preferably has a spherical shape and a volume average particle diameter of from 1 to 500 nm, and more preferably from 10 to 100 nm. The silicone fine particles are preferably selected from silicone resin particles, silicone rubber particles and silicone surface-treated silica particles, and may be selected from commercially available products.

The silicone fine particles are chemical inert, are particles having a small diameter excellent in dispersibility in resins, and are low in addition amount required for obtaining the sufficient characteristics, and therefore, they can improve the surface property of electrophotographic photoreceptor without impairing the crosslinking reaction. In other words, the silicon fine particles, which are incorporated uniformly in the firm crosslinked structure, can improve the lubricating property and the water repellent property of the surface of the electrophotographic photoreceptor and can maintain the wear resistance and the resistance to adhesion of contaminants of the surface of the electrophotographic photoreceptor in good conditions for a long period of time. The content of the silicone fine particles in the protective layer 7 is preferably from 0.1 to 30% by weight, and more preferably from 0.5 to 10% by weight, based on the total solid content in the protective layer 7.

Examples of the fluorine atom-containing resin particles include fluorine fine particles, such as fine particles obtained by polymerizing tetrafluoroethylene, trifluoroethylene, hexafluoropropylene, vinyl fluoride and vinylidene fluoride, and fine particles of a resin obtained by copolymerizing a fluorine resin and a monomer having a hydroxyl group, which is shown in Preprints of the 8th Polymer Material Forum, p. 89.

Examples of the other fine particles include particles of a semiconductive metallic oxide, such as $ZnO—Al_2O_3$, $SnO_2—Sb_2O_3$, $In_2O_3—SnO_2$, $ZnO—TiO_2$, $MgO—Al_2O_3$, $FeO—TiO_2$, $TiO_2$, $SnO_2$, $In_2O_3$, ZnO and MgO.

An oil, such as a silicone oil, may be added to the protective layer 7 for the similar purposes. Examples of the silicone oil include a silicone oil, such as dimethylpolysiloxane, diphenylpolysiloxane and phenylmethylpolysiloxane, and a reactive silicone oil, such as amino-modified polysiloxane, epoxy-modified polysiloxane, carboxyl-modified polysiloxane, carbinol-modified polysiloxane, methacrylic-modified polysiloxane, mercapto-modified polysiloxane and phenol-modified polysiloxane. The oil may be added in advance to the coating composition for forming the protective layer or may be impregnated into the protective layer under reduced pressure or increased pressure after producing the photoconductor.

The protective layer 7 may contain such an additive as a plasticizer, a surface improving agent, an antioxidant and a light degradation preventing agent. Examples of the plasticizer include biphenyl, biphenyl chloride, terphenyl, dibutyl phthalate, diethylene glycol phthalate, dioctyl phthalate, triphenyl phosphate, methylnaphthalene, benzophenone, chlorinated paraffin, polypropylene, polystyrene and various kinds of fluorohydrocarbons.

An antioxidant is particularly preferably added to the protective layer 7 for preventing deterioration due to an oxidative gas, such as ozone, generated in the charging device. In the case where the photoreceptor has a prolonged service life owing to an improved mechanical strength on the surface of the photoreceptor, the photoreceptor is in contact with an oxidative gas for a long period of time, and therefore the photoreceptor is demanded to have higher oxidation resistance than the conventional products. Preferred examples of the antioxidant include a hindered phenol antioxidant and a hindered amine antioxidant, and such known antioxidants may also be used as an organic sulfur antioxidant, a phosphite antioxidant, a dithiocarbamate antioxidant, a thiourea antioxidant and a benzimidazole antioxidant. The addition amount of the antioxidant in the protective layer 7 is preferably 20% by weight or less, and more preferably 10% by weight or less.

Examples of the hindered phenol antioxidant include 2,6-di-t-butyl-4-methylphenol, 2,5-di-t-butylhydroquinone, N,N'-hexamethylenebis(3,5-di-t-butyl-4-hydroxyhydrocinnamide, 3,5-di-t-butyl-4-hyxroxybenzylphosphonate diethyl ester, 2,4-bis((octylthio)methyl)-o-cresol, 2,6-di-t-butyl-4-ethylphenol, 2,2'-methylenebis(4-methyl-6-t-butylphenol), 2,2'-methylenebis(4-ethyl-6-t-butylphenol), 4,4'-butylidenebis(3-methyl-6-t-butylphenol), 2,5-di-t-amylhydroquinone, 2-t-butyl-6-(3-butyl-2-hydroxy-5-methylbenzyl)-4-metyylphenyl acrylate and 4,4-butylidenebis(3-methyl-6-t-butylphenol).

Examples of the commercially available hindered phenol antioxidant include Sumilizer BHT-R, Sumilizer MDP-S, Sumilizer BBM-S, Sumilizer WX-R, Sumilizer NW, Sumilizer BP-76, Sumilizer BP-101, Sumilizer GA-80, Sumilizer GM and Sumilizer GS, all produced by Sumitomo Chemical Co., Ltd., IRGANOX 1010, IRGANOX 1035, IRGANOX 1076, IRGANOX 1098, IRGANOX 1135, IRGANOX 1141, IRGANOX 1222, IRGANOX 1330, IRGANOX 1425WL, IRGANOX 1520L, IRGANOX 245, IRGANOX 259, IRGANOX 3114, IRGANOX 3790, IRGANOX 5057 and IRGANOX 565, all produced by Ciba Specialty Chemicals, Inc., and ADEKA STUB AO-20, ADEKA STUB AO-30, ADEKA STUB AO-40, ADEKA STUB AO-50, ADEKA STUB AO-60, ADEKA STUB AO-70, ADEKA STUB AO-80 and ADEKA STUB AO-330, all produced by Asahi Denka Co., Ltd. Examples of the commercially available hindered amine antioxidant include Sanol LS2626, Sanol LS756, Sanol LS770 and Sanol LS744, all produced by Sankyo Lifetech Co., Ltd., TINUVIN 144 and TINUVIN 622LD, all produced by Ciba Specialty Chemicals, Inc., MARK LA57, MARK LA67, MARK LA62, MARK LA68 and MARK LA63, all produced by Asahi Denka Co., Ltd. and Sumilizer TPS, produced by Sumitomo Chemical Co., Ltd. Examples of the commercially available thioether antioxidant include Sumilizer TP-D, produced by Sumitomo Chemical Co., Ltd. Examples of the commercially available phosphite antioxidant include MARK 2112, MARK PEP-8, MARK PEP-24G, MARK PEP-36, MARK 329K and MARK HP-10, all produced by Asahi Denka Co., Ltd.

These antioxidants may be modified with such a substituent as an alkoxysilyl group capable of undergoing crosslinking reaction with a material forming a crosslinked film.

The protective layer 7 may contain such an insulating resin as a polyvinyl butyral resin, a polyarylate resin (a polycondensate of bisphenol A and phthalic acid), a polycarbonate resin, a polyester resin, a phenoxy resin, a vinyl chloride-vinyl acetate copolymer, a polyamide resin, an acrylic resin, a polyacrylamide resin, a polyvinylpyridine resin, a cellulose resin, a urethane resin, an epoxy resin, casein, a polyvinyl alcohol resin and a polyvinylpyrrolidone resin. In this case, the insulating resin may be contained in a desired proportion, whereby adhesion to the charge transporting layer 6 can be improved, and defects in the coated film due to thermal contraction and repellency can be suppressed.

Electroconductive particles may be added to the protective layer 7 for decreasing the residual potential. Examples of the electroconductive particles include a metal, a metallic oxide and carbon black, and a metal and a metallic oxide are preferred. Examples of the metal include aluminum, zinc, copper, chromium, nickel, silver and stainless steel, and also include plastic particles having these metals vapor-deposited thereon. Examples of the metallic oxide include zinc oxide, titanium oxide, tin oxide, antimony oxide, indium oxide, bismuth oxide, indium oxide doped with tin, tin oxide doped with antimony or tantalum, and zirconium oxide doped with antimony. These may be used solely or in combination of plural kinds thereof. In the case where plural kinds thereof are used in combination, they may be simply mixed, or may be formed into a solid solution or a fused complex. The average particle diameter of the electroconductive particles is preferably 0.3 μm or less, and particularly preferably 0.1 μm or less, from the standpoint of transparency of the protective layer.

The protective layer 7 may be formed by using a coating composition for forming a protective layer containing the aforementioned constitutional materials.

The protective layer 7 is formed by using the charge transporting material having a reactive functional group, and therefore, it is preferred that a catalyst is added to the coating composition for forming a protective layer, or a catalyst is used upon producing the coating composition for forming a protective layer. Examples of the catalyst used include an inorganic acid, such as hydrochloric acid, acetic acid, phosphoric acid and sulfuric acid, an organic acid, such as formic acid, propionic acid, oxalic acid, p-toluenesulfonic acid, benzoic acid, phthalic acid and maleic acid, an alkali catalyst, such as potassium hydroxide, sodium hydroxide, calcium hydroxide, ammonia and triethylamine, and a solid catalyst insoluble in the system.

In order to remove a catalyst upon production from the phenol derivative having a methylol group, it is preferred that the phenol derivative is dissolved in a suitable solvent, such as methanol, ethanol, toluene and ethyl acetate, and then subjected to washing with water and reprecipitation with a poor solvent, or subjected to a treatment with an ion exchange resin or a inorganic solid.

Examples of the ion exchange resin include a cation exchange resin, such as Amberlite 15, Amberlite 200C and Amberlist 15E, all produced by Rohm & Haas Company, Dowex MWC-1-H, Dowex 88 and Dowex HCR-W2, all produced by Dow Chemical Company, Lewatit SPC-108 and Lewatit SPC-118, produced by Bayer AG, Diaion RCP-150H, produced by Mitsubishi Chemical Corp., Sumikaion KC-470, Duolite C26-C, Duolite C-433 and Duolite 464, all produced by Sumitomo Chemical Co., Ltd., and an anion exchange resin, such as Amberlite IRA-400 and Amberlite IRA-45, all produced by Rohm & Haas Company.

Examples of the inorganic solid include an inorganic solid having a group containing a protonic acid bonded on the surface thereof, such as $Zr(O_3PCH_2CH_2SO_3H)_2$ and $Th(O_3PCH_2CH_2COOH)_2$, polyorganosiloxane containing a protonic acid, such as polyorganosiloxane having a sulfonic acid group, a heteropoly acid, such as cobalt tungstate and phosphorous molybdate, isopoly acid, such as niobic acid, tantalic acid and molybdic acid, a monoelemental metallic oxide, such as silica gel, alumina, chromia, zirconia, CaO and MgO, a complex metallic oxide, such as silica-alumina, silica-magnesia, silica-zirconia and zeolite, a clay mineral, such as acid clay, activated clay, montmorillonite and kaolinite, a metallic sulfate, such as $LiSO_4$ and $MgSO_4$, a metallic phosphate, such as zirconium phosphate and lanthanum phosphate, a metallic nitrate, such as $LiNO_3$ and $Mn(NO_3)_2$, an inorganic solid having a group containing an amino group bonded on the surface thereof, such as a solid obtained by reacting aminopropyltriethoxysilane on silica gel, and polyorganosiloxane containing an amino group, such as amino-modified silicone resin.

In the coating composition for forming a protective layer, various kinds of solvents may be used depending on necessity, such as an alcohol, such as methanol, ethanol, propanol and butanol, a ketone, such as acetone and methyl ethyl ketone, tetrahydrofuran, and an ether, such as diethyl ether and dioxane, as well as other various kinds of solvents. In the case where the dip coating method is employed, which has been generally used for producing an electrophotographic photoreceptor, an alcohol solvent, a ketone solvent or a mixed solvent thereof is preferably used. The solvent used preferably has a boiling point of from 50 to 150° C., and the solvents may be used as a mixture thereof.

Since an alcohol solvent, a ketone solvent and a mixed solvent thereof are preferred as the solvent, the charge transporting material used in the protective layer is preferably soluble in the solvents.

The amount of the solvent may be arbitrarily determined, and is preferably from 0.5 to 30 parts by weight, and more preferably from 1 to 20 parts by weight, per 1 part by weight of the solid content in the coating composition for forming a protective layer, since the constitutional materials thereof are liable to be deposited when the amount of the solvent is too small.

Examples of the coating method for forming the protective layer by using the coating composition for forming a protective layer include ordinary methods, such as a blade coating method, a wire bar coating method, a spray coating method, a dip coating method, a bead coating method, an air knife coating method and a curtain coating method. In the case where the necessary thickness cannot be obtained by a one time coating operation, the necessary thickness may be obtained by repeating the coating operation. In the case where the coating operation is repeated, a heating operation may be effected per respective coating operations or may be effected after performing plural coating operations.

The protective layer 7 formed by using the coating composition for forming a protective layer is excellent in mechanical strength and further has sufficient photoelectric characteristics, and therefore it can also be used by itself as a charge transporting layer of an accumulated photoreceptor.

Figure 5:
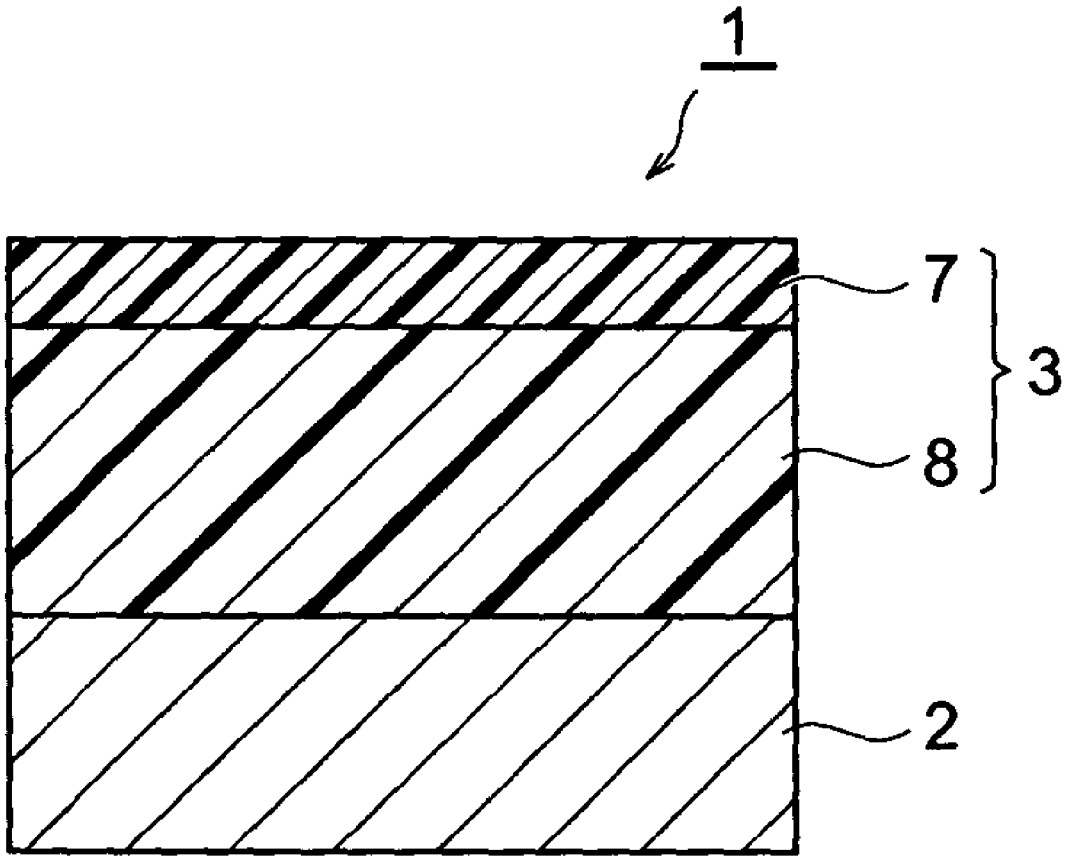
FIG. 5 is a schematic cross sectional view showing a still further preferred embodiment of the electrophotographic photoreceptor of the invention.

In the case where the single photosensitive layer 8 is produced as in the photoreceptors shown in FIGS. 4 and 5, the single photosensitive layer 8 contains a charge generating material, a charge transporting material and a binder resin. As these components, those having been described for the charge generating layer 5 and the charge transporting layer 6 may be used. The content of the charge generating material in the single photosensitive layer 8 is preferably from 10 to 85% by weight, and more preferably from 20 to 50% by weight, based on the total solid content in the single photosensitive layer. The content of the charge transporting material in the single photosensitive layer 8 is preferably from 5 to 50% by weight based on the total solid content in the single photosensitive layer. The solvent used for coating and the coating method may be the same as those for the aforementioned layers. The thickness of the single photosensitive layer is preferably about from 5 to 50 μm, and more preferably from 10 to 40 μm.

In the invention, the protective layer may not be necessarily provided in the photosensitive layer as far as the photosensitive layer satisfies the dynamic hardness and the elastic deformation ratio defined in the invention. For example, the protective layer 7 may be omitted in the case where the charge transporting layer 6 in the electrophotographic photoreceptor shown in FIG. 1 contains the aforementioned phenol resin. Specifically, the photosensitive layer may have a constitution containing an undercoating layer, a charge generating layer and a charge transporting layer in this order.

The photosensitive layer 3 may contain at least one electron acceptive substance for such a purpose as improvement in sensitivity, reduction in residual potential and reduction in fatigue upon repeated use.

Examples of the electron acceptive substance include succinic anhydride, maleic anhydride, diboromomaleic anhydride, phthalic anhydride, tetrabromophthalic anhydride, tetracyanoethylene, tetracyanoquinodimethane, o-dinitrobenzene, m-dinitrobenzene, chloranil, dinitroanthraquinone, trinitrofluorenone, picric acid, o-nitrobenzoic acid, p-nitrobenzoic acid and phthalic acid. Among these, a fluorenone compound, a quinone compound and a benzene derivative having an electron attractive substituent, such as Cl, CN and $NO_2$ are particularly preferred.

The photosensitive layer 3 may contain such an additive as an antioxidant, a light stabilizer and a heat stabilizer for preventing the photoreceptor from being deteriorated due to ozone and an oxidative gas generated in the image forming apparatus, light and heat.

Examples of the antioxidant include hindered phenol, hindered amine, p-phenylenediamine, arylalkane, hydroquinone, spirochroman, spiroindanone, derivatives thereof, an organic sulfur compound and an organic phosphorous compound. Examples of the light stabilizer include derivatives of benzophenone, benzotriazole, dithiocarbamate and tetramethylpiperidine.

It is preferred that the protective layer 7 as the outermost layer of the electrophotographic photoreceptor 1 is treated with an aqueous dispersion liquid containing a fluorine resin, whereby the torque required for rotating the electrophotographic photoreceptor can be decreased, and the transferring efficiency can be improved.

(Image Forming Apparatus and Process Cartridge)

Figure 6:
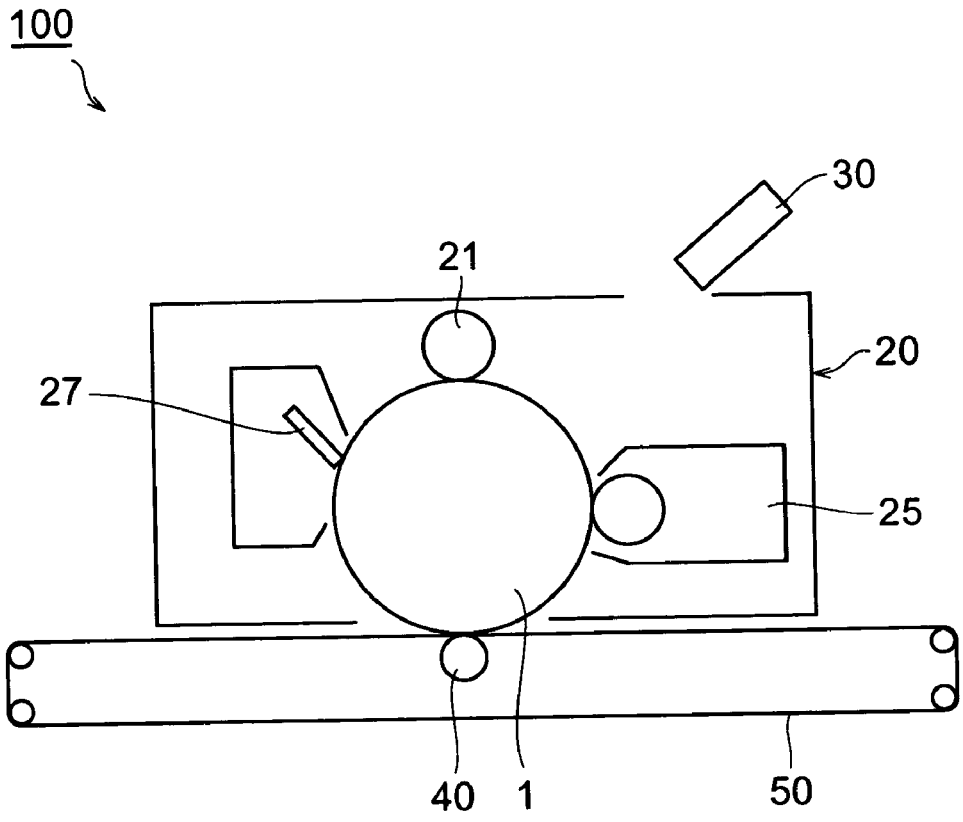
FIG. 6 is a schematic view showing a preferred embodiment of the image forming apparatus of the invention.

FIG. 6 is a schematic view showing a preferred embodiment of an image forming apparatus forming an image based on the image forming method of the invention. The image forming apparatus 100 shown in FIG. 6 has, in a main body, which is not shown in the figure, of the image forming apparatus, a process cartridge 20 equipped with an electrophotographic photoreceptor 1, an exposing device 30, a transferring device 40, and an intermediate transfer material 50. In the image forming apparatus 100, the exposing device 30 is disposed at a position where the electrophotographic photoreceptor 1 can be exposed through an opening of the process cartridge 20, the transferring device 40 is disposed to face the electrophotographic photoreceptor 1 through the intermediate transfer material 50, and the intermediate transfer material 50 is disposed in such a manner that a part thereof can be in contact with the electrophotographic photoreceptor 1.

The process cartridge 20 has, in a chassis, a charging unit 21, a developing unit 25 and a cleaning unit 27, which are integrated along with the electrophotographic photoreceptor 1 by combining with a rail. The chassis has an opening for exposure.

Examples of the charging unit 21 include a contact charging device using an electroconductive or semiconductive charging roller, a charging brush, a charging film, a charging rubber blade, a charging tube and the like. Other known charging devices may also be used, such as a non-contact roller charging device using a charging roller in the vicinity of the photoreceptor 1, and a scorotron charging device and a corotron charging device, which utilize corona discharge.

The developing unit 25 may be an ordinary developing device capable of developing an electrostatic latent image by making in contact with or in non-contact with a magnetic or non-magnetic one-component or two-component developer. The developing device is not particularly limited as far as it has the aforementioned function, and can be appropriately selected depending on purposes. For example, such a known developing device may be used that has a function of attaching a one-component or two-component developer to the photoreceptor 1 by using a brush or a roller.

Examples of the exposing device 30 include an optical device capable of imagewise exposing the surface of the photoreceptor 1 with semiconductor laser light, LED light or liquid crystal shutter light. The wavelength of the light source may be in a spectrally sensitive region of the photoreceptor. The mainstream of the wavelength of a semiconductor laser is in a near infrared region around 780 nm, but the invention is not limited thereto, and a laser having an oscillation wavelength of an order of 600 nm and a blue laser having an oscillation wavelength around a range of from 400 to 450 nm may also be used. In order to form a color image, a plane emission laser light source capable of executing multibeam output can be effectively used.

Examples of the transferring device 40 include known transfer charging devices, such as a contact transfer charging device using a belt, a roller, a film, a rubber blade or the like, and a scorotron transfer charging device and a corotron transfer charging device, which utilize corona discharge.

Examples of the intermediate transfer material 50 include a material in the form of a belt (intermediate transfer belt) having semiconductivity formed of polyimide, polyamideimide, polycarbonate, polyarylate, polyester, rubber or the like. The form of the intermediate transfer material 50 may be a drum form in addition to the belt form.

The image forming apparatus 100 may be equipped with, in addition to the aforementioned devices, a photodestaticizing device executing photodestaticization to the photoreceptor 1.

Figure 7:
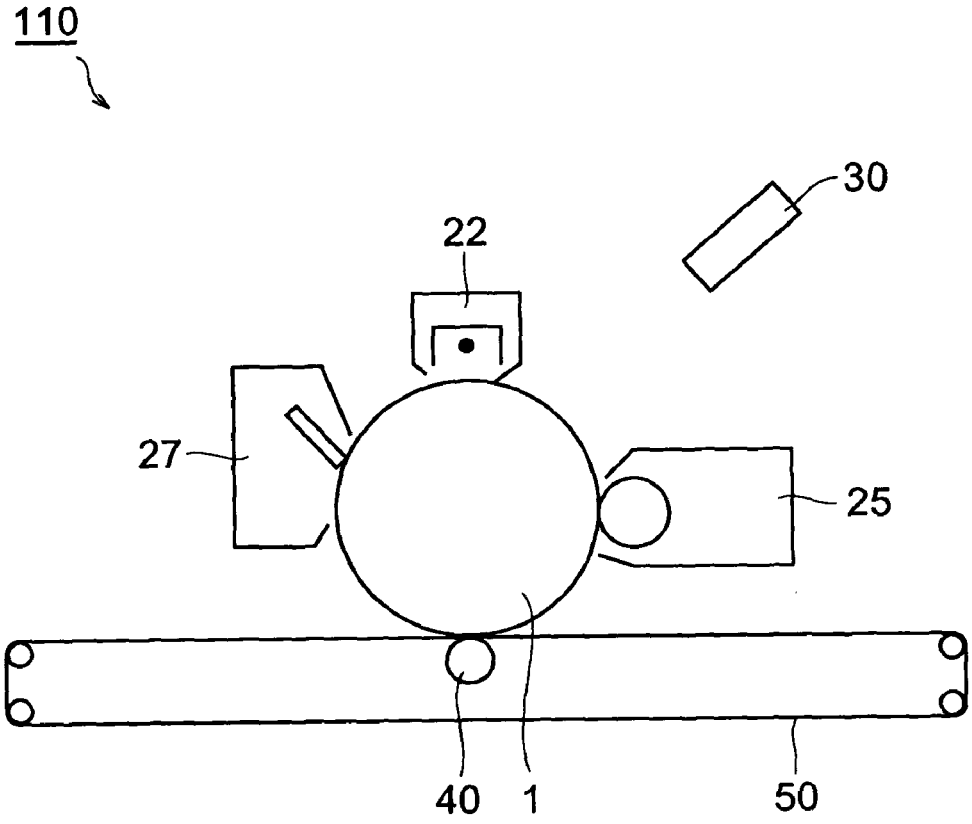
FIG. 7 is a schematic view showing another preferred embodiment of the image forming apparatus of the invention.

FIG. 7 is a schematic view showing another embodiment of the image forming apparatus of the invention. The image forming apparatus 110 shown in FIG. 7 has an electrophotographic photoreceptor 1 fixed to a main body of the image forming apparatus, and a charging device 22, a developing device 25 and a cleaning device, which are independently formed into cartridges, respectively, to constitute a charging cartridge, a developing cartridge and a cleaning cartridge. The charging device 22 has a charging unit for charging by the corona discharge system.

In the image forming apparatus 110, the electrophotographic photoreceptor 1 is separated from other devices, and the charging device 22, the developing device 25 and the cleaning device 27 are respectively mounted on the main body of the image forming apparatus detachably by drawing and pressing without fixing by screwing, crimping, adhering or welding.

In the image forming apparatus of the invention, the electrophotographic photoreceptor 1 has a protective layer having a crosslinked structure, by which the surface of the photoreceptor can be sufficiently prevented from being worn. The electrophotographic photoreceptor 1 has excellent resistance to foreign matters generated in the apparatus or getting into the apparatus to provide a long service life. According to the constitution, the electrophotographic photoreceptor may not be formed into a cartridge in some cases. Accordingly, the cost of members consumed per one printed matter can be reduced by using such a constitution that the charging device 22, the developing device 25 and the cleaning device 27 are respectively mounted on the main body detachably by drawing and pressing without fixing by screwing, crimping, adhering or welding. Among these devices, two or more devices may be integrated to form a cartridge, which is mounted detachably, whereby the cost of members consumed per one printed matter can be further reduced.

The image forming apparatus 110 has the same constitution as the image forming apparatus 100 except that the charging device 22, the developing device 25 and the cleaning device 27 are respectively formed into cartridges.

Figure 8:
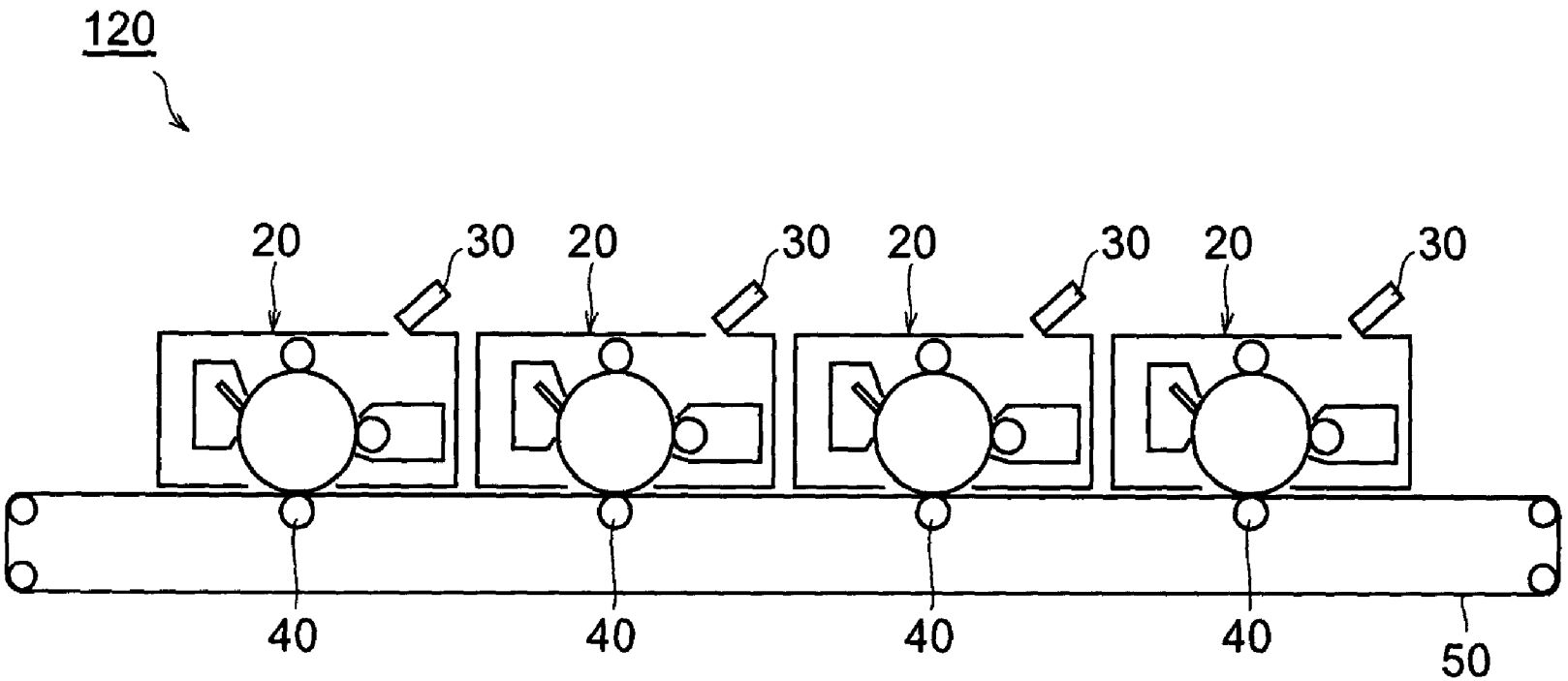
FIG. 8 is a schematic view showing still another preferred embodiment of the image forming apparatus of the invention.

FIG. 8 is a schematic view showing still another embodiment of the image forming apparatus of the invention. The image forming apparatus 120 is a tandem full color image forming apparatus equipped with four process cartridges 20. In the image forming apparatus 120, the four process cartridges 20 are arranged in parallel on an intermediate transfer material 50, and one electrophotographic photoreceptor can be used per one color. The image forming apparatus 120 has the same constitution as the image forming apparatus 100 except for the tandem system.

In the tandem image forming apparatus 120, the electrophotographic photoreceptors of the invention are used as photoreceptors for forming toner images of respective colors. Accordingly, pinhole leakage due to electroconductive foreign matters can be sufficiently suppressed from occurring even upon using for a long period of time, whereby beaded color dot defects can be sufficiently prevented from occurring to form images with high quality for a long period of time.

Figure 9:
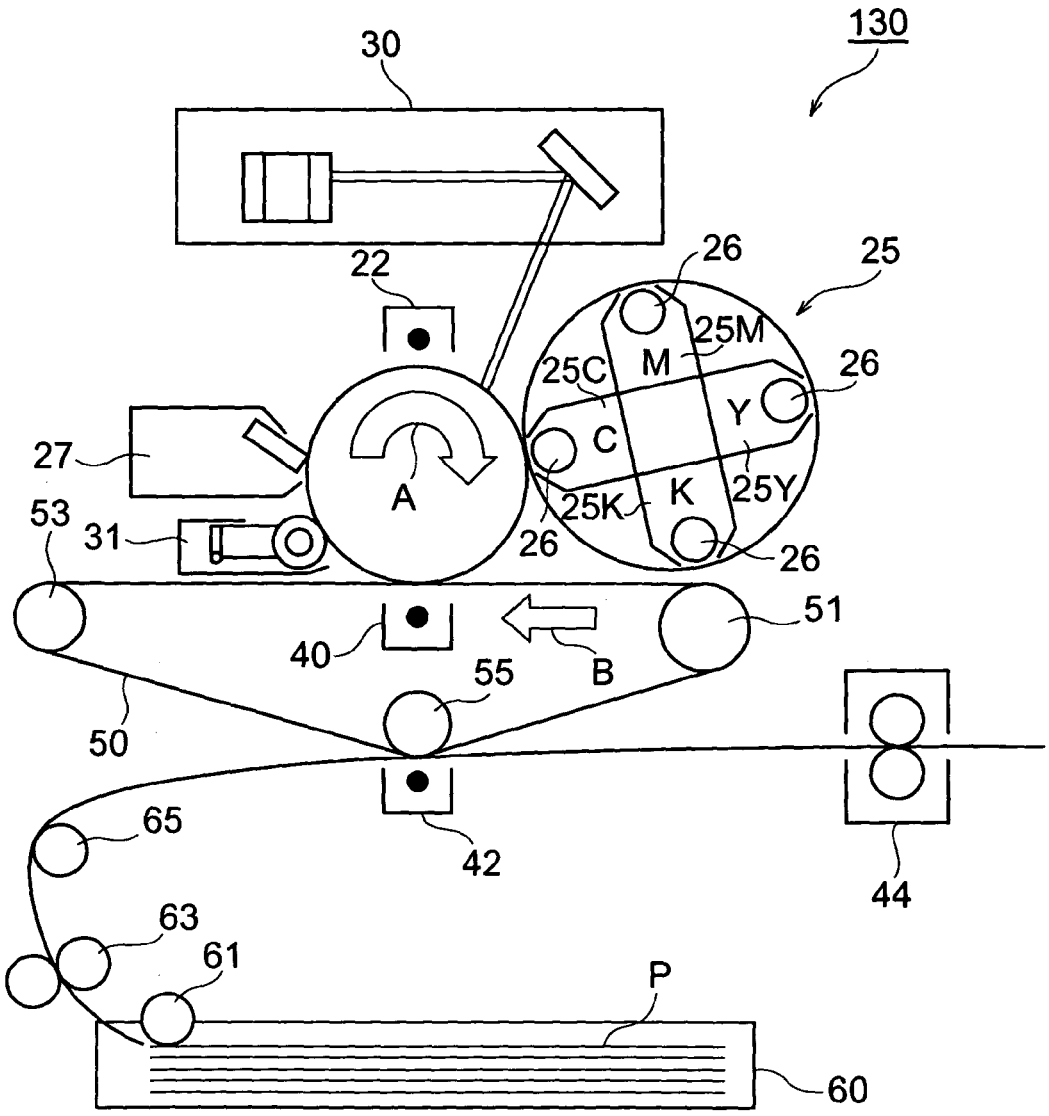
FIG. 9 is a schematic view showing a further preferred embodiment of the image forming apparatus of the invention.

FIG. 9 is a schematic view showing a further embodiment of the image forming apparatus of the invention. The image forming apparatus 130 shown in FIG. 9 is a so-called four-cycle image forming apparatus, in which toner images of plural colors are formed with one electrophotographic photoreceptor. The image forming apparatus 130 has a photoreceptor drum 1 rotating in the direction shown by the arrow A in the figure at a prescribed rotation speed with a driving device, which is not shown in the figure, and a charging device 22 for charging the outer surface of the photoreceptor drum 1 is provided above the photoreceptor drum 1. The photoreceptor drum 1 has the same constitution as the aforementioned electrophotographic photoreceptor 1.

An exposing device 30 having a plane emission laser array as an exposure light source is provided above the charging device 22. The exposing device 30 modulates plural laser beams emitted from the light source corresponding to an image to be formed, and deflects in the main scanning direction to scan the outer surface of the photoreceptor drum 1 in the direction in parallel to the axis of the photoreceptor drum 1. According to the operation, an electrostatic latent image is formed on the outer surface of the photoreceptor drum 1.

A developing device 25 is disposed on the side of the photoreceptor drum 1. The developing device 25 has a container body in a roller form rotatably disposed. The container body has four containers formed therein, and developing units 25Y, 25M, 25C and 25K are provided in the containers, respectively. The developing units 25Y, 25M, 25C and 25K each has a developing roller 26, and contain toners of Y(yellow), M(magenta), C(cyan) and K(black) colors, respectively.

A full color image is formed in the image forming apparatus 130 through four revolutions of the photoreceptor drum 1. During the four revolutions of the photoreceptor drum 1, such an operation is repeated that the charging device 22 charges the outer surface of the photoreceptor drum 1, and the exposing device 20 scans the outer surface of the photoreceptor drum 1 with a laser beam modulated corresponding to image data of one of Y, M, C and K colors, by switching the image data used for modulating the laser beam after completing one revolution of the photoreceptor drum 1. The developing device 25 actuates one of the developing units 25Y, 25M, 25C and 25K, the developing roller 26 of which is in contact with the outer surface of the photoreceptor drum 1, to develop the electrostatic latent image formed on the outer surface of the photoreceptor drum 1 into a specified color, and the operation is repeated by rotating the container body to switch the developing units used for developing the electrostatic latent image after completing one revolution of the photoreceptor drum 1. According to the procedure, toner images of Y(yellow), M(magenta), C(cyan) and K(black) colors are formed on the outer surface of the photoreceptor drum 1 sequentially per one revolution of the photoreceptor drum 1.

An endless intermediate transfer belt 50 is disposed substantially under the photoreceptor drum 1. The intermediate transfer belt 50 is stretched among rollers 51, 53 and 55, and disposed to make the outer surface thereof in contact with the outer surface of the photoreceptor drum 1. The rollers 51, 53 and 55 are rotated by transmitting a driving force of a motor, which is not shown in the figure, to drive the intermediate transfer belt 50 in the direction shown by the arrow B in FIG. 1.

On the side of the intermediate transfer belt 50 opposite to the photoreceptor drum 1, a transferring device (transferring unit) 40 is disposed, and the toner images formed on the outer surface of the photoreceptor drum 1 are transferred to the image forming surface of the intermediate transfer belt 50 with the transferring device 40. The intermediate transfer belt 50 is rotated according to the rotation of the photoreceptor drum 1, and a full color toner image is thus formed on the intermediate transfer belt 50 after completing four revolutions of the photoreceptor drum 1.

On the side of the photoreceptor drum 1 opposite to the developing device 25, a lubricant feeding device 31 and a cleaning device 27 are disposed on the outer surface of the photoreceptor drum 1. After transferring a toner image formed on the outer surface of the photoreceptor drum 1 to the intermediate transfer belt 50, a lubricant is fed to the outer surface of the photoreceptor drum 1 with the lubricant feeding device 31, and the area of the outer surface that retained the toner image having been transferred is cleaned with the cleaning device 27.

A tray 60 is disposed beneath the intermediate transfer belt 50, and a large number of sheets of recording paper P as a recording material are stacked and housed in the tray 60. A pickup roller 61 is disposed at the obliquely upper left of the tray 60, and a pair of rollers 63 and a roller 65 are disposed in this order on the downstream side of the pickup direction of the paper P with the pickup roller 61. The uppermost sheet of the stacked recording paper is picked up from the tray 60 by rotating the pickup roller 61 and conveyed with the pair of rollers 63 and the roller 65.

A transferring device 42 is disposed on the side of the intermediate transfer belt 50 opposite to the roller 55. The paper P conveyed with the pair of rollers 63 and the roller 65 is delivered between the intermediate transfer belt 50 and the transferring device 42, and the toner image formed on the image forming surface of the intermediate transfer belt 50 is transferred to the paper P with the transferring device 42. A fixing device 44 equipped with a pair of fixing rollers is disposed on the downstream side in the conveying direction of the paper with respect to the transferring device 42. The toner image transferred to the paper P is melted and fixed thereon with the fixing device 44, and the paper having the toner image fixed thereon is delivered to the outside of the image forming apparatus 130 and placed on a paper delivery tray, which is not shown in the figure.

Examples of the fixing device 44 include devices having been ordinarily used as the fixing device, such as a heat roll fixing device and an oven fixing device. A toner image transferred onto a transfer medium can be fixed thereon with the fixing device 44.

(Process Cartridge)

Figure 10:
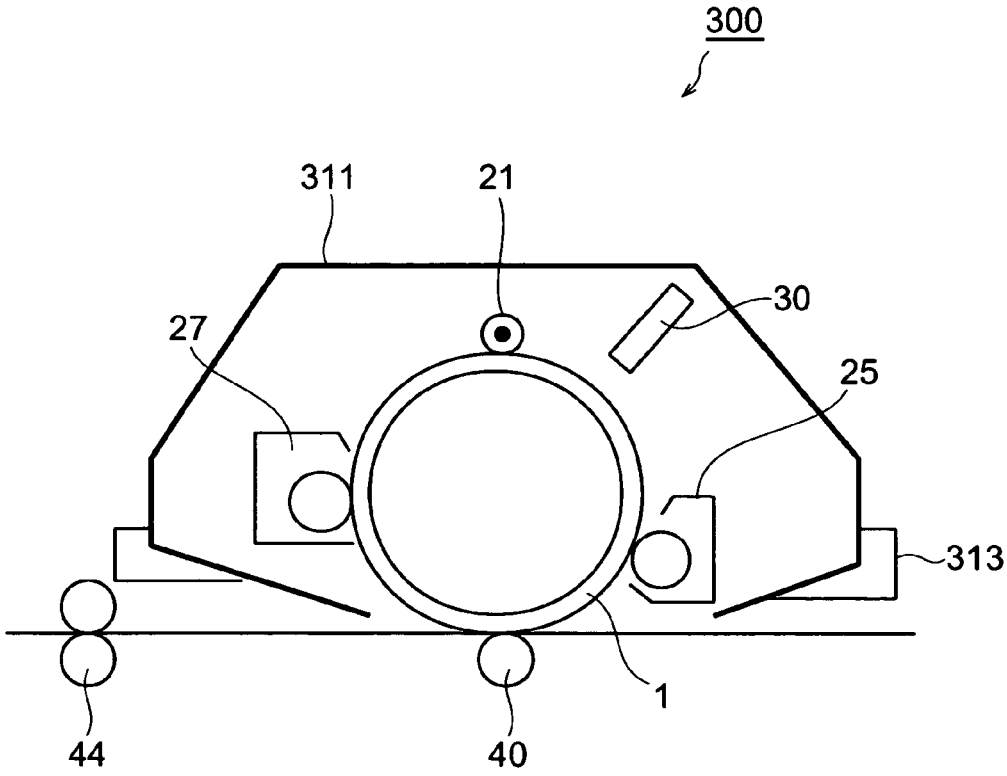
FIG. 10 is a schematic view showing a preferred embodiment of the process cartridge of the invention.
Figure 11:
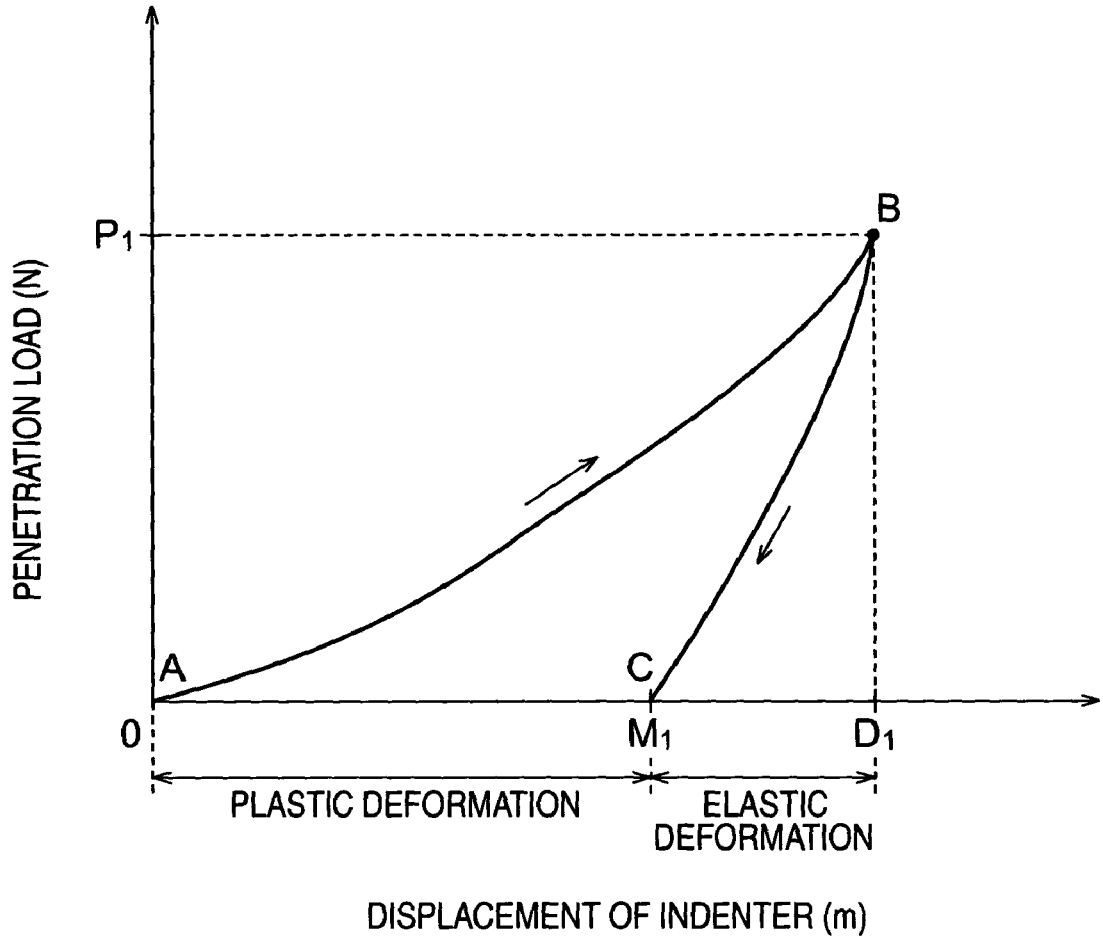
FIG. 11 is an illustrative diagram showing a method for measuring an elastic deformation ratio of a photosensitive layer.

The process cartridge of the invention will be described. FIG. 10 is a schematic view showing a preferred embodiment of the process cartridge of the invention.

The process cartridge 300 has, inside a chassis 311, a charging unit 21, an exposing device 30, a developing unit 25, a cleaning unit 27 and a mounting rail 313, which are integrated along with an electrophotographic photoreceptor 1. The process cartridge 300 is detachably mounted in a main body, which is not shown in the figure, of an image forming apparatus containing a transferring device 40 and a fixing device 44, and constitutes an image forming apparatus along with the main body of the image forming apparatus.

EXAMPLE

The invention will be described in more detail below with reference to examples, but the invention is not construed as being limited to the examples.

(Production of Electrophotographic Photoreceptor)

Example A-1

A cylindrical aluminum support (diameter: 30 mm, length: 404 mm, thickness: 1 mm) is prepared.

Separately, 100 parts by weight of zinc oxide (MZ-300, produced by Tayca Co., Ltd., average particle diameter: 70 nm, specific surface area: 15 $m^2/g$) and 500 parts by weight of tetrahydrofuran are mixed by agitation, to which 1.25 parts by weight of silane coupling agent (KBM603, produced by Shin-Etsu Chemical Co., Ltd.) is added, followed by agitating for 2 hours. Thereafter, tetrahydrofuran is distilled off by distillation under reduced pressure, and baking is conducted at 150° C. for 2 hours to obtain zinc oxide having a surface treated with a silane coupling agent.

100 parts by weight of the zinc oxide having a surface treated with a silane coupling agent and 500 parts by weight of tetrahydrofuran are mixed by agitation, to which a solution obtained by dissolving 1 part by weight of alizarine in 50 parts by weight of tetrahydrofuran is added, followed by agitating at 50° C. for 5 hours. Thereafter, zinc oxide having alizarine attached thereto is filtered by filtering under vacuum filtration and then dried at 60° C. under reduced pressure to obtain a zinc oxide pigment having alizarine attached thereto (a composite containing alizarine and zinc oxide).

100 parts by weight of the zinc oxide pigment having alizarine attached thereto, 13.5 parts by weight of a blocked isocyanate (Sumidule 3175, produced by Sumitomo Bayer Urethane Co., Ltd.) as a hardening agent, 15 parts by weight of butyral resin (S-LEC BM-1, produced by Sekisui Chemical Co., Ltd.) and 85 parts by weight of methyl ethyl ketone are mixed, and 38 parts by weight of the resulting solution and 25 parts by weight of methyl ethyl ketone are mixed, followed by dispersing with a sand mill using glass beads having a diameter of 1 mm for 2 hours, so as to obtain a dispersion liquid. 0.005 part by weight of dioctyltin dilaurate as a catalyst and 40 parts by weight of silicone resin particles (Tospearl 145, produced by GE Toshiba Silicones Co., Ltd.) are added to the resulting dispersion liquid to obtain a coating composition for forming an undercoating layer. The coating composition is coated on the aforementioned aluminum support by a dip coating method, and dried and cured at 170° C. for 40 minutes to obtain an undercoating layer having a thickness of 18 μm.

15 parts by weight of hydroxygallium phthalocyanine having major diffraction peaks of at least 7.3°, 16.0°, 24.9° and 28.0° at Bragg angles (2θ±0.2°) on X-ray diffraction spectrum using CuKα x-rays is mixed with 10 parts by weight of a vinyl chloride-vinyl acetate copolymer resin (VMCH, produced by Nippon Unicar Co., Ltd.) and 200 parts by weight of n-butyl acetate, and the mixture is dispersed with a sand mill along with glass beads having an outer diameter of 1 mm for 4 hours. 175 parts by weight of n-butyl acetate and 180 parts by weight of methyl ethyl ketone are added to the resulting dispersion liquid to prepare a coating composition for forming a charge generating layer. The resulting coating composition is coated on the electroconductive support having the undercoating layer coated thereon by dip coating method, and dried at ordinary temperature to form a charge generating layer having a thickness of 0.2 μm.

4 parts by weight of N,N'-diphenyl-N,N'-bis(3-methylphenyl)-[1,1']biphenyl-4,4'-diamine and 6 parts by weight of a bisphenol Z polycarbonate resin (viscosity average molecular weight: 40,000) are sufficiently dissolved in 80 parts by weight of chlorobenzene to prepare a coating composition for forming a charge transporting layer. The resulting coating composition is coated on the charge generating layer, followed by heating to 130° C. for 45 minutes, to form a charge transporting layer having a thickness of 20 μm.

3 parts by weight of the compound represented by formula (I-2), 3 parts by weight of a resole type phenol resin (RESITOP PL-2211, produced by Gunei Chemical Industry Co., Ltd.), 0.3 part by weight of colloidal silica, 0.5 part by weight of a polyvinyl phenol resin (produced by Sigma Aldrich, Inc.) and 0.4 part by weight of 3,5-di-t-butyl-4-hydroxytoluene (BHT) are added to a mixed solvent of 5 parts by weight of isopropyl alcohol and 5 parts by weight of methyl isobutyl ketone to prepare a coating composition for forming a protective layer. The coating composition is coated on the charge transporting layer by a ring type dip coating method, followed by air drying at room temperature for 30 minutes and curing by heating at 150° C. for 1 hour, so as to form a protective layer having a thickness of 3.5 μm. Consequently, an electrophotographic photoreceptor containing an electroconductive support having provided thereon a photosensitive layer containing an under coating layer, a charge generating layer, a charge transporting layer and a protective layer in this order is obtained. The resulting electroconductive photoreceptor is designated as PR-A-1.

Example A-2

An electrophotographic photoreceptor containing an electroconductive support having provided thereon a photosensitive layer containing an under coating layer, a charge generating layer, a charge transporting layer and a protective layer in this order is obtained in the same manner as in Example A-1 except that the compound represented by formula (I-20) is used instead of the compound represented by formula (I-2). The resulting electroconductive photoreceptor is designated as PR-A-2.

Example A-3

An electrophotographic photoreceptor containing an electroconductive support having provided thereon a photosensitive layer containing an under coating layer, a charge generating layer, a charge transporting layer and a protective layer in this order is obtained in the same manner as in Example A-1 except that the compound represented by formula (11-3) is used instead of the compound represented by formula (I-2). The resulting electroconductive photoreceptor is designated as PR-A-3.

Example A-4

An electrophotographic photoreceptor containing an electroconductive support having provided thereon a photosensitive layer containing an under coating layer, a charge generating layer, a charge transporting layer and a protective layer in this order is obtained in the same manner as in Example A-1 except that the compound represented by formula (II-15) is used instead of the compound represented by formula (I-2). The resulting electroconductive photoreceptor is designated as PR-A-4.

Example A-5

An electrophotographic photoreceptor containing an electroconductive support having provided thereon a photosensitive layer containing an under coating layer, a charge generating layer, a charge transporting layer and a protective layer in this order is obtained in the same manner as in Example A-1 except that the compound represented by formula (IV-2) is used instead of the compound represented by formula (I-2). The resulting electroconductive photoreceptor is designated as PR-A-5.

Example A-6

An electrophotographic photoreceptor containing an electroconductive support having provided thereon a photosensitive layer containing an under coating layer, a charge generating layer, a charge transporting layer and a protective layer in this order is obtained in the same manner as in Example A-1 except that the compound represented by formula (IV-25) is used instead of the compound represented by formula (I-2). The resulting electroconductive photoreceptor is designated as PR-A-6.

Example A-7

An electrophotographic photoreceptor containing an electroconductive support having provided thereon a photosensitive layer containing an under coating layer, a charge generating layer, a charge transporting layer and a protective layer in this order is obtained in the same manner as in Example A-1 except that the compound represented by formula (V-4) is used instead of the compound represented by formula (I-2). The resulting electroconductive photoreceptor is designated as PR-A-7.

Example A-8

An electrophotographic photoreceptor containing an electroconductive support having provided thereon a photosensitive layer containing an under coating layer, a charge generating layer, a charge transporting layer and a protective layer in this order is obtained in the same manner as in Example A-1 except that the compound represented by formula (V-19) is used instead of the compound represented by formula (I-2). The resulting electroconductive photoreceptor is designated as PR-A-8.

Example A-9

A cylindrical aluminum support (diameter: 30 mm, length: 404 mm, thickness: 1 mm) is prepared.

Separately, 100 parts by weight of zinc oxide (MZ-300, produced by Tayca Co., Ltd., average particle diameter: 70 nm) and 500 parts by weight of tetrahydrofuran are mixed by agitation, to which 1.25 parts by weight of silane coupling agent (KBM603, produced by Shin-Etsu Chemical Co., Ltd.) is added, followed by agitating for 2 hours. Thereafter, tetrahydrofuran is distilled off by distillation under reduced pressure, and baking is conducted at 120° C. for 3 hours to obtain zinc oxide having a surface treated with a silane coupling agent.

60 parts by weight of the zinc oxide having a surface treated with a silane coupling agent, 0.6 part by weight of alizarine, 13.5 parts by weight of a blocked isocyanate (Sumidule 3175, produced by Sumitomo Bayer Urethane Co., Ltd.) as a hardening agent, 15 parts by weight of butyral resin (S-LEC BM-1, produced by Sekisui Chemical Co., Ltd.) and 85 parts by weight of methyl ethyl ketone are mixed, and 38 parts by weight of the resulting solution and 25 parts by weight of methyl ethyl ketone are mixed, followed by dispersing with a sand mill using glass beads having a diameter of 1 mm for 2 hours, so as to obtain a dispersion liquid. 0.005 part by weight of dioctyltin dilaurate as a catalyst and 40 parts by weight of silicone resin particles (Tospearl 145, produced by GE Toshiba Silicones Co., Ltd.) are added to the resulting dispersion liquid to obtain a coating composition for forming an undercoating layer. The coating composition is coated on the aforementioned aluminum support by a dip coating method, and dried and cured at 170° C. for 40 minutes to obtain an undercoating layer having a thickness of 25 μm.

15 parts by weight of hydroxygallium phthalocyanine having major diffraction peaks of at least 7.3°, 16.0°, 24.9° and 28.0° at Bragg angles (2θ±0.2°) on X-ray diffraction spectrum using CuKα x-rays is mixed with 10 parts by weight of a vinyl chloride-vinyl acetate copolymer resin (VMCH, produced by Nippon Unicar Co., Ltd.) and 200 parts by weight of n-butyl acetate, and the mixture is dispersed with a sand mill along with glass beads having an outer diameter of 1 mm for 4 hours. 175 parts by weight of n-butyl acetate and 180 parts by weight of methyl ethyl ketone are added to the resulting dispersion liquid to prepare a coating composition for forming a charge generating layer. The resulting coating composition is coated on the electroconductive support having the undercoating layer coated thereon by dip coating method, and dried at ordinary temperature to form a charge generating layer having a thickness of 0.2 μm.

4 parts by weight of N,N'-diphenyl-N,N'-bis(3-methylphenyl)-[1,1']biphenyl-4,4'-diamine and 6 parts by weight of a bisphenol Z polycarbonate resin (viscosity average molecular weight: 40,000) are sufficiently dissolved in 80 parts by weight of chlorobenzene to prepare a coating composition for forming a charge transporting layer. The resulting coating composition is coated on the charge generating layer, followed by heating to 130° C. for 45 minutes, to form a charge transporting layer having a thickness of 20 μm.

3 parts by weight of the compound represented by formula (I-2), 3 parts by weight of a resole type phenol resin (RESITOP PL-1, produced by Gunei Chemical Industry Co., Ltd.), 0.3 part by weight of colloidal silica, 0.5 part by weight of a polyvinyl phenol resin (produced by Sigma Aldrich, Inc.) and 0.4 part by weight of 3,5-di-t-butyl-4-hydroxytoluene (BHT) are added to a mixed solvent of 5 parts by weight of isopropyl alcohol and 5 parts by weight of methyl isobutyl ketone to prepare a coating composition for forming a protective layer. The coating composition is coated on the charge transporting layer by a ring type dip coating method, followed by air drying at room temperature for 30 minutes and curing by heating at 150° C. for 1 hour, so as to form a protective layer having a thickness of 3.5 μm. Consequently, an electrophotographic photoreceptor containing an electroconductive support having provided thereon a photosensitive layer containing an under coating layer, a charge generating layer, a charge transporting layer and a protective layer in this order is obtained. The resulting electroconductive photoreceptor is designated as PR-A-9.

Example A-10

An electrophotographic photoreceptor containing an electroconductive support having provided thereon a photosensitive layer containing an under coating layer, a charge generating layer, a charge transporting layer and a protective layer in this order is obtained in the same manner as in Example A-9 except that the compound represented by formula (I-20) is used instead of the compound represented by formula (I-2). The resulting electroconductive photoreceptor is designated as PR-A-10.

Example A-11

An electrophotographic photoreceptor containing an electroconductive support having provided thereon a photosensitive layer containing an under coating layer, a charge generating layer, a charge transporting layer and a protective layer in this order is obtained in the same manner as in Example A-9 except that the compound represented by formula (II-3) is used instead of the compound represented by formula (I-2). The resulting electroconductive photoreceptor is designated as PR-A-11.

Example A-12

An electrophotographic photoreceptor containing an electroconductive support having provided thereon a photosensitive layer containing an under coating layer, a charge generating layer, a charge transporting layer and a protective layer in this order is obtained in the same manner as in Example A-9 except that the compound represented by formula (11-15) is used instead of the compound represented by formula (I-2). The resulting electroconductive photoreceptor is designated as PR-A-12.

Example A-13

An electrophotographic photoreceptor containing an electroconductive support having provided thereon a photosensitive layer containing an under coating layer, a charge generating layer, a charge transporting layer and a protective layer in this order is obtained in the same manner as in Example A-9 except that the compound represented by formula (IV-2) is used instead of the compound represented by formula (I-2). The resulting electroconductive photoreceptor is designated as PR-A-13.

Example A-14

An electrophotographic photoreceptor containing an electroconductive support having provided thereon a photosensitive layer containing an under coating layer, a charge generating layer, a charge transporting layer and a protective layer in this order is obtained in the same manner as in Example A-9 except that the compound represented by formula (IV-25) is used instead of the compound represented by formula (I-2). The resulting electroconductive photoreceptor is designated as PR-A-14.

Example A-15

An electrophotographic photoreceptor containing an electroconductive support having provided thereon a photosensitive layer containing an under coating layer, a charge generating layer, a charge transporting layer and a protective layer in this order is obtained in the same manner as in Example A-9 except that the compound represented by formula (V-4) is used instead of the compound represented by formula (I-2). The resulting electroconductive photoreceptor is designated as PR-A-15.

Example A-16

An electrophotographic photoreceptor containing an electroconductive support having provided thereon a photosensitive layer containing an under coating layer, a charge generating layer, a charge transporting layer and a protective layer in this order is obtained in the same manner as in Example A-9 except that the compound represented by formula (V-19) is used instead of the compound represented by formula (I-2). The resulting electroconductive photoreceptor is designated as PR-A-16.

Example A-17

The same procedures as in Example A-1 are repeated until the production of the charge transporting layer. Thereafter, a coating composition for forming a protective layer produced in the same manner as in Example A-1 is coated on the charge transporting layer by a ring type dip coating method, followed by curing by heating at 190° C. for 1 hour, so as to form a protective layer having a thickness of 2.8 μm. Consequently, an electrophotographic photoreceptor containing an electroconductive support having provided thereon a photosensitive layer containing an under coating layer, a charge generating layer, a charge transporting layer and a protective layer in this order is obtained. The resulting electroconductive photoreceptor is designated as PR-A-17.

Comparative Example A-1

The same procedures as in Example A-1 are repeated until the production of the charge transporting layer. Thereafter, 2 parts by weight of the compound represented by the following formula (CT-1) and 2 parts by weight of the compound represented by the following formula (CP-1) are added and mixed with a mixed solvent containing 5 parts by weight of isopropyl alcohol, 3 parts by weight of tetrahydrofuran and 0.3 part by weight of distilled water, and 0.05 part by weight of ion exchange resin (Amberlyst 15E, produced by Rohm and Haas Company) was added to the resulting mixture, followed by stirring at room temperature, to effect hydrolysis for 24 hours. In the formula (CT-1), i-Pr represents an isopropyl group.

(CT-1)

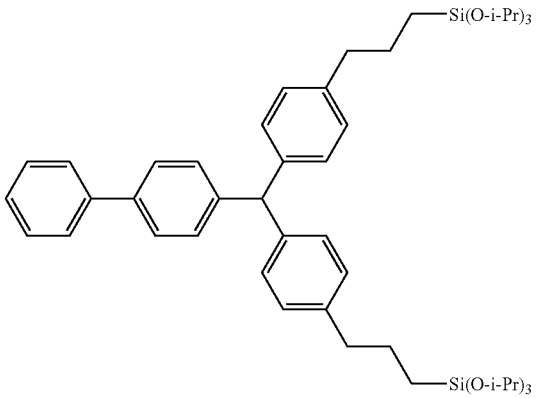

(CP-1)

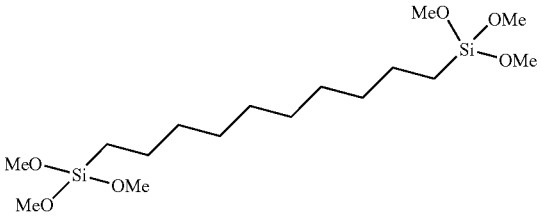

0.04 part by weight of aluminum trisacetylacetonate (Al(aqaq)$_3$) is added to 2 parts by weight of the solution obtained by filtration of the hydrolyzed product to separate from the ion exchange resin, so as to obtain a coating composition for a protective layer. The coating composition is coated on the charge transporting layer by a ring type dip coating method, followed by air drying at room temperature for 10 minutes and curing by heating at 140° C. for 40 minutes, so as to form a protective layer having a thickness of 3 μm. Consequently, an electrophotographic photoreceptor containing an electroconductive support having provided thereon a photosensitive layer containing an under coating layer, a charge generating layer, a charge transporting layer and a protective layer in this order is obtained. The resulting electroconductive photoreceptor is designated as RPR-A-1.

Comparative Example A-2

The same procedures as in Example A-1 are repeated until the production of the charge transporting layer. Thereafter, 10 parts by weight of a polysiloxane resin (containing 1% by weight of silanol group) containing 80% by mol of a methylsiloxane unit and 20% by mol of a methylphenylsiloxane unit is dissolved in 8 parts by weight of toluene, to which 13.0 parts by weight of methyltrisiloxane and 0.2 part by weight of dibutyltin diacetate are further added, to obtain a solution. 20 parts by weight of toluene and 4 parts by weight of 4-(N,N-bis(3,4-dimethylphenyl)amino)-(2-(triethoxysilyl)ethyl) benzene are added to 10 parts by weight of the resulting solution to obtain a coating composition for forming a protective layer. The coating composition is coated on the charge transporting layer by a spray coating method, followed by air drying at 120° C. for 10 minutes and curing by heating at 170° C. for 2 hours, so as to form a protective layer having a thickness of 3 μm. Consequently, an electrophotographic photoreceptor containing an electroconductive support having provided thereon a photosensitive layer containing an under coating layer, a charge generating layer, a charge transporting layer and a protective layer in this order is obtained. The resulting electroconductive photoreceptor is designated as RPR-A-2.

Comparative Example A-3

The same procedures as in Example A-9 are repeated until the production of the charge transporting layer. Thereafter, a coating composition for forming a protective layer produced in the same manner as in Comparative Example A-1 is coated on the charge transporting layer by a ring type dip coating method, followed by air drying at room temperature for 10 minutes and curing by heating at 140° C. for 40 minutes, so as to form a protective layer having a thickness of 3 μm. Consequently, an electrophotographic photoreceptor containing an electroconductive support having provided thereon a photosensitive layer containing an under coating layer, a charge generating layer, a charge transporting layer and a protective layer in this order is obtained. The resulting electroconductive photoreceptor is designated as RPR-A-3.

Comparative Example A-4

The same procedures as in Example A-9 are repeated until the production of the charge transporting layer. Thereafter, a coating composition for forming a protective layer produced in the same manner as in Comparative Example A-2 is coated on the charge transporting layer by a spray coating method, followed by air drying at 120° C. for 10 minutes and curing by heating at 170° C. for 2 hours, so as to form a protective layer having a thickness of 3 μm. Consequently, an electrophotographic photoreceptor containing an electroconductive support having provided thereon a photosensitive layer containing an under coating layer, a charge generating layer, a charge transporting layer and a protective layer in this order is obtained. The resulting electroconductive photoreceptor is designated as RPR-A-4.

Comparative Example A-5

A cylindrical aluminum support (diameter: 30 mm, length: 404 mm, thickness: 1 mm) is prepared.

30 parts by weight of an organic zirconium compound (acetylacetone zirconium butyrate), 3 parts by weight of an organic silane compound (γ-aminopropyltrimethoxysilane), 4 parts by weight of a polyvinyl butyral resin (S-LEC BM-S, produced by Sekisui Chemical Co., Ltd.) and 170 parts by weight of n-butyl alcohol are mixed and agitated to form a coating composition for forming an underlayer, which is coated on the aforementioned aluminum support by a dip coating method, and cured at 150° C. for 1 hour to obtain an undercoating layer having a thickness of 1.2 μm.

A charge generating layer is formed on the undercoating layer, and a charge transporting layer is further formed thereon, in the same manner as in Example A-1.

A coating composition for forming a protective layer produced in the same manner as in Example A-1 is coated on the charge transporting layer by a ring type dip coating method, followed by curing by heating at 190° C. for 1 hour, so as to form a protective layer having a thickness of 2.8 μm. Consequently, an electrophotographic photoreceptor containing an electroconductive support having provided thereon a photosensitive layer containing an under coating layer, a charge generating layer, a charge transporting layer and a protective layer in this order is obtained. The resulting electroconductive photoreceptor is designated as RPR-A-5.

(Measurement of Dynamic Hardness and Elastic Deformation Ratio)

The electrophotographic photoreceptors PR-A-1 to PR-A-17 obtained in Examples A-1 to A-17 and the electrophotographic photoreceptor RPR-A-1 to RPR-A-5 obtained in Comparative Examples A-1 to A-5 are measured for dynamic hardness and elastic deformation ratio of the photosensitive layer according to the following manners. The results obtained are shown in Table 1 below.

(Dynamic Hardness)

The photoreceptor cut into a 10 mm square is set in an ultramicro hardness tester (DUH-201, produced by Shimadzu Corp.) equipped with a Bercovici indenter (a diamond indenter having a triangular pyramid shape with an apical angle of 115° and a nose curvature radius of 0.07 μm), and the hardness of the photosensitive layer is measured in an indenter pressing measure mode (pressing rate: 0.045 mN/sec). Upon measurement, the indenter is pressed onto the photosensitive layer from the side of the protective layer at a pressing load of 0.3 mN, and after maintaining the pressure of 0.3 mN for 1 second, the pressure applied to the indenter is released to 0 mN (releasing rate of pressure: 0.045 mN/sec). A hardness is calculated from the penetration depth upon pressing the indenter with a pressing load of 0.3 mN by using the following equation (1), and the calculated value is designated as the dynamic hardness of the photosensitive layer. The penetration depth is read from the displacement of the indenter, and the penetration load is read from a load cell attached to the indenter:

$$DH=3.8584\times(P/D^2) \quad (1)$$

wherein DH represents the dynamic hardness, P represents the penetration load (N), and D represents the penetration depth (m).

(Elastic Deformation Ratio)

The elastic deformation ratio is calculated from the penetration depth upon pressing the indenter with a pressing load of 0.3 mN and the displacement of the indenter after releasing the load by using the following equation (2):

$$ED=(D-M)/D\times 100 \quad (2)$$

wherein ED represents the elastic deformation ratio(%), M represents the displacement of the indenter after releasing the stress (m), and D represents the penetration depth (m).

Examples (B-1) to (B-17) and Comparative Examples (B-1) to (B-5)

The electrophotographic photoreceptors PR-A-1 to PR-A-17 obtained in Examples A-1 to A-17 and the electrophotographic photoreceptor RPR-A-1 to RPR-A-5 obtained in Comparative Examples A-1 to A-5 are each mounted on a full color printer, DocuPrint C2220, produced by Fuji Xerox Co., Ltd., to produce image forming apparatuses, which are subjected to the following image formation tests 1 and 2.

(Image Formation Test 1)

Image formation is carried out continuously for 30,000 sheets by using the image forming apparatuses under an environment of 30° C. and 85% RH. Thereafter, an image (A3 size) is formed under the same environment, and the image quality thereof is visually evaluated based on the following grades. The results obtained are shown in Table 1 below.

A: favorable

B: negligible color dot defects found

C: conspicuous color dot or color line defects found

The number of color dot defects occurring is counted, and the results obtained are shown in Table 1.

Assuming such a situation that upon using an image forming apparatus for a long period of time, electroconductive materials are emitted from a deteriorated developing device and a deteriorated intermediate transfer material and stick into the photoreceptor, carbon fibers having a cylindrical shape (diameter: 5 to 10 μm, length: 3 to 300 μm) are intentionally added to the toner cartridge of the image forming apparatus. The carbon fibers are added in such an amount that provides a ratio toner/carbon fibers of 1,000/1. Image formation is carried out continuously for 10 sheets by using the image forming apparatuses under an environment of 30° C. and 85% RH, and the tenth image (A3 size) is visually evaluated based on the following grades. The results obtained are shown in Table 1 below.

A: favorable

B: negligible color dot defects found

C: conspicuous color dot or color line defects found

The number of color dot defects with a color dot exceeding 0.2 mm and the number of color dot defects with a color dot of 0.2 mm or less are counted, and the results obtained are shown in Table 1.

TABLE 1

| | Electrophotographic photoreceptor | | | Image formation test 1 (after 30,000 sheets output) | | Image formation test 2 (addition of carbon fibers) | | |
|---|---|---|---|---|---|---|---|---|
| | No. | Dynamic hardness ($\times 10^9$ N/m$^2$) | Elastic deformation ratio (%) | Number of color dots occurred | Image quality | Number of color dots exceeding 0.2 mm | Number of color dots 0.2 mm or less | Image quality |
| Example B-1 | PR-A-1 | 32.6 | 27.5 | 0 | A | 0 | 15 | A |
| Example B-2 | PR-A-2 | 31.0 | 32.6 | 0 | A | 0 | 23 | A |
| Example B-3 | PR-A-3 | 36.8 | 22.6 | 0 | A | 0 | 35 | A |
| Example B-4 | PR-A-4 | 36.9 | 38.1 | 0 | A | 0 | 42 | A |
| Example B-5 | PR-A-5 | 39.9 | 30.4 | 0 | A | 0 | 61 | A |
| Example B-6 | PR-A-6 | 43.2 | 33.1 | 0 | A | 0 | 51 | A |
| Example B-7 | PR-A-7 | 40.2 | 24.3 | 0 | A | 0 | 19 | A |
| Example B-8 | PR-A-8 | 39.7 | 41.1 | 0 | A | 0 | 41 | A |
| Example B-9 | PR-A-9 | 30.5 | 26.3 | 0 | A | 0 | 33 | A |
| Example B-10 | PR-A-10 | 28.8 | 31.8 | 0 | A | 0 | 52 | A |
| Example B-11 | PR-A-11 | 35.4 | 21.5 | 0 | A | 0 | 48 | A |
| Example B-12 | PR-A-12 | 35.9 | 29.1 | 0 | A | 0 | 63 | A |
| Example B-13 | PR-A-13 | 37.7 | 34.0 | 0 | A | 0 | 25 | A |
| Example B-14 | PR-A-14 | 39.8 | 23.3 | 0 | A | 0 | 39 | A |
| Example B-15 | PR-A-15 | 39.1 | 40.0 | 0 | A | 0 | 61 | A |
| Example B-16 | PR-A-16 | 38.8 | 24.3 | 0 | A | 0 | 57 | A |
| Example B-17 | PR-A-17 | 35.3 | 18.9 | 0 | A | 2 | 73 | B |
| Comparative Example B-1 | RPR-A-1 | 13.8 | 30.2 | 5 | B | 0 | 437 | C |
| Comparative Example B-2 | RPR-A-2 | 163.4 | 22.1 | 0 | A | 7 | 10 | C |
| Comparative Example B-3 | RPR-A-3 | 12.2 | 27.3 | 7 | C | 0 | 352 | C |
| Comparative Example B-4 | RPR-A-4 | 159.1 | 21.2 | 0 | A | 9 | 2 | C |
| Comparative Example B-5 | RPR-A-5 | 37.2 | 13.1 | 2 | B | 15 | 38 | C |

As shown in Table 1, it is confirmed that the image forming apparatuses of Examples (B-1) to (B-17) equipped with a photoreceptor containing a photosensitive layer having a dynamic hardness of from $20\times10^9$ to $150\times10^9$ N/m$^2$ and an elastic deformation ratio of from 15 to 80% form favorable images in the image formation tests 1 and 2. Therefore, according to the invention, image defects caused by leakage can be sufficiently prevented from occurring to form images with high image quality for a long period of time.

It is confirmed that the image forming apparatuses of Comparative Examples (B-1) and (B-3) equipped with a photoreceptor containing a photosensitive layer having a dynamic hardness of less than $20\times10^9$ N/m$^2$ cannot form a favorable image in the image formation tests 1 and 2. It is confirmed that the image forming apparatuses of Comparative Examples (B-2) and (B-4) equipped with a photoreceptor containing a photosensitive layer having a dynamic hardness exceeding $150\times10^9$ N/m$^2$ suffer from occurrence of a large number of color dots exceeding 0.2 mm, which may be ascribed to flaws and cracks of the photosensitive layer. It is confirmed that the image forming apparatus of Comparative Example (B-5) equipped with a photoreceptor containing a photosensitive layer having an elastic deformation ration of less than 15% cannot form a favorable image in the image formation tests 1 and 2, and suffers from occurrence of a large number of color dots exceeding 0.2 mm, which may be ascribed to flaws and cracks of the photosensitive layer.

According to the invention, such an electrophotographic photoreceptor is provided that is capable of sufficiently preventing image defects caused by leakage from being generated to provide a prolonged service life and high image quality, and such a process cartridge and an image forming apparatus are provided that have the electrophotographic photoreceptor to attain a prolonged service life and high image quality.

The entire disclosure of Japanese Patent Application No. 2005-274621 filed on Sep. 21, 2005 including specification, claims, drawings and abstract is incorporated herein by reference in its entirely.

What is claimed is:

1. An electrophotographic photoreceptor comprising:

an electroconductive support; and a photosensitive layer on the electroconductive support, wherein the photosensitive layer has a dynamic hardness of from $20\times10^9$ to $150\times10^9$ N/m$^2$ and an elastic deformation ratio of from 15 to 80%;

the photosensitive layer comprises a phenol resin-containing layer on the farthest side of the photosensitive layer from the electroconductive support, the phenol resin-containing layer comprising a phenol resin having a crosslinked structure and charge transporting property;

the phenol resin is formed from: a phenol derivative having a methylol group; and a charge transporting material having a reactive functional group;

the charge transporting material is represented by formula (IV):

(IV)

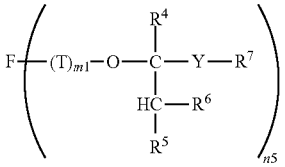

wherein F represents a n5-valent organic group having a positive hole transporting capability, T represents a divalent group, Y represents an oxygen atom or a sulfur atom, $R^4$, $R^5$ and $R^6$ each independently represents a hydrogen atom or a monovalent organic group, $R^7$ represents a monovalent organic group, m1 represents 0 or 1, and n5 represents an integer of from 1 to 4, provided that $R^6$ and $R^7$ may be bonded to form a heterocyclic ring containing Y as a hetero atom;

the photosensitive layer comprises an undercoating layer on a side of the electroconductive support, the undercoating layer comprises a composite of an acceptive compound having an anthraquinone structure and metallic oxide fine particles, and a thickness of the undercoating layer is from 15 μm to 50 μm.

2. The electrophotographic photoreceptor as claimed in claim 1, wherein the acceptive compound having a group capable of being bonded to the metallic oxide fine particles through reaction therewith.

3. The electrophotographic photoreceptor as claimed in claim 1, wherein the charge transporting material having a reactive functional group is a charge transporting material having at least one reactive functional group selected from the group consisting of a hydroxyl group, a carboxyl group, an alkoxysilyl group, an epoxy group, a carbonate group, a thiol group and an amino group.

4. A process cartridge comprising:

an electrophotographic photoreceptor which comprises an electroconductive support; and a photosensitive layer on the electroconductive support, wherein the photosensitive layer having a dynamic hardness of from $20\times10^9$ to $150\times10^9$ N/m$^2$ and an elastic deformation ratio of from 15 to 80%;

the photosensitive layer comprises a phenol resin-containing layer on the farthest side of the potosensitive layer from the electrocondutice support, the phenol resin-containing layer comprising a phenol resin having a crosslinked structure and charge transporting property;

the phenol resing is formed; a phenol derivative having a methylol group; and a charge transportin material having a reactive functional group;

at least one selected from the group consisting of a charging unit charging the electrophotographic photoreceptor, a developing unit developing an electrostatic latent image formed on the electrophotographic photoreceptor with a toner to from a toner image, and a cleaning unit removing the toner remaining on a surface of the electrophotographic photoreceptor;

the charge transporting material is represented by formula (IV):

(IV)

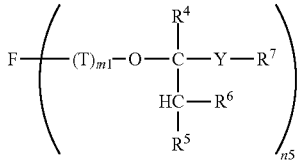

wherein F represents a n5-valent organic group having a positive hole transporting capability, T represents a divalent group, Y represents an oxygen atom or a sulfur atom, $R^4$, $R^5$ and $R^6$ each independently represents a hydrogen atom or a monovalent organic group, $R^7$ represents a monovalent organic group, m1 represents 0 or 1, and n5 represents an integer of from 1 to 4, provided that $R^6$ and $R^7$ may be bonded to form a heterocyclic ring containing Y as a hetero atom;

the photosensitive layer comprises an undercoating layer on a side of the electroconductive support, the undercoating layer comprises a composite of an acceptive compound having an anthraquinone structure and metallic oxide fine particles, and a thickness of the undercoating layer is from 15 μm to 50 μm.

5. The process cartridge as claimed in claim 4, wherein the acceptive compound having a group capable of being bonded to the metallic oxide fine particles through reaction therewith.

6. The process cartridge as claimed in claim 4, wherein the charge transporting material having a reactive functional group is a charge transporting material having at least one reactive functional group selected from the group consisting of a hydroxyl group, a carboxyl group, an alkoxysilyl group, an epoxy group, a carbonate group, a thiol group and an amino group.

7. An image forming apparatus comprising:

an electrophotographic photoreceptor which comprises an electroconductive support; and a photosensitive layer on the electroconductive support, wherein the photosensitive layer having a dynamic hardness of from $20\times10^9$ to $150\times10^9$ N/m$^2$ and an elastic deformation ratio of from 15 to 80%;

the photosensitive layer comprises a phenol resin-containing layer on the farthest side of the photosensitive layer from the electroconductive support, the phenol resin-containing layer comprising a phenol resin having a crosslinked structure and charge transporting property;

the phenol resin is formed from: a phenol derivative having a methylol group; and a charge transporting material having a reactive functional group; and the charge transporting material is represented by formula (IV):

(IV)

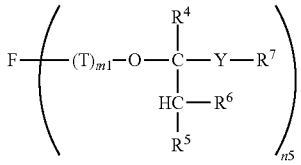

wherein F represents a n5-valent organic group having a positive hole transporting capability, T represents a divalent group, Y represents an oxygen atom or a sulfur atom, $R^4$, $R^5$ and $R^6$ each independently represents a hydrogen atom or a monovalent organic group, $R^7$ represents a monovalent organic group, m1 represents 0 or 1, and n5 represents an integer of from 1 to 4, provided that $R^6$ and $R^7$ may be bonded to form a heterocyclic ring containing Y as a hetero atom; p1 the photosensitive layer comprises an undercoating layer on a side of the electroconductive support, the undercoating layer comprises a composite of an acceptive compound having an anthraquinone structure and metallic oxide fine particles;

a charging unit charging the electrophotographic photoreceptor;

an exposing unit forming an electrostatic latent image on the electrophotographic photoreceptor charged;

a developing unit developing an electrostatic latent image with a toner to form a toner image;

a transferring unit transferring the toner image from the electrophotographic photoreceptor to a transferring material, and a thickness of the undercoating layer is from 15 μm to 50 μm.

8. The image forming apparatus as claimed in claim 7, wherein the acceptive compound having a group capable of being bonded to the metallic oxide fine particles through reaction therewith.

9. The image forming apparatus as claimed in claim 7, wherein the charge transporting material having a reactive functional group is a charge transporting material having at least one reactive functional group selected from the group consisting of a hydroxyl group, a carboxyl group, an alkoxysilyl group, an epoxy group, a carbonate group, a thiol group and an amino group.

10. The electrophotographic photoreceptor as claimed in claim 1, wherein the acceptive compound is selected from the group consisting of anthraquinone, alizarin, quinizarine, anthrarufin, and purpurin.

11. The process cartridge as claimed in claim 4, wherein the acceptive compound is selected from the group consisting of anthraquinone, alizarin, quinizarine, anthrarufin, and purpurin.

12. The image forming apparatus as claimed in claim 7, wherein the acceptive compound is selected from the group consisting of anthraquinone, alizarin, quinizarine, anthrarufin, and purpurin.

13. The electrophotographic photoreceptor as claimed in claim 10, wherein the acceptive compound is alizarin.

14. The process cartridge as claimed in claim 11, wherein the acceptive compound is alizarin.

15. The image forming apparatus as claimed in claim 12, wherein the acceptive compound is alizarin.

16. The electrophotographic photoreceptor as claimed in claim 1, wherein a thickness of the undercoating layer is from 17 μm to 30 μm.

17. The process cartridge as claimed in claim 4, wherein a thickness of the undercoating layer is from 17 μm to 30 μm.

18. The image forming apparatus as claimed in claim 7, wherein a thickness of the undercoating layer is from 17 μm to 30 μm.

* * * * *